US009879516B2

(12) United States Patent
Hughes et al.

(10) Patent No.: US 9,879,516 B2
(45) Date of Patent: Jan. 30, 2018

(54) MULTI-WELL SOLUTION MINING EXPLOITATION OF AN EVAPORITE MINERAL STRATUM

(71) Applicant: SOLVAY SA, Brussels (BE)

(72) Inventors: Ronald O. Hughes, Green River, WY (US); Matteo Paperini, Green River, WY (US); Herve Cuche, Waterloo (BE); Joseph A. Vendetti, Green River, WY (US); Larry C. Refsdal, Green River, WY (US); Jean-Paul Detournay, Floreffe (BE); David M. Hansen, Green River, WY (US); Todd Brichacek, Green River, WY (US); Justin T. Patterson, Mountain View, WY (US); John Kolesar, Green River, WY (US); Ryan Schmidt, Green River, WY (US); Beatrice C. Ortego, Katy, TX (US)

(73) Assignee: Solvay SA, Brussels (BE)

( * ) Notice: Subject to any disclaimer, the term of this patent is extended or adjusted under 35 U.S.C. 154(b) by 0 days.

(21) Appl. No.: 14/657,448

(22) Filed: Mar. 13, 2015

(65) Prior Publication Data

US 2015/0260025 A1 Sep. 17, 2015

Related U.S. Application Data

(60) Provisional application No. 61/953,378, filed on Mar. 14, 2014.

(51) Int. Cl.

*E21B 43/28* (2006.01)
*C22B 26/10* (2006.01)
(Continued)

(52) U.S. Cl.

CPC ..... *E21B 43/28* (2013.01); *C22B 3/46* (2013.01); *C22B 26/10* (2013.01); *E21B 43/283* (2013.01); *E21B 43/30* (2013.01); *E21B 43/305* (2013.01)

(58) Field of Classification Search

CPC ..... E21B 43/283; E21B 43/285; E21B 43/29
See application file for complete search history.

(56) References Cited

U.S. PATENT DOCUMENTS 2,388,009 A 10/1945 Pike
2,625,384 A 1/1953 Pike et al.
(Continued)

FOREIGN PATENT DOCUMENTS

GB 897566 A 5/1962
GB 960112 A 6/1964

OTHER PUBLICATIONS

Frint, Ray; "FMC Newest Goal: Commercial Solution Mining of Trona", Sep. 1985, Engineering and Mining Journal, FMC Report, pp. 3D and pp. 26-31; 7 pgs.

*Primary Examiner* — David J Bagnell
*Assistant Examiner* — Michael Goodwin
(74) *Attorney, Agent, or Firm* — Beatrice C. Ortego

(57) ABSTRACT

A method for in situ solution mining of a mineral from an underground evaporite stratum using a set of wells in fluid communication with at least one mineral cavity with some wells operated in solvent injection mode and other wells operated in brine production mode and optionally with some inactive wells, comprising switching the operation mode of one or more wells. The evaporite mineral preferably comprises trona. The at least one cavity may be formed by directionally drilled uncased boreholes or by lithological displacement of the evaporite stratum at a weak interface with an underlying insoluble stratum by application of a lifting hydraulic pressure to create an interfacial gap. The
(Continued)

extracted brine can be processed to make valuable products such as soda ash and/or any derivatives thereof. This method can provide more uniform dissolution of mineral in the cavity, minimize flow channeling, minimize sodium bicarbonate blinding for solution mining of incongruent trona ore, and/or may avoid uneven deposit of insolubles.

16 Claims, 16 Drawing Sheets

(51) Int. Cl.
*C22B 3/46* (2006.01)
*E21B 43/30* (2006.01)

(56) References Cited

U.S. PATENT DOCUMENTS 2,818,240 A 12/1957 Livingston
2,847,202 A 8/1958 Pullen, Jr.
2,919,909 A 1/1960 Rule
2,952,449 A 9/1960 Bays
2,966,346 A * 12/1960 Huitt ..... E21B 43/283 166/271
2,979,317 A 4/1961 Bays
3,012,764 A * 12/1961 Jacoby ..... E21B 43/283 299/4
3,018,095 A 1/1962 Redlinger
3,050,290 A 8/1962 Caldwell et al.
3,064,957 A * 11/1962 Jacoby ..... E21B 43/283 166/271
3,086,760 A * 4/1963 Bays ..... E21B 43/283 166/271
3,119,655 A 1/1964 Frint et al.
3,361,540 A 1/1968 Peverley et al.
3,841,705 A * 10/1974 Girard ..... E21B 43/283 166/247
3,941,422 A * 3/1976 Henderson ..... E21B 43/283 299/16
4,005,750 A 2/1977 Shuck
4,082,358 A 4/1978 Learmont
4,249,776 A 2/1981 Shuck et al.
4,398,769 A 8/1983 Jacoby
4,498,706 A 2/1985 Ilardi et al.
4,561,696 A * 12/1985 Graves ..... E21B 43/17 166/271
4,586,752 A 5/1986 Showalter
4,652,054 A 3/1987 Copenhafer et al.
4,815,790 A 3/1989 Rosar et al.
5,246,273 A 9/1993 Rosar
5,262,134 A 11/1993 Frint et al.
7,507,388 B2 3/2009 Ceylan et al.
7,611,208 B2 11/2009 Day et al.
8,057,765 B2 11/2011 Day et al.
2003/0029617 A1 2/2003 Brown et al.
2006/0039842 A1 2/2006 Day et al.
2009/0236899 A1* 9/2009 Geisler ..... B09C 1/02 299/18
2010/0225154 A1 9/2010 Halverson et al.
2011/0127825 A1 6/2011 Hughes et al.
2012/0027516 A1 2/2012 Day et al.
2013/0146293 A1* 6/2013 Zazovsky ..... E21B 43/006 166/308.1
2013/0171048 A1* 7/2013 Phillip ..... E21B 43/34 423/208

* cited by examiner

FIG. 7a
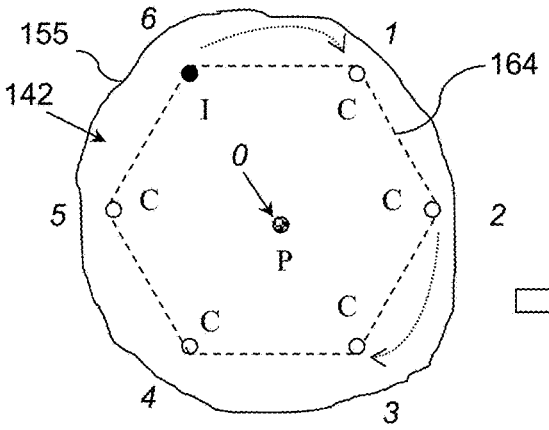
FIG. 7b
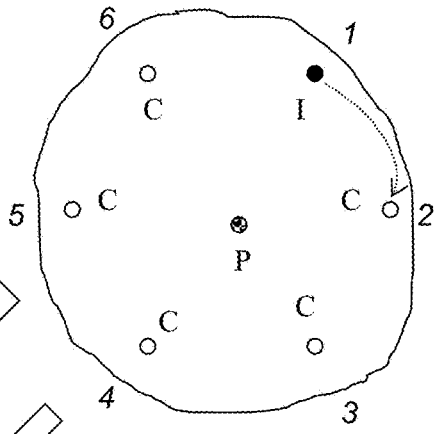
FIG. 7c
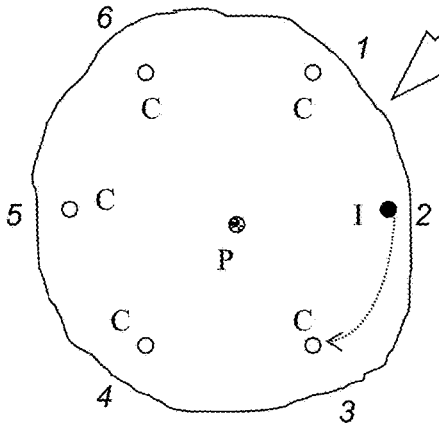
FIG. 7d
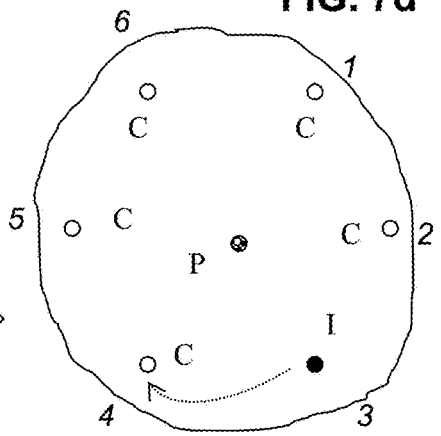
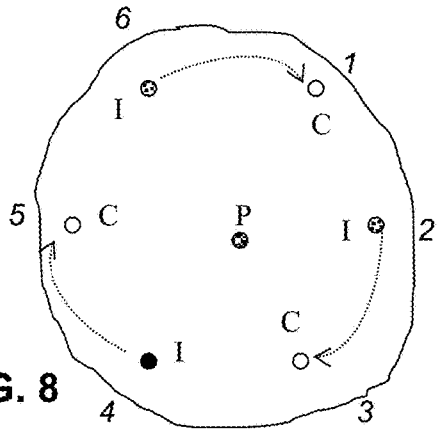
FIG. 8
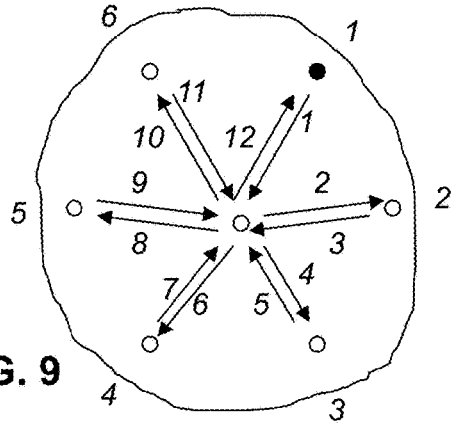
FIG. 9

Method V

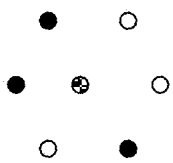
FIG. 20a
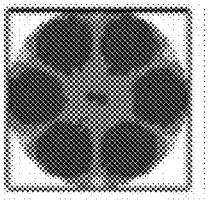
FIG. 20b
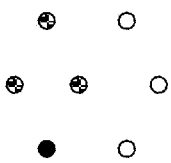
FIG. 21a
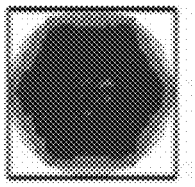
FIG. 21b
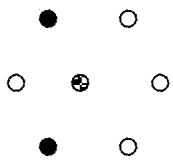
FIG. 22a
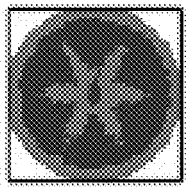
FIG. 22b
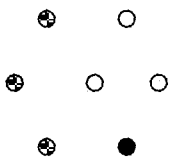
FIG. 23a
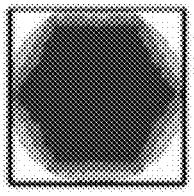
FIG. 23b
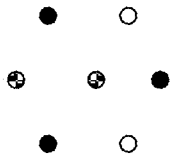
FIG. 24a
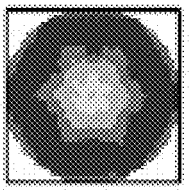
FIG. 24b
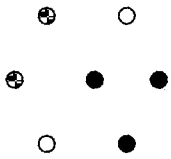
FIG. 25a
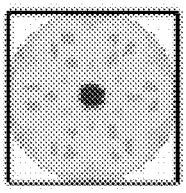
FIG. 25b
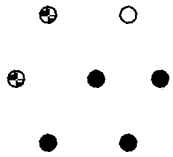
FIG. 26a
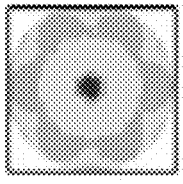
FIG. 26b
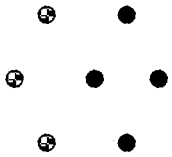
FIG. 27a
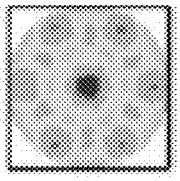
FIG. 27b
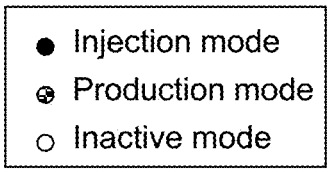

MULTI-WELL SOLUTION MINING EXPLOITATION OF AN EVAPORITE MINERAL STRATUM

CROSS-REFERENCE TO RELATED APPLICATIONS

The present application claims the priority benefit to U.S. provisional application No. 61/953,378 filed on Mar. 14, 2014, the whole content of this application being incorporated herein by reference for all purposes.

STATEMENT REGARDING FEDERALLY SPONSORED RESEARCH OR DEVELOPMENT

Not applicable.

TECHNICAL FIELD OF THE INVENTION

The present invention relates to a method for the continuous exploitation of a mineral cavity provided in an underground evaporite mineral stratum via multi-well solution mining.

BACKGROUND OF THE INVENTION

Sodium carbonate ($Na_2CO_3$), or soda ash, is one of the largest volume alkali commodities made worldwide with a total production in 2008 of 48 million tons. Sodium carbonate finds major use in the glass, chemicals, detergents, paper industries, and also in the sodium bicarbonate production industry. The main processes for sodium carbonate production are the Solvay ammonia synthetic process, the ammonium chloride process, and the trona-based processes.

Trona-based soda ash is obtained from trona ore deposits in the U.S. (southwestern Wyoming in Green River, in California near Searles Lake and Owens Lake), Turkey, China, and Kenya (at Lake Magadi) by underground mechanical mining techniques, by solution mining, or lake waters processing.

Crude trona is a mineral that may contain up to 99% sodium sesquicarbonate (generally about 70-99%). Sodium sesquicarbonate is a sodium carbonate-sodium bicarbonate double salt having the formula ($Na_2CO_3.NaHCO_3.2H_2O$) and which contains 46.90 wt. % $Na_2CO_3$, 37.17 wt. % $NaHCO_3$ and 15.93 wt. % $H_2O$. Crude trona also contains, in lesser amounts, sodium chloride (NaCl), sodium sulfate ($Na_2SO_4$), organic matter, and insolubles such as clay and shales. A typical analysis of the trona ore mined in Green River is shown in TABLE 1.

Other naturally-occurring sodium (bi)carbonate minerals from which sodium carbonate and/or sodium bicarbonate may be produced are known as nahcolite, a mineral which contains mainly sodium bicarbonate and is essentially free of sodium carbonate and known as "wegscheiderite" (also called "decemite") of formula: $Na_2CO_3.3NaHCO_3$.

TABLE 1

| Constituent | Weight Percent |
|---|---|
| $Na_2CO_3$ | 43.2-45 |
| $NaHCO_3$ | 33.7-36 |
| $H_2O$ (crystalline and free moisture) | 15.3-15.6 |
| NaCl | 0.004-0.1 |
| $Na_2SO_4$ | 0.005-0.01 |
| Insolubles | 3.6-7.3 |

In the United States, trona and nahcolite are the principle source minerals for the sodium bicarbonate industry. While sodium bicarbonate can be produced by water dissolution and carbonation of mechanically mined trona ore or of soda ash produced from trona ore, sodium bicarbonate can be produced also by solution mining of nahcolite. The production of sodium bicarbonate typically includes cooling crystallization or a combination of cooling and evaporative crystallization.

The large deposits of mineral trona in the Green River Basin in southwestern Wyoming have been mechanically mined since the late 1940's and have been exploited by five separate mining operations over the intervening period. In 2007, trona-based sodium carbonate from Wyoming comprised about 90% of the total U.S. soda ash production. To recover valuable alkali products, the so-called 'monohydrate' commercial process is frequently used to produce soda ash from trona. When the trona is mechanically mined, crushed trona ore is calcined (i.e., heated) to convert sodium bicarbonate into sodium carbonate, drive off water of crystallization and form crude soda ash. The crude soda ash is then dissolved in water and the insoluble material is separated from the resulting solution. A clear solution of sodium carbonate is fed to a monohydrate crystallizer, e.g., a high temperature evaporator system generally having one or more effects (sometimes called 'evaporator-crystallizer'), where some of the water is evaporated and some of the sodium carbonate forms into sodium carbonate monohydrate crystals ($Na_2CO_3.H_2O$). The sodium carbonate monohydrate crystals are removed from the mother liquor and then dried to convert the crystals to dense soda ash. Most of the mother liquor is recycled back to the evaporator system for additional processing into sodium carbonate monohydrate crystals.

The Wyoming trona deposits are evaporites and hence form various substantially horizontal layers (or beds). The major deposits consists of 25 near horizontal beds varying from 4 feet (1.2 m) to about 36 feet (11 m) in thickness and separated by layers of shales. Depths range from 400 ft (120 m) to 3,300 ft (1,000 m). These deposits contain from about 88% to 95% sesquicarbonate, with the impurities being mainly dolomite and calcite-rich shales and shortite. Some regions of the basin contain soluble impurities, most notably halite (NaCl). These extend for about 1,000 square miles (about 2,600 $km^2$), and it is estimated that they contain over 75 billions tons of soda ash equivalent, thus providing reserves adequate for reasonably foreseeable future needs.

In particular, a main trona bed (No. 17) in the Green River Basin, averaging a thickness of about 8 feet (2.4 m) to about 11 feet (3.3 m) is located from approximately 1,200 feet (about 365 m) to approximately 1,600 feet (about 488 m) below ground surface. Presently, trona from the Wyoming deposits is economically recovered mainly from the main trona bed no. 17. This main bed is located below substantially horizontal layers of sandstones, siltstones and mainly unconsolidated shales. In particular, within about 400 feet (about 122 m) above the main trona bed are layers of mainly weak, laminated green-grey shales and oil shale, interbedded with bands of trona from about 4 feet (about 1.2 m) to about 5 feet thick (about 1.5 m). Immediately below the main trona bed lie substantially horizontal layers of somewhat plastic oil shale, also interbedded with bands of trona. Both overlying and underlying shale layers contain methane gas.

The comparative tensile strengths, in pounds per square inch (psi) or kilopascals (kPa), of trona and shale in average values are substantially as follows:

Shale: 70-140 psi (482-965 kPa)

Trona: 290-560 psi (2,000-3,861 kPa)

Both the immediately overlying shale layer and the immediately underlying shale layer are substantially weaker than the main trona bed. Recovery of the main trona bed, accordingly, essentially comprises removing the only strong layer within its immediate vicinity.

Most mechanical mining operations to extract trona ore practice some form of underground ore extraction using techniques adapted from the coal and potash mining industries. A variety of different systems and mechanical mining techniques (such as longwall mining, shortwall mining, room-and-pillar mining, or various combinations) exist. Although any of these various mining techniques may be employed to mine trona ore, when a mechanical mining technique is used, nowadays it is preferably longwall mining.

All mechanical mining techniques require miners and heavy machinery to be underground to dig out and convey the ore to the surface, including sinking shafts of about 800-2,000 feet (about 240-610 meters) in depth. The cost of the mechanical mining methods for trona is high, representing as much as 40 percent of the production costs for soda ash. Furthermore, recovering trona by these methods becomes more difficult as the thickest beds (more readily accessible reserves) of trona deposits with a high quality (less contaminants) were exploited first and are now being depleted. Thus the production of sodium carbonate using the combination of mechanical mining techniques followed by the monohydrate process is becoming more expensive, as the higher quality trona deposits become depleted and labor and energy costs increase. Furthermore, development of new reserves is expensive, requiring a capital investment of as much as hundreds of million dollars to sink new mining shafts and to install related mining and safety (ventilation) equipment.

Additionally, because some shale is also removed during mechanical mining, this extracted shale must be transported along with the trona ore to the surface refinery, removed from the product stream, and transported back into the mine, or a surface waste pond. These insoluble contaminants not only cost a great deal of money to mine, remove, and handle, they provide very little value back to the mine and refinery operator. Additionally, the crude trona is normally purified to remove or reduce impurities, primarily shale and other nonsoluble materials, before its valuable sodium content can be sold commercially as: soda ash ($Na_2CO_3$), sodium bicarbonate ($NaHCO_3$), caustic soda (NaOH), sodium sesquicarbonate ($Na_2CO_3.NaHCO_3.2H_2O$), a sodium phosphate ($Na_5P_3O_{10}$) or other sodium-containing chemicals.

Recognizing the economic and physical limitations of underground mechanical mining techniques, solution mining of trona has been long touted as an attractive alternative with the first patent U.S. Pat. No. 2,388,009 entitled "Solution Mining of Trona" issued to Pike in 1945. Pike discloses a method of producing soda ash from underground trona deposits in Wyoming by injecting a heated brine containing substantially more carbonate than bicarbonate which is unsaturated with respect to the trona, withdrawing the solution from the formation, removing organic matter from the solution with an adsorbent, separating the solution from the adsorbent, crystallizing, and recovering sodium sesquicarbonate from the solution, calcining the sesquicarbonate to produce soda ash, and re-injecting the mother liquor from the crystallizing step into the formation.

In its simplest form, solution mining of trona is carried out by contacting trona ore with a solvent such as water or an aqueous solution to dissolve the ore and form a liquor (also termed 'brine') containing dissolved sodium values. For contact, the water or aqueous solution is injected into a cavity of the underground formation, to allow the solution to dissolve as much water-soluble trona ore as possible, and then the resulting brine is extracted to the surface. A portion of the brine can be used as feedstock to one or more processes to manufacture one or more sodium-based products, while another brine portion may be re-injected for additional contact with trona.

Solution mining of trona could indeed reduce or eliminate the costs of underground mining including sinking costly mining shafts and employing miners, hoisting, crushing, calcining, dissolving, clarification, solid/liquid/vapor waste handling and environmental compliance. The numerous salt (NaCl) solution mines operating throughout the world exemplify solution mining's potential low cost and environmental impact. But ores containing sodium carbonate and sodium bicarbonate (trona, wegscheiderite) have relatively low solubility in water at room temperature when compared with other evaporite minerals, such as halite (mostly sodium chloride) and sylvite (mostly potassium chloride), which are mined "in situ" with solution mining techniques.

Implementing a solution mining technique to exploit sodium (bi)carbonate-containing ores like trona ore, especially those ores whose thin beds, beds of lower trona quality (e.g., less than 70% quality), and/or deep beds of depth greater than 2,000 ft (610 m) which are currently not economically viable via mechanical mining techniques, has proven to be quite challenging.

In 1945, Pike proposed the use of a single well comprising an outer casing and an inner casing. Hot solvent is injected through the inner casing to contact the trona bed, and the brine is withdrawn through the annulus. This method however proved unsuccessful, and currently there are two approaches to trona solution mining that are being pursued.

A hybrid approach to trona solution mining which is commercially used at the present time is part of an underground tailings disposal projects. Mine operators flood old workings, dissolving the pillars and recovering the dissolved sodium value. Solution mining of mine pillars was disclosed in U.S. Pat. No. 2,625,384 issued to Pike et al in 1953 entitled "Mining Operation"; it uses water as a solvent under ambient temperatures to extract trona from existing mined sections of the trona deposits. Solvay Chemicals, Inc. (SCI), known then as Tenneco Minerals was the first to begin depositing tails, from the refining process back into these mechanically mined voids left behind during normal partial extract operation. This hybrid approach takes advantage of the remnant voids and subsequent exposed surface areas of trona left behind from mechanical mining to both deposit insoluble materials and other contaminants (collectively called tailings or tails) and to recover sodium value from the aqueous solutions used to carry the tails.

Even though 'hybrid' solution mining is one of the preferred mining methods in terms of both safety and productivity, this method is necessarily dependent upon the surface area and openings provided by mechanical mining to make them economically feasible and productive, and there is a finite amount of trona that has been previously mechanically mined. The 'hybrid' solution mining cannot exist in their present form without the necessity of prior mechanical mining in a partial production mode. When current trona target beds will be completely mechanically mined, the mine operators will eventually be forced to move into thinner beds and/or into beds of lower quality and to endure more rigorous mining conditions while the more desirable beds are depleting and finally become exhausted.

A more sustainable approach to trona solution mining would allow the extraction from less desirable beds (thin beds, poor quality beds, and/or deeper beds) which are currently less economically viable, without the negative impact of increased mining hazards and increased costs. In such approach, two or more wells are drilled into the trona bed, and fluid communication between the wells is established by hydraulic fracturing or directional drilling.

Attempts to solution mine trona using vertical boreholes began soon after the 1940's discovery of trona in the Green River Basin in Wyoming. U.S. Pat. No. 3,050,290 entitled "Method of Recovery Sodium Values by Solution Mining of Trona" by Caldwell et al. discloses a process for solution mining of trona that suggests using a mining solution at a temperature of the order of 100-200° C. This process requires the use of recirculating a substantial portion of the mining solution removed from the formation back through the formation to maintain high temperatures of the solution. A bleed stream from the recirculated mining solution is conducted to a recovery process during each cycle and replaced by water or dilute mother liquor. U.S. Pat. No. 3,119,655 entitled "Evaporative Process for Producing Soda Ash from Trona" by Frint et al discloses a process for the recovery of soda ash from trona and recognizes that trona can be recovered by solution mining. This process includes introduction of water heated to about 130° C., and recovery of a solution from the underground formation at 90° C.

Directional drilling from the ground surface has been used to connect dual wells for solution mining bedded evaporite deposits and the production of sodium bicarbonate, potash, and salt. Nahcolite solution mining utilizes directionally drilled boreholes and a hot aqueous solution comprised of dissolved soda ash, sodium bicarbonate, and salt. Development of nahcolite solution mining cavities by using directionally drilled horizontal holes and vertical wells is described in U.S. Pat. No. 4,815,790, issued in 1989 to E. C. Rosar and R. Day, entitled "Nahcolite Solution Mining Process". The use of directional drilling for trona solution mining is described in U.S. Patent Application Pre-Grant Publication No. US 2003/0029617 entitled "Application, Method and System For Single Well Solution Mining" by N. Brown and K. Nesselrode. A well pair per cavity may be used for injection and production. A plurality of lateral boreholes in various configurations such as those described in U.S. Pat. No. 8,057,765, issued in November 2011 to Day et al, entitled "Methods for Constructing Underground Borehole Configurations and Related Solution Mining Methods" is described to improve the lateral expansion of a solution mined cavity in the evaporite deposit.

In the late 1950's-early 1960's, hydraulic fracturing of trona has been proposed, claimed or discussed in patents as a means to connect two wells positioned in a trona bed. See for example U.S. Pat. No. 2,847,202 (1958) by Pullen, entitled "Methods for Mining Salt Using Two Wells Connected by Fluid Fracturing"; U.S. Pat. No. 2,952,449 (1960) by Bays, entitled "Method of Forming Underground Communication Between Boreholes"; U.S. Pat. No. 2,919,909 (1960) by Rule entitled "Controlled Caving For Solution Mining Methods"; U.S. Pat. No. 3,018,095 (1962) by Redlinger et al, entitled "Method of Hydraulic Fracturing in Underground Formations"; and GB 897566 (1962) by Bays entitled "Improvements in or relating to the Hydraulic Mining of Underground Mineral Deposits".

In the 1980's, a borehole trona solution mine attempt by FMC Corporation involved connecting multiple conventionally drilled vertical wells along the base of a preferred trona bed by the use of hydraulic fracturing. FMC published a report (Frint, Engineering & Mining Journal, September 1985 "FMC's Newest Goal: Commercial Solution Mining Of Trona" including "Past attempts and failures") promoting the hydraulic fracture well connection of well pairs as the new development that would commercialize trona solution mining. According to FMC's 1985 article though, the application of hydraulic fracturing for trona solution mining was found to be unreliable. Fracture communication attempts failed in some cases and in other cases gained communication between pre-drilled wells but not in the desired manner. The fracture communication project was eventually abandoned in the early 1990's.

These attempts of in situ solution mining of virgin trona in Wyoming were met with less than limited success, and technologies using hydraulic fracturing to connect wells in a trona bed failed to mature.

In the field of oil and gas drilling and operation however, hydraulic fracturing is a mainstay operation, and it is estimated that more than 60% new wells in 2011 used hydraulic fracturing to extract shale gas. Such hydraulic fracturing often employs directional drilling with horizontal section within a shale formation for the purpose of opening up the formation and increasing the flow of gas therefrom to a particular single well using multi-fracking events from one horizontal borehole in the formation.

Through this technique, it has been established that fractures produced in formations should be approximately perpendicular to the axis of the least stress and that in the general state of stress underground, the three principal stresses are unequal (anisotropic conditions). Where the main stress on the formation is the stress of the overburden, these fractures tend to develop in a vertical or inverted conical direction. Horizontal fractures cannot be produced by hydraulic pressures less than the total pressure of the overburden.

In fracturing between spaced wells in evaporite mineral formations for the purpose of removing the mineral by solution flowing between the adjacent wells, the 'fracking' methods used in the oil & gas industry are however not suitable to accomplish the formation of a single main horizontal fracture. Because the depth of the hydraulically-fractured formation is generally greater than 1,000 meters (3,280 ft), the injection pressures in oil & gas exploration are high, even though they are still less than the overburden pressure; this favors the formation of vertical fractures which increases permeability of the exploited shale formation. The main goal of 'fracking' methods in the oil & gas industry is indeed to increase the permeability of shale. Overburden gradient is generally estimated to be between 0.75 psi/ft (17 kPa/m) and 1.05 psi/ft (23.8 kPa/m), thus what is called the 'fracture gradient' used in oil & gas fracking is less than the overburden gradient, preferably less than 1 psi/ft (22.6 kPa/m), preferably less than 0.95 psi/ft (21.5 kPa/m), sometimes less than 0.9 psi/ft (20.4 kPa/m). The 'fracture gradient' is a factor used to determine formation fracturing pressure as a function of well depth in units of psi/ft. For example, a fracture gradient of 0.7 psi/ft (15.8 kPa/m) in a well with a vertical depth of 2,440 m (8,000 ft) would provide a fracturing pressure of 5,600 psi (38.6 MPa).

Unlike the oil and gas exploration from shale formations where it is desirable to produce numerous vertical fractures near the center of the shale formation to recover the most oil and/or gas therefrom, in the recovery of a soluble mineral from underground evaporite formations, it is desirable to produce a single fracture substantially at the bottom of the evaporite mineral stratum and along the top of the underlying water-insoluble non-evaporite stratum and to direct the fracture to the next adjacent well along the interface between the bottom of the evaporite stratum to be removed and the top of the underlying stratum so that the soluble mineral will be dissolved from the bottom up.

The bottom-up approach for dissolving the mineral from the interface gap (fracture) created substantially at the bottom of the evaporite stratum offers a number of advantages. The less concentrated and less saturated solvent present in the gap rises to a top layer of the solvent body inside the gap due to density gradient, and contacts the roof of the evaporite stratum cavity, dissolves the mineral therefrom, and as the solvent becomes more saturated, settles to a lower layer of the solvent body so that the bottom edge of the evaporite stratum is always exposed to dissolution by less concentrated solvent. The insoluble materials in the evaporite formation can settle through the solvent body to the bottom of the solution-mining cavity and deposit thereon so that only clear solutions are recovered from production wells.

A further advantage of the bottom-up approach for solution mining of mineral from a mature mineral cavity is that it can help minimize contact of the solvent with contaminants-rich minerals (e.g., halite) which may be found in overlying strata such as green shale strata found above a trona stratum. Since these contaminants-rich minerals are generally soluble in the same solvent as the desirable mineral, if solvent flow is allowed to occur to reach contaminated overlying layers, this would allow contaminants from these overlying layers to dissolve into the solvent, thereby "poisoning" the resulting brine and rendering it useless or, at the very least, making its further processing into valuable product(s) very expensive. Indeed, poisoning by sodium chloride from chloride-based minerals can occur during solution mining of trona, and it is suspected that the solution mining efforts by FMC in the 1980's in the Green River Basin were mothballed in the 1990's due to high NaCl contamination in the extracted brine.

Other than chloride poisoning, another complicating factor in dissolving in situ underground double-salt ores like an ore containing sodium sesquicarbonate (main component of trona) or wegscheiderite is that sodium carbonate and sodium bicarbonate have different solubilities and dissolving rates in water. These incongruent solubilities of sodium carbonate and sodium bicarbonate can cause sodium bicarbonate 'blinding' (also termed 'bicarb blinding') during solution mining. Blinding occurs as the bicarbonate, which has dissolved in the mining solution tends to redeposit out of the solution onto the exposed face of the ore as the carbonate saturation in the solution increases, thus clogging the dissolving face and "blinding" its carbonate values from further dissolution and recovery. Blinding can thus slow dissolution and may result in leaving behind significant amounts of reserves in the mine. It can be shown that the aforementioned problem arises because when trona, for example, is dissolved in water, both the sodium bicarbonate and the sodium carbonate fractions begin going into solution at the same time until the solution reaches saturation with respect to sodium bicarbonate. Unfortunately, the resulting liquid phase existing at this point is in equilibrium with sodium bicarbonate in solid phase, and the sodium carbonate continues to dissolve while the bicarbonate starts precipitating out until the final resulting solution is in equilibrium condition with sodium sesquicarbonate (trona) as the stable solid phase, in fact, reached wherein a substantial portion of sodium bicarbonate precipitates out of solution and a lot more of the sodium carbonate has gone into solution. Wegscheiderite behaves in much the same way as trona in that they both go into solution in accordance with their respective solid percentage compositions of sodium bicarbonate and sodium carbonate. It is expected that the deposited sodium bicarbonate is most likely prevalent around a downhole end of a production well during dissolution phase (a), when the sodium bicarbonate content in the brine surrounding the downhole end of this well may be saturated or super-saturated under the conditions of dissolution in this area of the cavity.

Additionally, a phenomenon termed 'channeling' in an ore bed may occur during solution mining. A 'channeling' event describes the tendency of the solvent to find and maintain a path through an area of ore insolubles (e.g., trona insolubles). Once a channel is created, it may result in low or near zero dissolution rates of the surrounding ore, as the solvent bypasses solute-containing ore and fails to expose the mineral solute to the solvent. It is expected however that this phenomenon may not occur or may be disrupted when the solvent flow path is modified periodically.

Some of the problems of prior art solution mining techniques, for example the formation of "morning glory" holes which are generally narrow at the base and flare outward at the top in a generally convex upward cross-sectional floor profile. A variety of techniques have been attempted in order to prevent the formation of such types of holes, since they are very wasteful and since they result in a low percentage of mineral recovery from the bed. One of these techniques involves use of a blanket fluid above the level of the solvent in the cavity to achieve a more or less cylindrical solution-mined cavity. The contact between the solvent and the roof of the ore is prevented by the blanket fluid which is less dense than the solvent (such as a liquid lighter than water, e.g., diesel or liquefied petroleum gas, or a gas, e.g., pressurized air, nitrogen). This blanket fluid forces contact of solvent with the cavity walls, thus controlling the expansion of the cavity in the horizontal direction. But because the blanket fluid prevents contact of solvent with a large surface area of mineral ore on the mineral cavity ceiling, the dissolution rate can be greatly reduced.

Based on the foregoing, there is still a need for a solution mining method which addresses at least one or more of the issues provided above.

SUMMARY OF THE INVENTION

Applicants have developed, in a first aspect, in an underground formation comprising an evaporite mineral stratum, a method for solution mining of such evaporite mineral ore which contains trona, nahcolite, wegscheiderite, or combinations thereof from at least one cavity having a mineral free face. This method comprises:

a) providing a set of wells in fluid communication with at least one cavity, said set comprising a first subset of wells being operated in injection mode and a second subset of separate wells operated in production mode;

b) injecting a solvent into the at least one cavity through the first subset operated in injection mode for the solvent to contact the mineral free face as the solvent flows through the at least one cavity and to dissolve in situ at least a portion of the mineral from the free face into the solvent to form a brine;

c) extracting at least a portion of said brine to the ground surface through the second subset of wells operated in production mode;

d) switching the operation mode of at least one well from the set after a suitable period of time; and (e) repeating the steps (a) to (d).

The at least one cavity may be initially formed from at least one uncased section, preferably from at least one uncased horizontal section, of at least one borehole directionally drilled through the mineral stratum. Alternatively or additionally, the at least one cavity may be initially formed by a lithological displacement of the mineral stratum. Such lithological displacement is performed when said mineral stratum is lying immediately above a water-insoluble stratum of a different composition with a weak parting interface being defined between the two strata and above which is defined an overburden up to the ground, said lithological displacement comprising injecting a fluid at the parting interface to lift the evaporite stratum at a lifting hydraulic pressure greater than the overburden pressure, thereby forming an interface gap which is a nascent mineral cavity at the interface and creating said mineral free-surface.

The at least one cavity is enlarged by dissolution of the ore from the walls of the cavity (e.g., uncased borehole section of a directionally drilled borehole, interfacial gap) in a solvent injected into the cavity.

According to some embodiments to the present invention, the set of wells comprises a number 'n' of wells with n being equal to or greater than 4, and a number of wells less than 'n' are arranged in at least one pattern centered around one or more center well(s). Preferably, a number (n−1) of peripheral wells are arranged in the at least one pattern centered around one center well. In some embodiments, there may be n/2 or (n−1)/2 number of peripheral wells arranged in one pattern centered around n/2 or (n−1)/2 center wells, respectively.

The at least one pattern centered around at least one center well may be at least one polygon with from 3 to up to 16 sides, a honeycomb shape, at least one ovoid shape, or a plurality thereof; preferably a circle, an oval, a polygon with 4 to 6 sides, or a plurality thereof.

The wells in the set may be paired, and wherein cross-over valves are provided and controlled so that the two wells serve alternately as injection and production wells.

The set of wells may comprise from 4 to 100 wells or even more.

When one of the wells switches operation mode in step (d), the solvent injection and brine production for this well may be carried out by a same pump, preferably by a same surface pump.

The set of wells may comprise outermost wells, these wells preferably surrounding innermost wells including one or more centered wells. In such embodiments, switching the operation mode in step (d) for some or all of these outermost wells may be done more frequently than for the innermost wells. In preferred embodiments, switching the operation mode in step (d) for the outermost wells in the set is carried out preferably two times more often, more preferably three times more often, than for the innermost wells.

The step (d) comprises switching the operation mode of at least one well from the first subset and also switching the operation mode of at least one well from the second subset after the suitable period of time.

The step (d) comprises switching the operation mode of two or more wells from the first subset from injection to production and also switching the operation mode of two or more wells from the second subset from production to injection after the given period of time. In some embodiments, the operation mode switching in step (d) is performed on peripheral wells of the set to impart a rotating motion of solvent around a centered well of the set.

As with any of the embodiments described herein, the period of time for switching step (d) may be set based on a pre-determined time schedule. This regular well switching has the advantage of being predictable. As such, manpower may be kept to a minimum, as the switching step (d) may be carried out by an automatic controller which is connected to the flow valve(s) at each well, thus controlling the flow in, the flow out, or stopping flow for each well. For automatic control, the switching sequence between wells may be set at regular time intervals by the mine operator. The timing for well switching may be selected to occur during regular operator working hours so as to oversee the automatically-controlled switch in case there may be a valve malfunction or failure during the switching step (d).

In alternate embodiments, the period of time for switching step (d) may be set based on specific constraints determined from the production output and specific requirements. For example, well switching in step (d) may take place in response to measurement of selected parameters which are identified by the mine operator as key indicators of mineral ore solution mining performance. The key indicator(s) for mineral ore solution mining performance may be at least one parameter, preferably more than one, selected from the group consisting of brine temperature, brine pH, brine outflow rate from each well operated in production mode, insolubles content, brine concentration of desired mineral ore, content in solvent-soluble impurities, and any combinations thereof. Examples of such key indicators of trona solution mining performance which may trigger well switching may be a brine sodium bicarbonate content exceeding a maximum target level; a brine Total Alkalinity content below a minimum target level; a brine content in sodium chloride, in sodium sulfate, in organics (such as total organic content, or total dissolved organics content) exceeding their respective maximum threshold level; and/or a brine outflow rate below a minimum target level.

In alternate embodiments the well switching (d) may be performed at random or semi-random times and wells sequence in order to encourage an even dissolution of the ore stratum.

The suitable period of time for switching operation mode in step (d) may be from 1 hour to 1 week. The steps (b) to (d) may be carried out in the cavity at a pressure from less than the lifting hydraulic pressure (which is used during the lithological displacement of the mineral ore to create the interfacial gap) to less than hydrostatic head pressure.

The method may further comprise: carrying out step (f) switching at least one well from the first or second subset which is operated under injection or production mode to an inactive mode; carrying out step (f'): switching at least one well in inactive mode from the well set to an injection or production mode; or carrying out step (f) and (f') simultaneously on at least two different wells from the set.

Steps (f) and (f') may be carried out at the same time, with the one or more wells switched in step (f) being different than the one or more wells switched in step (f'). Steps (f) and (f') may be carried out simultaneously when there is a need to alter flow patterns inside the cavity and/or to locally adjust liquid flow rates.

Step (f) or step (f') may be carried out when there is a need to adjust the overall flow rate of solvent into the cavity or the overall flow rate of brine out of the cavity.

The at least one cavity may be initially formed from at least one uncased section, preferably from at least one uncased horizontal section, of a borehole directionally drilled through the mineral stratum.

The at least one cavity may be initially formed by a lithological displacement of the mineral stratum, said lithological displacement being performed when said mineral stratum is lying immediately above a water-insoluble stratum of a different composition with a weak parting interface being defined between the two strata and above which is defined an overburden up to the ground, said lithological displacement comprising injecting a fluid at the parting interface to lift the evaporite stratum at a lifting hydraulic pressure greater than the overburden pressure, thereby forming an interface gap which is a nascent mineral cavity at the interface and creating a mineral free-surface. The lifting hydraulic pressure applied may be characterized by a fracture gradient between 0.9 psi/ft (20.4 kPa/m) and 1.5 psi/ft (34 kPa/m), preferably between 0.95 psi/ft and 1.3 psi/ft, more preferably between 0.95 psi/ft and 1.2 psi/ft, most preferably between 1 psi/ft and 1.1 psi/ft. The lifting hydraulic pressure may be from 0.01% to 50% greater than the overburden pressure at the depth of the interface. The parting interface may be horizontal or near-horizontal with a dip of 5 degrees or less, but not necessarily. In some embodiments, the defined parting interface 20 may have a dip greater than 5 degrees up to 45 degrees.

In some embodiments, a proppant material may be injected into the interface during lithological displacement which would allow to keep the interface gas open. This 'propping' would permit any subsequent injection of solvent in the interface gap to be carried out at a pressure below the overburden lifting pressure.

One advantage of the method according to the present invention may be to obtain a more uniform dissolution of the evaporite mineral ore in the cavity. Since the ore will dissolve more readily at the injection point where dissolution conditions are more favorable (e.g., unsaturated solvent, higher solvent temperature), the ever-changing movement of the injection point(s) allows for contact with freshly-injected solvent throughout the cavity and not at one or more fixed injections points. For dissolution uniformity when step (d) is repeated in the method, it is preferred that the switching of the operation mode in step (d) is not carried out on the same well(s) in the set. By switching the operation mode of different wells in a multi-well set in the repetition of steps (d), the present method should provide at least 70% uniformity of dissolution in the cavity, preferably at least 75% uniformity of dissolution, more preferably at least 80% uniformity of dissolution, most preferably at least 85% uniformity of dissolution. For example, for a 7-well hexagonal well arrangement, the present method could achieve from 85% up to 99% uniformity of dissolution, or more specifically from 87% to 99% uniformity of dissolution, or even more specifically from 87% to 95% uniformity of dissolution. It is expected that applying various alternative patterns for switching of operation mode in step (d) could achieve very close to 100% uniformity of dissolution.

Another advantage of such method may be to better control cavity development configuration, thus reducing the formation of morning-glory cavities and/or reducing the necking down or barbell cavity configuration with a continuous unidirectional solvent flow from an injection well to a production well.

Another advantage of such method would be to maintain the geomechanical integrity of the cavity being mined.

Yet another advantage of such method may be to reduce the phenomenon of sodium bicarbonate 'blinding' during solution mining of a mineral ore containing sodium sesquicarbonate (main component of trona) or wegscheiderite. Switching the well operation from production to injection in this area targets re-dissolution of deposited sodium bicarbonate around the downhole end of such well and prevent possible plugging of a brine production tubing string in the production well.

Still another advantage of such method may be to reduce the phenomenon of "channeling" as explained above.

Still yet another advantage of such method may be to avoid uneven deposit of ore insolubles which deposit at the bottom of the cavity during dissolution.

Another advantage may be to obtain a specific motion of solvent around a centered production well, such as triggering various solvent injection events in peripheral wells arranged around the centered production well to form a slowly rotating mass of nearly homogenous brine at or near saturation at the production well.

Yet another advantage may be to obtain a first rotating motion of solvent around a centered production well, such as triggering various solvent injection events in peripheral wells arranged around the centered production well to form a slowly rotating mass of nearly homogenous brine at or near saturation at the production well, and then reversing the rotating motion of solvent around the same centered production (such as triggering the various solvent injection events in peripheral wells but in reversed order).

One advantage of the present invention is the continuous solvent injection and brine production—as opposed to batch fashion, in that there is no time lost in injecting solvent in the cavity, waiting for enrichment and eventually approaching saturation of the solvent with dissolved mineral, and then pumping out the brine.

An additional advantage of the continuous mode well-switching process as opposed to a batch process is that the continuous well-switching method efficiently avoids high vertical dissolution over small areas that would likely lead to problems related to geomechanical instability of the cavity being solution mined.

A second aspect of the present invention relates to a manufacturing process for making one or more sodium-based products from an evaporite mineral stratum comprises a water-soluble mineral selected from the group consisting of trona, nahcolite, wegscheiderite, and combinations thereof, preferably from an evaporite mineral stratum comprising trona, such process comprising:

carrying out the method according to the first aspect of the present invention to dissolve the water-soluble mineral ore from a cavity in the evaporite mineral stratum to obtain a brine comprising sodium carbonate and/or sodium bicarbonate, and passing at least a portion of said brine through one or more units selected from the group consisting of a crystallizer, a reactor, and an electrodialysis unit, to form at least one sodium-based product. The at least one sodium-based product is preferably selected from the group consisting of soda ash, sodium bicarbonate, sodium hydroxide, sodium sulfite, sodium sesquicarbonate, any sodium carbonate hydrates, and any combinations thereof.

A third aspect of the present invention relates to a sodium-based product selected from the group of consisting sodium sesquicarbonate, sodium carbonate monohydrate, sodium carbonate decahydrate, sodium carbonate heptahydrate, anhydrous sodium carbonate, sodium bicarbonate, sodium sulfite, sodium bisulfite, and sodium hydroxide, being obtained by the manufacturing process according to the second aspect of the present invention.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other methods for carrying out the same purposes of the present invention. It should also be realized by those skilled in the art that such equivalent constructions or methods do not depart from the spirit and scope of the invention as set forth in the appended claims.

BRIEF DESCRIPTION OF THE DRAWINGS

For a detailed description of the preferred embodiments of the invention, reference will now be made to the accompanying drawings which are provided for example and not limitation, in which:

FIGS. 7*a*, 7*b*, 7*c*, and 7*d* illustrate various embodiments of step (d) according to the present invention, comprising switching some wells in a 7-well set comprising a center well and 6 peripheral wells in fluid communication with a cavity formed by lithological displacement of a trona stratum, in which, at suitable time intervals, solvent injection flow is switched from one peripheral well to the next adjacent peripheral well around the perimeter of the cavity in a rotational fashion—that is to say, injecting from each successive peripheral well in a clockwise fashion while closing the other peripheral well —, and brine is extracted to the surface from the center well operated as a production well;

FIG. 8 illustrates another embodiment of step (d) according to the present invention, comprising switching some wells in a 7-well set comprising a center well and peripheral wells in fluid communication with a cavity formed by lithological displacement of a trona stratum, in which at suitable time intervals, the mine operator simultaneously switches three of the peripheral wells from closed to production mode while the other peripheral wells which were producing are closed;

FIG. 9 illustrates yet another embodiment of step (d) according to the present invention, comprising switching some wells in a 7-well set comprising a center well and peripheral wells in fluid communication with a cavity formed by lithological displacement of a trona stratum, in which at proper time intervals, the mine operator switches the inner well from production to injection and switches a peripheral well from injection to production well; reversing this step; and carrying a similar dual-switch on the immediately adjacent peripheral well—thus "firing" each successive peripheral well around the cavity perimeter;

FIG. 20*a*, 21*a*, 22*a*, 23*a*, 24*a* illustrate 7-well fundamental flow patterns of Examples 1A, 1D, 1G, 1J, and 1M respectively, according to various embodiments of the present invention, while FIG. 20*b*, 21*b*, 22*b*, 23*b*, 24*b* illustrate the resulting uniform cavity dissolution by using each respective fundamental flow pattern and its derived flow patterns, the darker color indicating areas of greater vertical dissolution; and FIG. 25*a*, 26*a*, 27*a* illustrate 7-well fundamental flow patterns of Examples 1P, 1Q, 1R, respectively, according to other embodiments of the present invention, while FIG. 25*b*, 26*b*, 27*b* illustrate the resulting uneven and poor cavity dissolution by using each respective fundamental flow pattern and its derived patterns, the lighter color indicating areas of poor vertical dissolution.

On the figures, identical numbers correspond to similar references.

Figure 1:
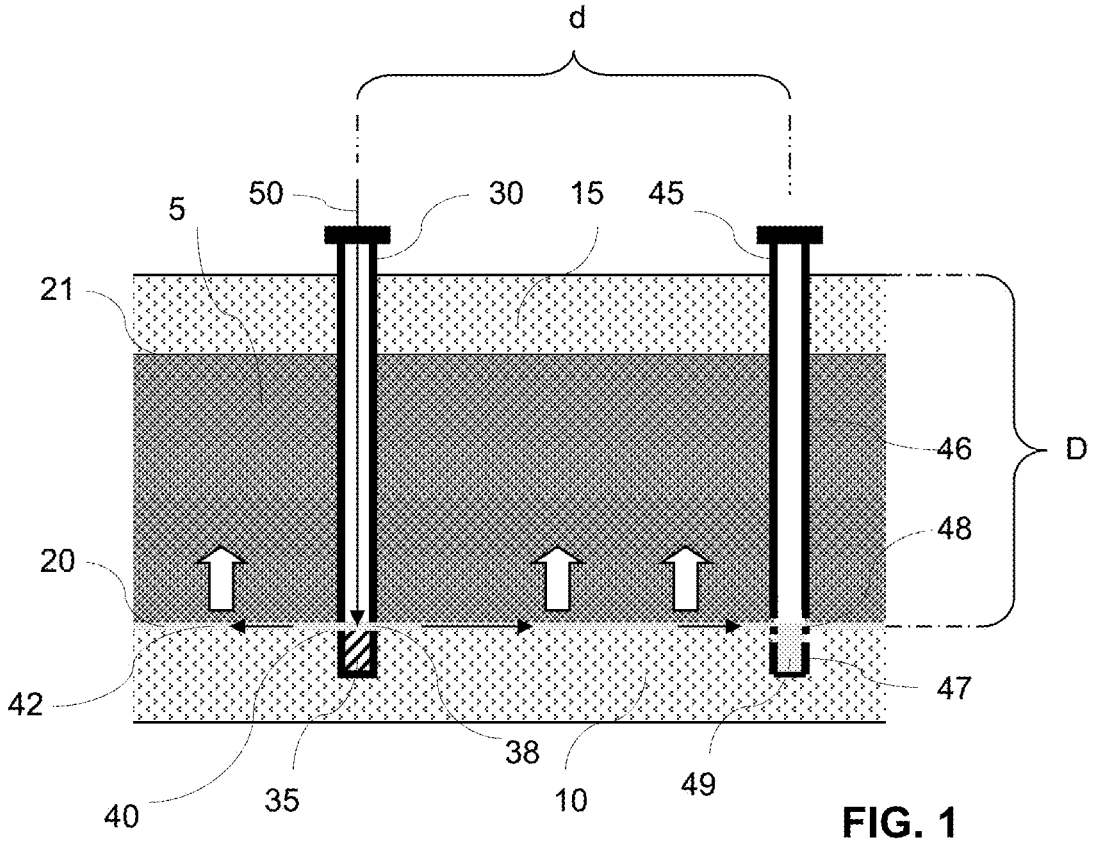
FIG. 1 illustrates an embodiment of a mineral cavity creating comprising a lithological displacement step (lifting step) in a solution mining of a trona stratum from an oil shale stratum using fluid injection in a vertical well at or near a parting trona/shale oil interface.

Drawings have are not to scale or proportions. Some features may have been blown out or enhanced in size to illustrate them better.

DEFINITIONS AND NOMENCLATURES

For purposes of the present disclosure, certain terms are intended to have the following meanings.

The term 'set of wells' is intended to mean a plurality of wells, each well in the set being in fluid communication with at least another well from the set. The set of wells is preferably in fluid communication with at least one cavity. A set of wells comprises one or more wells operated in production (or extraction) mode, one or more wells operated in injection mode, and optionally one or more inactive wells (inactive mode), so long as the set of wells contains at least 3 wells, preferably at least 4 wells, or even more.

The term 'subset of wells' is intended to mean one or more wells from a set of wells. Each well in a subset is characterized by the same mode of operation. One of the subsets in the set comprises one or more wells operated in injection mode. Another subset in the same set comprises one or more wells operated in production mode. The set of wells may also comprise a subset of one or more inactive wells.

The term 'evaporite' is intended to mean a water-soluble sedimentary rock made of, but not limited to, saline minerals such as trona, halite, nahcolite, sylvite, wegscheiderite, that result from precipitation driven by solar evaporation from aqueous brines of marine or lacustrine origin.

The term "fracture" when used herein as a verb refers to the propagation of any pre-existing (natural) fracture or fractures and the creation of any new fracture or fractures; and when used herein as a noun, refers to a fluid flow path in any portion of a formation, stratum or deposit which may be natural or hydraulically generated.

The term 'lithological displacement' as used herein to include a hydraulically-generated vertical displacement of an evaporite stratum (lift) at its interface with an (generally underlying) non-evaporite stratum. A "lithological displacement" may also include a lateral (horizontal) displacement of the evaporite stratum (slip), but slip is preferably avoided.

The term 'overburden' is defined as the column of material located above the target interface up to the ground surface. This overburden applies a pressure onto the interface which is identified by an overburden gradient (also called 'overburden stress', 'gravitational stress', 'lithostatic stress') in a vertical axis.

The term 'TA' or 'Total Alkali' as used herein refers to the weight percent in solution of sodium carbonate and/or sodium bicarbonate (which latter is conventionally expressed in terms of its equivalent sodium carbonate content) and is calculated as follows: TA wt %=(wt % $Na_2CO_3$)+0.631 (wt % $NaHCO_3$). For example, a solution containing 17 weight percent $Na_2CO_3$ and 4 weight percent $NaHCO_3$ would have a TA of 19.5 weight percent.

The term 'liquor' or 'brine' represents a solution containing a solvent and a dissolved mineral (such as dissolved trona) or at least one dissolved component of such mineral. A liquor or brine may be unsaturated or saturated in mineral.

As used herein, the term "solute" refers to a compound (e.g., mineral) which is soluble in water or an aqueous solution, unless otherwise stated in the disclosure.

As used herein, the terms "solubility", "soluble", "insoluble" as used herein refer to solubility/insolubility of a compound or solute in water or in an aqueous solution, unless otherwise stated in the disclosure.

The term "solution" as used herein refers to a composition which contains at least one solute in a solvent.

The term "slurry" refers to a composition which contains solid particles and a liquid phase.

The term "saturated" in relation to a solution refers to a composition which contains a solute dissolved in a liquid phase at a concentration equal to the solubility limit of such solute under the temperature and pressure of the composition.

The term "unsaturated" in relation to a solution as used herein refers to a composition which contains a dissolved solute at a concentration which is below the solubility limit of such solute under the temperature and pressure of the composition.

The term "(bi)carbonate" refers to the presence of both sodium bicarbonate and sodium carbonate in a composition, whether being in solid form (such as trona as a double salt) or being in liquid form (such as a liquor or brine). For example, a (bi)carbonate-containing stream describes a stream which contains both sodium bicarbonate and sodium carbonate.

A 'surface' parameter is a parameter characterizing a fluid, solvent and/or brine at the ground surface (terranean location), e.g., before injection into an underground cavity or after extraction from a cavity to the surface.

An 'in situ' parameter is a parameter characterizing a fluid, solvent and/or brine in an underground cavity or void (subterranean location).

The term 'comprising' includes 'consisting essentially of' and also "consisting of".

A plurality of elements includes two or more elements.

Any reference to 'an' element is understood to encompass 'one or more' elements.

In the present disclosure, where an element or component is said to be included in and/or selected from a list of recited elements or components, it should be understood that in related embodiments explicitly contemplated here, the element or component can also be any one of the individual recited elements or components, or can also be selected from a group consisting of any two or more of the explicitly listed elements or components, or any element or component recited in a list of recited elements or components may be omitted from this list. Further, it should be understood that elements and/or features of a composition, a process, or a method described herein can be combined in a variety of ways without departing from the scope and disclosures of the present teachings, whether explicit or implicit herein.

The use of the singular 'a' or 'one' herein includes the plural (and vice versa) unless specifically stated otherwise.

In addition, if the term "about" is used before a quantitative value, the present teachings also include the specific quantitative value itself, unless specifically stated otherwise. As used herein, the term "about" refers to a +−10% variation from the nominal value unless specifically stated otherwise.

DETAILED DESCRIPTION OF THE PREFERRED EMBODIMENTS

The following detailed description illustrates embodiments of the present invention by way of example and not necessarily by way of limitation.

It should be noted that any feature described with respect to one aspect or one embodiment is interchangeable with another aspect or embodiment unless otherwise stated.

The present invention relates to in situ solution mining of a mineral in an underground formation comprising an evaporite mineral stratum in which the mineral is soluble in a removal (liquid) solvent using multiple interconnected well operations. The solution mining method may be carried out in a mineral cavity which is formed by dissolution of mineral free face created through the evaporite mineral stratum. The mineral free face may be created for example by drilling an uncased section of a borehole directionally drilled through the evaporite mineral stratum or by creating an interfacial gap via lithological displacement. The creation of such mineral cavity allows for the interconnection of these wells so that the set of wells are in fluid communication with the at least one cavity.

Cavity Formation

The at least one cavity may be initially formed by one or more uncased borehole sections, preferably an uncased horizontal borehole section of at least one borehole directionally drilled through the mineral stratum.

The at least one cavity may be initially formed by a lithological displacement of the mineral stratum. Such lithological displacement is performed when said mineral stratum is lying immediately above a water-insoluble stratum of a different composition with a weak parting interface being defined between the two strata and above which is defined an overburden up to the ground, said lithological displacement comprising injecting a fluid at the parting interface to lift the evaporite stratum at a lifting hydraulic pressure greater than the overburden pressure, thereby forming an interface gap which is a nascent mineral cavity at the interface and creating said mineral free-surface.

The at least one cavity is enlarged by dissolution of the ore from the walls of the cavity in a solvent injected into the cavity.

At least one cavity is preferably formed by a lithological displacement of the mineral stratum.

When the set of wells are in fluid communication with more than one cavity, at least one of the cavities is formed by lithological displacement. The other mineral cavities may be created by hydraulically separating bedding planes, by horizontal drilling, or by undercutting.

For lithological displacement, when the mineral stratum is lying immediately above a water-insoluble stratum of a different composition with a weak parting interface being defined between the two strata and above which is defined an overburden up to the ground, the lithological displacement is performed by hydraulically separating bedding planes. The lithological displacement comprises injecting a lifting fluid at the parting interface to lift the evaporite stratum at a lifting hydraulic pressure greater than the overburden pressure, thereby forming an interface gap which is a nascent mineral cavity at the interface and creating the mineral free-surface which is accessible to solvent and available for ore dissolution.

This cavity may or may not be propped open subsequent to the lithological displacement by injecting a suitable proppant material. In order to maintain and/or enhance the flowability of the hydraulically-created gap in the mineral stratum, particulates with high compressive strength (often referred to as "proppant") may be deposited in the gap, for example, by injecting the lifting fluid carrying the proppant. The proppant may prevent the gap from fully closing upon the release of the hydraulic pressure for extraction, forming fluid flow channels through which a production solvent may flow in a subsequent solution mining exploitation phase. The process of placing proppant in the interface gap is referred to herein as "propping" the interface. Although it may be desirable to use proppant in maintaining fluid flow paths in the interface gap, dissolution of mineral by the lifting fluid comprising solvent will enlarge the gap over time to form a mineral cavity. As such, the proppant may be needed only during the interface gap formation and/or during nascent cavity development. But in some instances, this propping may be omitted from the lifting step.

The lifting fluid may comprise or consist of a solvent suitable to dissolve the mineral, but not necessarily. The lifting fluid may be a fluid which has interesting properties such as a viscosity sufficient to efficiently maintain particles contained herein (such as proppant) in a well-dispersed manner so as to carry them all along the interface gap.

When the evaporite stratum comprises trona, the lifting fluid preferably comprises water or an unsaturated aqueous solution comprising sodium carbonate, sodium bicarbonate, sodium hydroxide, calcium hydroxide, or combinations thereof.

Water may be used preferably as the lifting fluid to create the gap at the interface and to enlarge the interface gap quickly by mineral dissolution to form the cavity.

The injected lifting fluid may comprise or consist of a slurry comprising particles suspended in water or an aqueous solution (e.g., caustic and/or sodium (bi)carbonate-containing solution). The fluid may comprise or consist of a slurry comprising particles suspended in water or the aqueous solution. The particles may be any suitable water-insoluble matter, such as tailings, proppant particles, or combinations thereof. The particles may comprise or consist of tailings used as proppant.

Such tailings are insoluble material which may be obtained during refining of mechanically-mined trona. Tailings in trona processing represent a water-insoluble matter recovered after a mechanically-mined trona is dissolved (generally after being calcined) in a surface refinery. During the mechanical mining of a trona stratum, some portions of the underlying floor and overlying roof rock which contain oil shale, mudstone, and claystone, as well as interbedded material, get extracted concurrently with the trona. The resulting mechanically-mined trona feedstock which is sent to the surface refinery may range in purity from a low of 75 percent to a high of nearly 95 percent trona. The surface refinery dissolves this feedstock (generally after a calcination step) in water or an aqueous medium to recover alkali values, and the portion which is non-soluble, e.g., the oil shale, mudstone, claystone, and interbedded material, is referred to as 'insols' or 'tailings'. After trona dissolution, the tailings are separated from the sodium carbonate-containing brine by a solid/liquid separation system. The particles size in tailings may vary depending on the surface refinery operations. Typical trona tailings may have particle sizes ranging between 1 micron and 250 microns, although bigger and smaller sizes may be obtained. More than 50% of the particles in tailings generally have a particle size between 5 and 100 microns. The full range of the mineral tailings may be used as water-insoluble particles. Alternatively, a fraction of the full range of tailings may be used as insolubles. For example, a size-separation apparatus (e.g., wet sieve apparatus) may be used to isolate a specific particles fraction, such as isolating particles passing through a sieve with a specific size cut-off (such as 44 μm=325 mesh) from particles retained by the sieve.

A proppant may be any suitable insoluble solid material with a size distribution that will "prop" open the hydraulically-induced gap in such a way as to allow passage and flow of fluid in the gap when using a lower hydraulic pressure in a later dissolution step.

In the embodiments when the cavity is created by 'hydraulically lifting' the underground ore formation for establishing fluid communication between at least two wells, a sufficient hydraulic pressure is maintained at the interface for propping open fractures; and circulating a solvent liquid through such fractures for dissolving water-soluble constituents of the ore to create the cavity.

In other embodiments when the cavity may be created by drilling a directionally-drilled well (comprising a cased vertical portion—not in contact with ore- and an uncased horizontal portion—in contact with ore—) and also drilling a vertical well, a cased portion of which is not in contact with ore. The downhole end of the vertical well preferably intersects the uncased horizontal portion to provide fluid communication between the two wells. Injecting an aqueous solvent liquid through one well is carried out to bring the solvent liquid to come in contact with ore in said horizontal portion so as to dissolve water-soluble ore components and to create such cavity.

Suitable examples of such cavity creation may be found in U.S. Pat. No. 4,398,769 by Jacoby (hydrofracturing), in U.S. Pat. No. 7,611,208 by Day et al (solution mining with multiple horizontal boreholes), in U.S. Pat. No. 5,246,273 by Rosar et al, and in U.S. Pat. Application Publication No. 2011/0127825 by Hughes et al (undercut solution mining with horizontal boreholes). These patents/applications are hereby incorporated herein by reference for their teachings of such cavity creation and of solution mining of trona with an aqueous solution.

In preferred embodiments, the solution mining method may be carried out in at least one mineral cavity which is formed by lithological displacement of the evaporite stratum lying immediately above a non-evaporite stratum of a different composition which is insoluble in such removal solvent.

In preferred embodiments, the solution mining method may be carried out in a plurality of cavities all formed by lithological displacement.

In other embodiments, the plurality of cavities may be initially created by using directionally-drilled wells (comprising a cased vertical portion—not in contact with ore- and an uncased horizontal portion—in contact with ore—). The solution mining method may be carried out in a plurality of cavities all initially formed by uncased portions of directionally-drilled wells.

In yet other embodiments, the plurality of cavities may be initially created by using a combination of such techniques. Preferably, at least one cavity of the plurality of cavities is formed by lithological displacement.

Water-soluble evaporite formations, and particularly trona formations, usually consist in nearly parallel beds of various thicknesses, underlain and overlain by water-insoluble sedimentary rocks like shale, mudstone, marlstone and siltstone. The surface of separation between the evaporite stratum and the underlying or overlying non-evaporite stratum is usually sharply defined and forms a natural plane of weakness. This surface of separation at any given point may lie substantially in a horizontal plane. In the U.S. Green River Basin, the depth of the surface of separation between the trona and oil shale strata is shallow, typically 3,000 ft (914 m) or less, preferably a depth of 2,500 ft (762 m) or less, more preferably a depth 2,000 ft (610 m) or less.

If a sufficient amount of hydraulic pressure is applied at this interface, the two dissimilar substances (trona and shale) should easily separate. When the water-soluble evaporite stratum is a nearly horizontal bed at sufficiently shallow depths and underlain by water-insoluble nearly horizontal sedimentary rock, injection pressures equal to or slightly greater than the pressure of the overburden should favor the development of a main horizontal fracture, particularly in the case where the desirable target fracture lies along the known plane of weakness between two incongruent materials. The single main fracture (interface gap) created at their interface is substantially horizontal, and creates a large free-surface of mineral upon which a suitable solvent can be introduced for in situ solution mining.

The interface gap is initially created by lithologically displacing (lifting) the evaporite stratum and the overburden at the interface by application of a lifting hydraulic pressure greater than the overburden pressure. The lifting hydraulic pressure is applied by injecting a fluid at a strata parting interface (preferably injected at a specific steady volumetric flow rate) until the desired lifting hydraulic pressure is reached (a lifting hydraulic pressure greater than the overburden pressure) and the interface gap is created generating a mineral free-surface. Once the hydraulic pressure has reached the desired lifting pressure, the interface gap which is a nascent cavity generates may be enlarged by dissolution of mineral from the solvent-exposed free-surface to form a mineral cavity and generating a brine containing dissolved mineral (or a dissolved component from the mineral). This mineral cavity can be exploited by the solution mining method according to the present invention, by using one or more wells to inject solvent and using one or more different wells to extract at least some of the brine.

To form the mineral cavity, solvent injection may be carried out via an initial vertical well or an initial directionally drilled well.

The method according to the present invention may comprise forming at least one partially cased and cemented well which has an uncased portion, preferably uncased horizontal portion, which is generally lying at or above the strata interface and drilled through the mineral ore. The walls of this uncased portion of the partially cased and cemented well consist essentially of mineral ore. This well may serve as a solvent injection well and/or may serve as a production well from which liquor can be extracted.

The method according to the present invention may comprise forming at least one fully cased and cemented well which intersects the strata interface. This well will serve as a solvent injection well and/or may serve as a production well.

Forming the initial well may include drilling a well from the surface to at least the depth of a target injection zone which is located near or at the interface between the target block of evaporite stratum and the underlying stratum, followed by partially or completely casing and cementing the initial well.

The initial well may be fully cemented and cased but with a downhole section which provides at least one in situ solvent injection zone which is in fluid communication with the strata interface. The downhole well section may be a portion of the fully cemented and cased well which comprises at least one opening (which provides at least one in situ solvent injection zone) which is in fluid communication with the strata interface. A liquid (e.g., solvent) can flow through the opening(s) between the inside of the well and the strata interface. The casing of a well downhole section may be perforated and/or the initial well may be otherwise left open at the interface to expose the target in situ solvent injection zone.

When the initial well is vertical for lithological displacement, the in situ injection zone may comprise or consist of perforations (casing openings) in a downhole section of the well casing, preferably aligned alongside the strata interface. When the vertical well goes through the interface which is horizontal or near horizontal, perforations (casing openings) are preferably positioned on at least one casing circumference of this downhole section, such casing circumference being aligned alongside the strata interface.

When the initial well is directionally drilled for lithological displacement, the initial directionally drilled well comprises an in situ injection zone which is located at or near the parting interface, wherein the injection zone may comprise or consist of an end opening of a horizontal downhole section of the initial well and/or specific casing perforations in the horizontal downhole section of the well casing, for example perforations on one sidewall or on opposite sidewalls of the well horizontal section which are aligned alongside the strata interface (such as a row of perforations on either sidewall or both sidewalls of the horizontal downhole section). In this instance, when the lifting fluid exits the in situ injection zone (well end opening and/or casing perforations) thereby lifting the overlying evaporite stratum at the interface, the gap created at the interface is an extension of such horizontal borehole section.

The method may further comprise perforating the casing along at least one circumference of the initial vertical well or along at least one generatrix of its horizontal downhole section.

The opening(s) on the casing may be in fluid communication with a conduit inserted into the well to facilitate solvent flow from the ground surface to this well solvent injection zone.

The initial well when vertical is preferably drilled from the ground surface past the depth of the interface, and the initial vertical well is cased and cemented through its entire length, but comprises an in situ injection zone being in fluid communication with the strata interface, said in situ injection zone of said initial vertical well comprising a downhole end opening and/or casing perforations.

In at least one embodiment, the in situ solvent injection zone may be intentionally widened to form a 'pre-lift' slot between the overlying evaporite stratum and the underlying insoluble stratum, this 'pre-lift' slot providing a pre-existing "initial lifting surface" which would allow the hydraulic pressure exerted by the injected fluid to act upon this initial lifting surface preferentially in order to begin the initial separation of the two strata. The pre-lift slot may be created by directionally injecting a fluid (preferably comprising a solvent suitable to dissolve the mineral) under pressure via a rotating jet gun.

Figure 2:
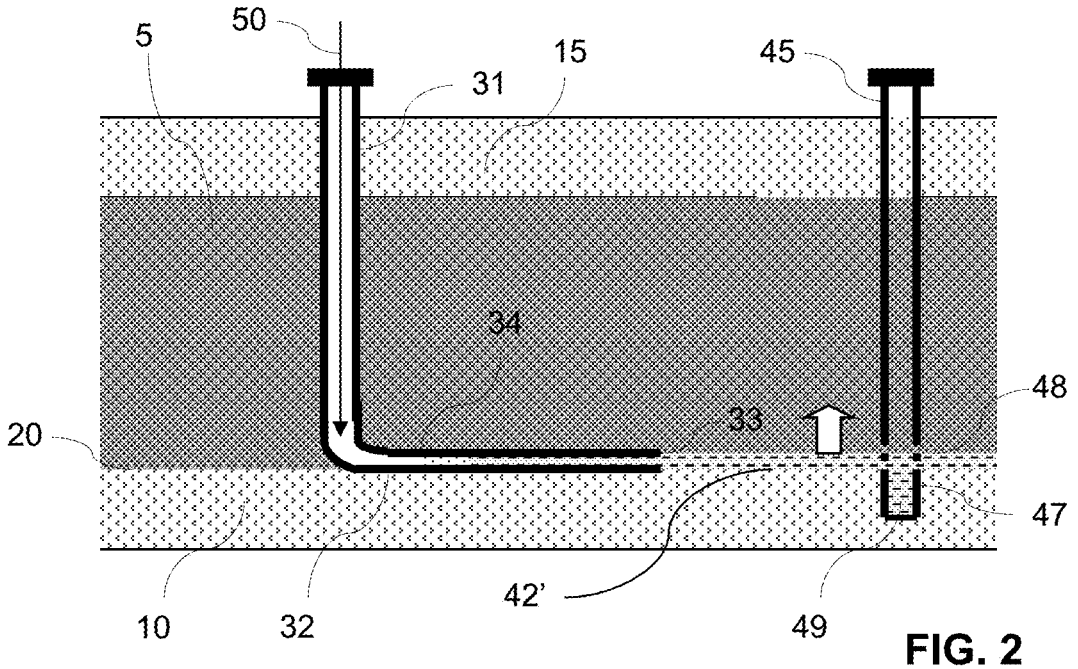
FIG. 2 illustrates another embodiment of a mineral cavity creating comprising a lithological displacement (lifting) of a trona stratum from an oil shale stratum using fluid injection in a directionally drilled well via a horizontal borehole section which is located at or near a parting trona/shale oil interface.

Embodiments concerning a lithological displacement step to make such mineral cavity according to the present invention will now be described in reference to the following drawings: FIGS. 1 and 2.

Although FIGS. 1-2 are illustrated in the context of a trona/shale system and the application of hydraulic pressure at their underground interface, with respect to any or all embodiments of the present invention, the evaporite mineral to which the present method can be applied may be any suitable evaporite stratum containing a desirable mineral solute. The evaporite mineral stratum may comprise a mineral which is soluble in the solvent to form a brine which can be used for the production of rock salt (NaCl), potash (KCl), soda ash, and/or derivatives thereof. The evaporite mineral stratum may comprise for example a mineral selected from the group consisting of trona, nahcolite, wegscheiderite, shortite, northupite, pirssonite, dawsonite, sylvite, carnalite, halite, and combinations thereof. Preferably, the evaporite mineral stratum comprises any deposit containing sodium carbonate and/or sodium bicarbonate. The evaporite mineral stratum preferably comprises a water-soluble mineral selected from the group consisting of trona, nahcolite, wegscheiderite, and combinations thereof. Most preferably, the evaporite mineral comprises trona. In such instance, the underlying water-insoluble stratum of a different composition may include oil shale or any substantially water-insoluble sedimentary rock that has a weak bond interface with the target evaporite stratum.

The overburden is defined as the column of material located above the strata interface up to the ground surface. This overburden applies a pressure onto this interface which is identified by an overburden gradient (also called 'overburden stress', 'gravitational stress', 'lithostatic stress') in a vertical axis.

In FIGS. 1 and 2, a trona stratum 5 is overlying an oil shale stratum 10 and is underlying another non-evaporite stratum 15 (generally another shale stratum which may be contaminated with chloride-containing bands). There is a defined parting interface 20 between the strata 5 and 10. There is also a parting interface 21 between the strata 5 and 15. The application of hydraulic pressure is preferably carried out at the interface 20.

The trona stratum 5 may contain up to 99 wt % sodium sesquicarbonate, preferably from 25 to 98 wt % sodium sesquicarbonate, more preferably from 50 to 97 wt % sodium sesquicarbonate.

The trona stratum 5 may contain up to 1 wt % sodium chloride, preferably up to 0.8 wt % NaCl, yet more preferably up to 0.2 wt % NaCl.

The defined parting interface 20 between the strata 5 and 10 is preferably horizontal or near-horizontal, but not necessarily. The interface 20 may be characterized by a dip of 5 degrees or less; preferably with a dip of 3 degrees or less; more preferably with a dip of 1 degrees or less. In some embodiments, the defined parting interface 20 may have a dip greater than 5 degrees up to 45 degrees or more.

The trona/shale interface 20 may at a shallow depth 'D' of less than 3,280 ft (1,000 m) or at a depth of 3,000 ft (914 m) or less, preferably at a depth of 2,500 ft (762 m) or less, more preferably at a depth of 2,000 ft (610 m) or less. The trona/shale interface 20 may at a depth 'D' of more than 800 ft (244 m).

In the Green River Basin, the trona/oil shale parting interface 20 may be at a shallow depth of from 800 to 2,500 feet (244-762 m).

In the Green River Basin, the trona stratum 5 may have a thickness of from 5 feet to 30 feet (1.5-9.1 m), or may be thinner with a thickness from 5 to 15 feet (1.5-4.6 m).

One embodiment of the lithological displacement technique used to make the mineral cavity employs at least one vertical injection well and is illustrated in FIG. 1.

The method may first comprise drilling at least one, but possibly more, vertical well(s) 30 from the ground down to a depth below the interface 20. The portion 35 of the well 30 which is underneath the interface 20 is preferably plugged. The depth at which the bottom of well portion 35 lies (where the drilling of well 30 stops) may be at least 5 feet below the depth of interface 20, preferably between 10 feet and 100 feet below the depth of interface 20, more preferably between 30 feet and 80 feet below the depth of interface 20.

The well 30 is preferably fully cemented and cased, except that it comprises an in situ injection zone 40 which is in fluid communication with the strata interface 20. The in situ injection zone 40 should allow for a fluid to be injected into the well 30 and to be directed at the interface 20. The in situ injection zone 40 is preferably, albeit not necessarily, designed to laterally inject the fluid in order to avoid injection of fluid in a vertical direction. The in situ injection zone 40 allows the fluid to force a path at the trona/shale interface 20 by vertically displacing the stratum 5 to create the gap 42.

The in situ injection zone 40 may comprise one or more downhole casing openings. A downhole vertical section of the vertical well 30 may have a downhole end opening which is located at or near the parting interface 20. The vertical borehole section may have, alternatively or additionally, perforations (not illustrated) which may be aligned with the interface 20. Using a downhole perforating tool, these perforations may be cut through the casing and cement at a well circumference aligned with the interface 20 to form the in situ injection zone 40.

The fluid can flow inside the casing of well 30 or may be injected via a conduit (not shown) all the way to the in situ injection zone 40. Such conduit may be inserted inside the injection well 30 to facilitate injection of fluid. The conduit may be inserted while the injection well 30 is drilled, or may be inserted after drilling is complete. The injection conduit may comprise a tubing string, where tubes are connected end-to-end to each other in a series in a somewhat seamless fashion. The injection conduit may comprise or consist of a coiled tubing, where the conduit is a seamless flexible single tubular unit. The injection conduit may be made of any suitable material, such as for example steel or any suitable polymeric material (e.g., high-density polyethylene). The injection conduit inside well 30 should be in fluid communication with the in situ injection zone 40.

For extraction of brine to the surface, one or more wells may be drilled at a distance from the initial vertical well 30. For illustrative purposes, one vertical production well 45 is illustrated in side-view in FIG. 1 and in plan-view in FIG. 3*a*. But in preferred embodiments of the present invention, a set of wells comprising at least 4 wells, one of which being the initial vertical well 30 through which the lifting fluid 50 is injected to lift the evaporite mineral 5 while the other wells are peripheral wells arranged in a pattern along the perimeter 55 of the gap 42 centered around the initial vertical well 30. Examples of suitable well arrangements for the wells set are illustrated in FIG. 4*a*-4*e*. Peripheral wells 45*x* (x=a, b, . . . h) in these well arrangements may be drilled prior to the lithological displacement such as is described below for the well 45 in FIG. 1 and FIG. 3*a*. But some of the peripheral wells 45*x* may be drilled after the gap 42 has been created and enlarged by dissolution of mineral to form the mineral cavity 142.

Referring back to FIG. 1, the well 45 may be spaced from the initial vertical well 30 by a distance 'd' of at most 1,000 meters, or at most 800 meters, or at most 600 meters. Preferred spacing 'd' between these wells may be from 100 to 600 meters, preferably from 100 to 500 meters.

The well 45 may be cemented and cased from the surface down past the bottom of the trona stratum 5 which is defined by the interface 20, and which penetrates a portion of the oil shale stratum 10 with a downhole section 47. The downhole section 47 may be left uncased and uncemented, so that brine flowing therethrough may have contact with the walls of the downhole section 47 of well 45.

Preferably, the well 45 is cemented and cased all the way down including in downhole section 47, but the downhole section 47 is perforated where it intersects the interface 20. Using a downhole perforating tool, perforations 48 may be cut through the casing and cement at the interface 20. As shown in FIG. 1, these perforations 48 would allow liquid and optionally insolubles to enter the lumen of well 45 and to be collected in a sump 49 (collection zone) at the downhole end of the well 45 in order for at least a portion of the collected liquid to be extracted to the surface.

The sump 49 may be created at the downhole section 47 of well 45 to facilitate the recovery of the brine from the gap 42. The formation of the sump 49 is preferably carried out by mechanical means (such as drilling past the trona/shale interface 20). The bottom of sump 49 may have a greater depth than the bottom of the trona stratum 5. The sump 49 may be embedded at least partially or completely into the oil shale stratum 10. The walls and bottom of sump 49 are preferably cased and cemented.

A pumping system (not illustrated) may be installed so that the brine produced in the gap 42 and resulting cavity 142 can be pumped to the surface for further processing and recovery of valuable products. Suitable pumping system can be installed at the downhole section 47 of production well 45 or at the surface end of this well. This pumping system might be an 'in-mine' system in the sump 49 (e.g., downhole pump (not shown) which would permit to push at least a portion of the brine out from underground to the ground surface) or a 'terranean' system (e.g., a pumping system which would permit to pull at least a portion of the brine out from underground to the ground surface). A brine return pipe (not shown) may be placed into the sump 49 in fluid communication with the terranean pumping system to allow the brine to be pumped to the surface during production.

For injection of the lifting fluid 50, water may be used initially to create the gap 42 at the interface 20 and to enlarge the gap 42 to form the nascent mineral cavity 142. The injected fluid 50 may be extracted by flowback into well 30 to drain the cavity of liquid.

The injected fluid 50 is preferably injected at a volumetric flow rate from 7 to 358 cubic meters per hour ($m^3$/hr) [31.7-1575 gallons per minute or 1-50 barrels per minute], to allow the hydraulic pressure to rise at the in situ injection zone 40 until it reaches a target lifting hydraulic pressure (estimated to be the interface depth times the overburden gradient plus a small additional pressure gradient necessary to overcome the tensile strength of the interface, and the frictional resistance to fluid flow). Other suitable fluid flow rates have been previously described. At this point, the flow of injected fluid 50 may be stopped or, at the very least, reduced to a very low flow rate, but the lifting hydraulic pressure is maintained.

The injected fluid 50 may comprise water or an unsaturated aqueous solution comprising sodium carbonate, sodium bicarbonate, sodium hydroxide, calcium hydroxide, or combinations thereof.

The injected fluid 50 may comprise or consist of a slurry comprising particles suspended in water or an aqueous solution (e.g., caustic solution). The particles may be tailings (insolubles), proppant particles, or combinations thereof. The particles may comprise or consist of tailings used as proppant. These particles are generally water-insoluble.

The fluid 50 may be preheated before injection. When the fluid 50 comprises a solvent suitable for trona dissolution (such as water or an aqueous medium), the fluid 50 may be preheated to a predetermined temperature higher than the in situ temperature of trona to increase the solubility of trona.

The fluid 50 may be injected from the ground surface to the interface 20 at a surface temperature at least 20° C. higher than the in situ temperature of trona.

The fluid 50 may be injected from the ground surface to the interface at a surface temperature which is near the ambient trona temperature (the in situ temperature) at the injection depth. The surface temperature of the fluid 50 may be within +/−5° C. or within +/−3° C. of the in situ temperature of the trona stratum 5. Since the in situ temperature of trona stratum 5 is estimated to be about 30-36° C. (86-96.8° F.), preferably 31-35° C. (87.8-95° F.), the surface temperature of the fluid 50 may be between about 25 and about 41° C. (about 77-106° F.).

Now is described how the system of FIG. 1 operates in the context of the present invention for lifting the trona stratum and making the gap 42 to create a nascent mineral cavity 142.

The fluid 50 is injected via injection zone 40 of the injection well 30 at the interface 20 between the trona stratum 5 and the underlying oil shale stratum 10 until a target lifting hydraulic pressure is reached. The lifting hydraulic pressure applied by injecting the fluid at the interface 20 is preferably greater than the overburden pressure. The application of hydraulic pressure by injection of fluid at the interface 20 lifts the overlying trona stratum 5 and the overburden, thereby creating a main horizontal fracture (gap 42).

The lifting hydraulic pressure application of the present invention is significantly different than the commercially-available hydraulic fracturing using very high pressures in deep oil and gas formations like in shale fracturing where the intent is the creation of numerous vertical fractures in the actual rock mass at much greater depth (>4,000 ft=1,219 m) under much greater overburden pressure.

That is why the Applicants refer to the present lifting step used in the solution mining method as a 'lithological displacement' in order to distinguish it, as a less invasive process, from the high pressure hydraulic fracturing used in oil and gas fields. The present 'lithological displacement' technique comprises applying a low hydraulic pressure to make a separation at a natural shallow-depth plane of weakness between a nearly horizontal bedded, soluble evaporite stratum (e.g., trona) and a dissimilar stratum (e.g., oil shale) in order to create a large mineral free-surface that a suitable solvent (e.g., water or aqueous solution) can contact to initiate in situ solution mining.

For this lithological displacement to be carried out on trona ore, the depth of the trona/shale interface is sufficiently shallow (e.g., at interface depths of less than 1,000 m) so as to encourage the development under hydraulic pressure of a main horizontal or near-horizontal fracture extending laterally away from the in situ injection zone at this interface between the trona stratum and the underlying oil shale stratum.

During lithological displacement of the target block of trona stratum 5 in the lifting step, the production well 45 should be capped. The injection well 30 should also be capped but will allow the fluid to be injected therethrough.

A fracture will open in the direction perpendicular to minimum principal stress. To propagate a fracture in an isotropic medium in the horizontal direction, the minimum principal stress must be vertical. The vertical stress at the trona/shale interface 20 coincides with the overburden pressure. It is generally prudent to select a fracture gradient for lithological displacement to be slightly higher than the overburden gradient to propagate a horizontal fracture initiated at the injection zone 40 along the parting interface 20.

The fracture gradient used will be estimated depending on the local underground stress field and the tensile strength of the trona/shale interface. The fracture gradient used for estimating the target lifting pressure for lithological displacement is equal to or greater than 0.9 psi/ft, or equal to or greater than 0.95 psi/ft, preferably equal to or greater than 1 psi/ft. The fracture gradient used for estimating the target lifting pressure for lithological displacement may be 1.5 psi/ft or less; or 1.4 psi/ft or less; or 1.3 psi/ft or less; or 1.2 psi/ft or less; or 1.1 psi/ft or less; or even 1.05 psi/ft or less. The fracture gradient may be between 0.9 psi/ft (20.4 kPa/m) and 1.5 psi/ft (34 kPa/m); preferably between 0.90 and 1.30 psi/ft; yet more preferably between 1 and 1.25 psi/ft; most preferably between 1 and 1.10 psi/ft. The fracture gradient may alternatively be from 0.95 psi/ft to 1.2 psi/ft; or from about 0.95 psi/ft to about 1.1 psi/ft, or from about 1 psi/ft to about 1.05 psi/ft. For example, for a depth of 2,000 ft for interface 20, a minimum target hydraulic pressure of 2,000 psi may be applied at interface 20 by the injection of the fluid to lift the overburden with the stratum 5 immediately above the targeted zone to be lifted, which represents the interface 20 between the trona and the oil shale.

The lifting hydraulic pressure may be at least 0.01% greater, or at least 0.1% greater, or at least 1% greater, or at least 3% greater, or at least 5% greater, or at least 7% greater, or at least 10% greater, than the overburden pressure at the depth of the interface. The hydraulic pressure during the lifting step may be at most 50% greater, or at most 40% greater, or at most 30% greater, or at most 20%, than the overburden pressure at the depth of the interface. The lifting hydraulic pressure may be from 0.01% to 50% greater, or from 0.1% to 50% greater, or even from 1% to 50% greater than the overburden pressure at the depth of the interface. The lifting hydraulic pressure should be sufficient and preferably should be just above the pressure (e.g., from about 0.01% to 1% greater) necessary to overcome the sum of the overburden pressure and the tensile strength of the interface.

The targeted block of trona stratum 5 to be lifted is located at shallow depth where the vertical stress should be sufficiently low, and it is known to have very low tensile strength, considerably weaker than either the trona or the oil shale. The combination of both low vertical stress and a very weak horizontal interface creates very favorable conditions for the propagation of a horizontal hydraulically induced lithological displacement to create the gap 42.

The gap 42 provides a trona free-surface 22 which is mostly the bottom of the lifted target block of trona stratum 5. Contact with this trona free-surface 22 can be made with a solvent when the gap 42 is filled with this solvent, dissolution of mineral occurs thereby enlarging the gap 42 into cavity 142.

Figure 3A:
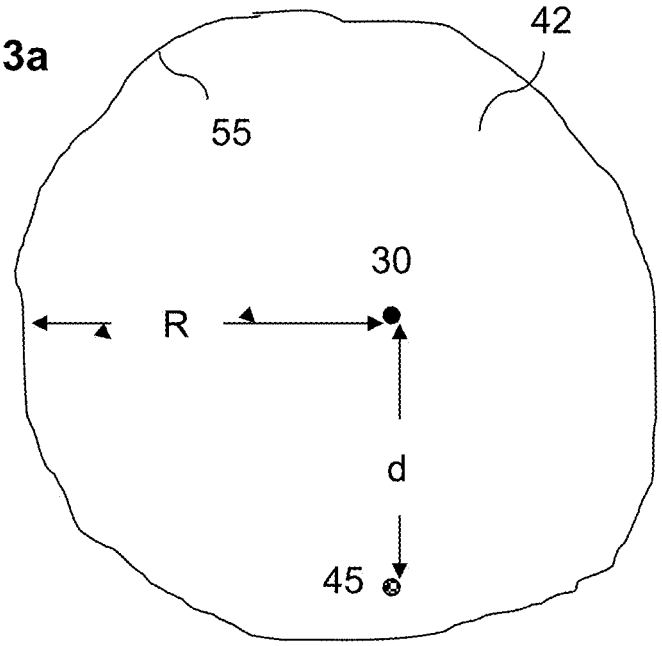
FIG. 3*a* shows a plan view of the cavity formed by lithological displacement (lifting) of the trona stratum using a vertical well as illustrated in FIG. 1.

As illustrated in plan-view in FIG. 3*a*, the formation of gap 42 in this lithological displacement may extend laterally in mostly all directions away from the injection zone 40 of well 30 for a considerable lateral distance, such lateral distance from well 30 being somewhat equivalent to the radius 'R' of the perimeter 55 of the gap 42 being from 30 meters (about 100 feet), up to 150 m (about 500 ft), or up to 300 m (about 1,000 ft), or up to 500 m (about 1,640 ft), or even up to 610 m (about 2,000 ft) away from well 30. Because it is expected that the stresses are not equal in all directions, the lateral expansion will not be even in the horizontal plane. So even though the lateral extent for the gap 42 is illustrated as being represented by a circular area shown in plan view in FIG. 3*a*, it is understood that the lithological displacement may create an irregular shape. The width (or height) of the gap 42 however would be much less than 1 cm, generally from about 0.5 to 1 cm near the in situ injection zone up to 0.25 cm or less at the extreme edge (perimeter 55) of the lateral expanse (gap 42). The width (height) of the gap 42 is highly dependent upon the flow rate of the fluid during lithological displacement.

Ideally during lithological displacement, the lateral expanse of the gap 42 intercepts the perforated downhole section 47 of well 45. In this manner, fluid communication is established between wells 30 and 45 as shown in FIG. 3*a*. As shown in this figure, the well 45 is positioned within the perimeter 55 of the interface gap 42, and the gap radius R from center well 30 is greater than the distance 'd' between the initial well 30 and second well 45.

To create a multitude of interconnected wells, more than one well 45 may be drilled within the perimeter of the interface gap 42 and thus of mineral cavity 142. Examples of such arrangements of peripheral wells 45 are illustrated in FIGS. 4*a*, 4*b*, 4*c*, 4*d*, 4*e*, and 4*f*.

Figure 4A:
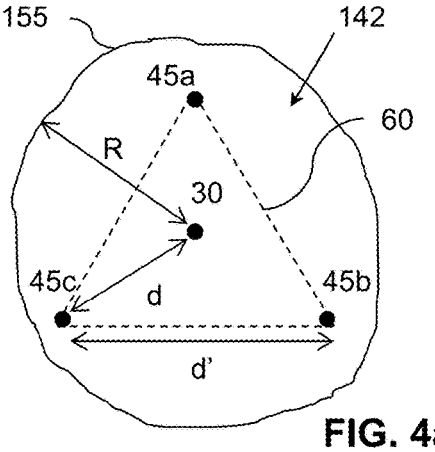
FIGS. 4*a*, 4*b*, 4*c*, 4*d*, and 4*e* show in plan view several centered patterns of wells in fluid communication with one cavity formed by lithological displacement (lifting) of a trona stratum using a 3-well set, a 4-well set, a 5-well set, a 9-well set, a 7-well set, respectively, each well set including an arrangement of wells in a single pattern around a center well.
Figure 4B:
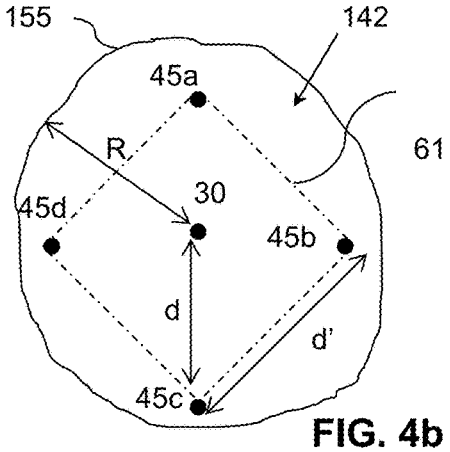
Figure 4C:
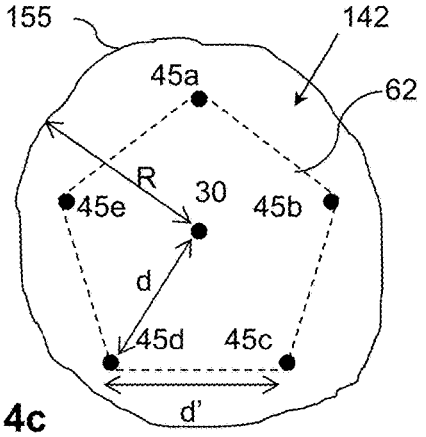
Figure 4D:
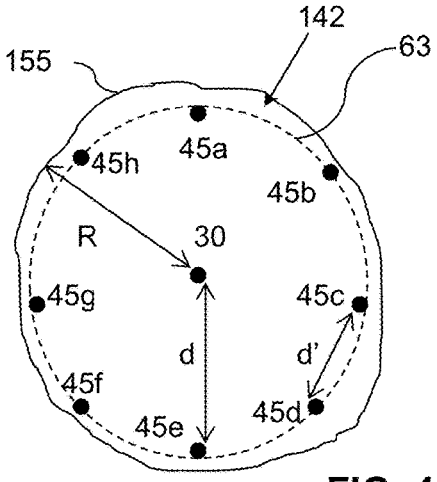
Figure 4E:
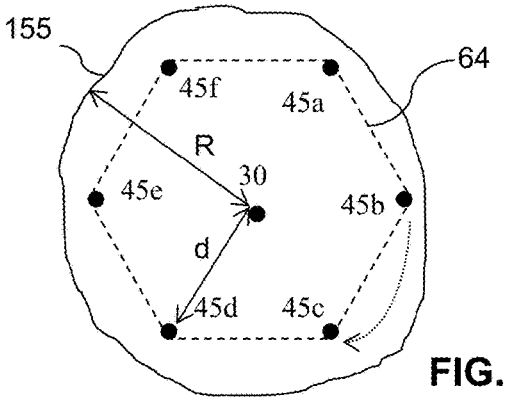
Figure 4F:
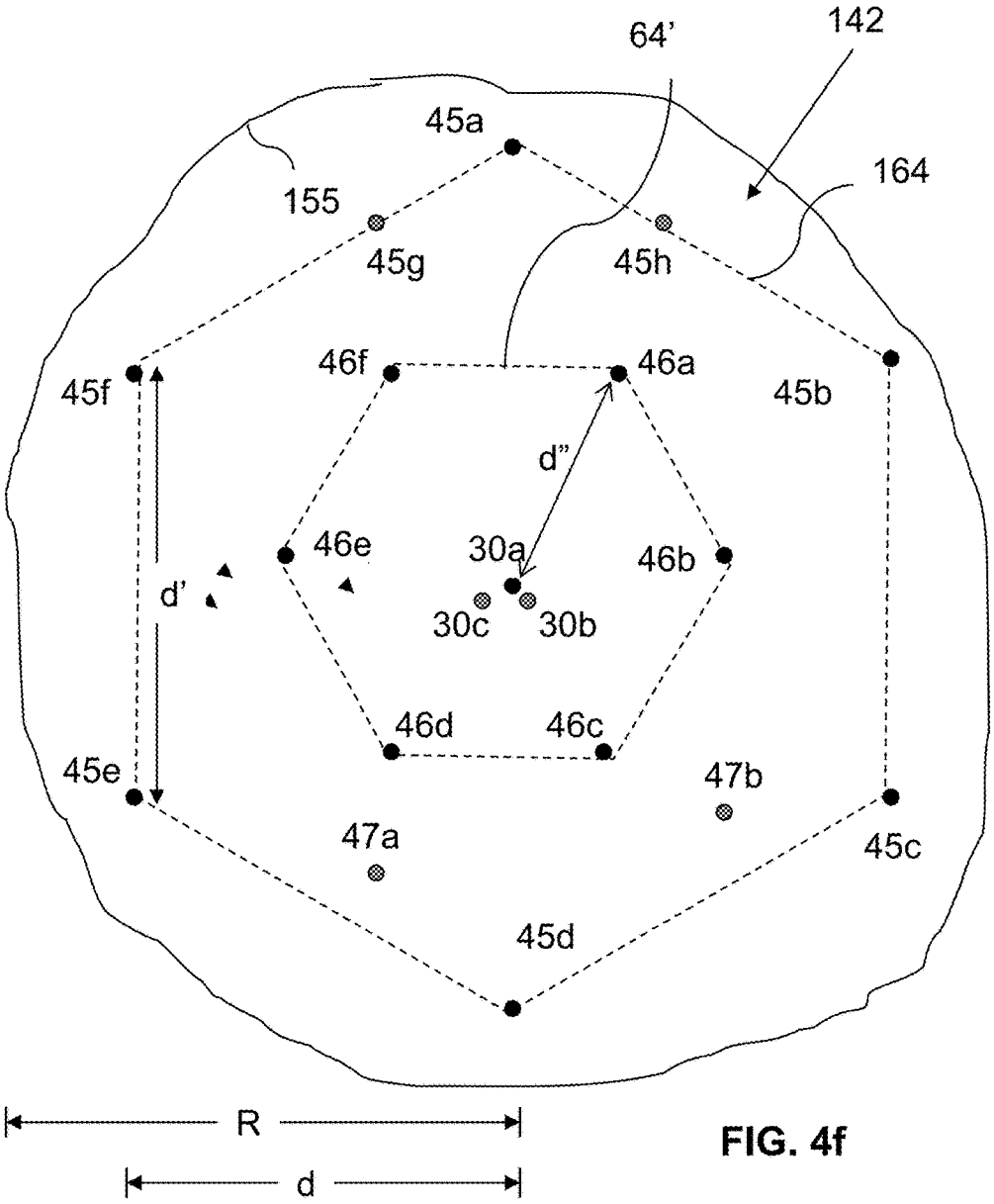
FIG. 4*f* shows in plan view a multi-well set including an arrangement of wells in two concentric or pseudo-concentric patterns around one or more center wells and optionally one or more random wells.

FIGS. 4*a*, 4*b*, 4*c*, 4*d*, 4*e*, and 4*f* show in various plan views several arrangements of interconnected wells in fluid communication with the cavity 142 which is initially formed via interface gap 42 by lithological displacement (lifting) of the trona stratum 5 and then enlarged by trona dissolution. FIG. 4*a*, 4*b*, 4*c*, 4*d*, 4*e* illustrate centered arrangement patterns of wells, each pattern comprising a center well (initial well 30) and from 3 to 8 peripheral wells identified as '45*x*' with x representing a, b, . . . . , h. FIG. 4*f* illustrates a multi-well arrangement with two centered patterns of wells, each pattern comprising a center well (initial well 30*a*) and optionally additional center wells 30*b* and 30*c*, a plurality of peripheral wells ('45*x*', '46*x*') for each pattern, and optionally some random wells 47*a* and 47*b*.

In particular, FIG. 4*a* illustrates a centered arrangement of wells along a pattern 60 (of triangular shape) comprising a center well (initial well 30) and three peripheral wells identified as '45*x*' where x represents a, b, c which have an inter-well spacing d' and which are within the perimeter 155 of the cavity 142. The spacing d between center well 30 and peripheral wells 45*x* is such that d<d'<R, R being the perimeter radius of the cavity 142.

FIG. 4*b* illustrates a centered arrangement of wells along a pattern 61 (shown as square-shaped but could be any other oblong shape) comprising a center well (initial well 30) and 4 peripheral wells identified as '45*x*' where x=a, b, c, d which have an inter-well spacing d' and which are within the perimeter 155 of the cavity 142. The spacing d between center well 30 and one peripheral well 45*x* may be such that d<d'<R, R being the radius of the perimeter 155 of the cavity 142.

FIG. 4*c* uses a centered arrangement of wells along a pattern 62 (illustrated as a pentagon but could be any other polygonal shape with 5 sides) comprising a center well (initial well 30) and 5 peripheral wells identified as '45*x*' where x=a, b, c, d, e, which have an inter-well spacing d' and which are within the perimeter 155 of the cavity 142. The spacing d between center well 30 and one peripheral wells 45*x* may be such that d<d'<R or d'<d<R, R being the radius of the perimeter 155 of the cavity 142.

FIG. 4*d* illustrates a centered arrangement of wells along a pattern 63 (shown as circular-shaped but could be any ovoid shape such as an oval shape) comprising a center well (initial well 30) and 8 peripheral wells identified as '45*x*' where x=a, b, . . . h, which have an inter-well spacing d' and which are within the perimeter 155 of the cavity 142. The spacing d between center well 30 and one peripheral wells 45*x* may be such that d'<d<R, R being the radius of the perimeter 155 of the cavity 142.

FIG. 4*e* illustrates a centered arrangement of wells along a hexagonal pattern 64 comprising a center well (initial well 30) and 6 peripheral wells identified as '45*x*' where x=a, b, . . . f, which have an inter-well spacing d' and which are within the perimeter 155 of the cavity 142. The spacing d between center well 30 and one peripheral wells 45*x* may be such that d'<d<R, R being the radius of the perimeter 155 of the cavity 142.

FIG. 4*f* illustrates a multi-well arrangement comprising two centered concentric patterns 164, 64' of wells. These patterns 164, 64' are shown as hexagonal patterns but could be of any other polygonal shape with $3^+$ sides or any ovoid shape. Since the pattern 164 surrounds the pattern 64' in FIG. 4*f*, for that reason, the pattern 164 may be termed the 'outer pattern' while the pattern 64' may be termed the 'inner pattern'.

The multi-well arrangement of FIG. 4*f* comprises a center well 30*a* (which is typically the initial well from which the cavity 142 is created by lithological displacement of the trona stratum 5) and may optionally comprise two other center wells 30*b* and 30*c* (as shown) which are in close proximity to the center well 30*a*. The multi-well arrangement of FIG. 4*f* further comprises 8 peripheral wells identified as '45*x*' where x=a, b, . . . h, along the first hexagonal outer pattern 164 in which the spacing between initial center well 30*a* and peripheral wells 45*x* is d; and 6 additional peripheral wells identified as '46*x*' where x=a, b, . . . f, along the other (second) hexagonal inner pattern 64', in which the spacing between the initial center well 30*a* and peripheral wells 46*x* is d". The peripheral wells '46*x*' are preferably evenly distributed on the 6 vertices of the hexagonal pattern 64'. The peripheral wells '45*x*' where x=a, b, . . . , f are preferably also evenly distributed on the 6 vertices of the hexagonal pattern 164, while peripheral wells 45*g* and 45*h* are located on two sides of the hexagonal pattern 164. All peripheral wells 45*x* and 46*x* are within the perimeter 155 of the cavity 142 and d"<d<R.

The additional center wells 30*b* and 30*c* as illustrated in FIG. 4*f* may be created to supplement the requirement in solvent and/or brine flow rate at the initial center well 30*a*. The additional center wells 30*b* and 30*c* may be drilled after well 30*a* has been used to initiate cavity development therefrom. Or the additional center wells 30*b* and 30*c* may be drilled before well 30*a* is used to initiate cavity development therefrom.

In alternate embodiments in which there are more than one center well (and which is not shown in FIG. 4*a-f*), there may be as many center wells 30*x* as there are peripheral wells 45*x*, and each center well '30*x*' may be paired to a peripheral well '45*x*' so that the pair switches operation mode, one well switching from injection to production while the other switching from production to injection, simultaneously for example via a cross-over valve.

Optionally, the multi-well set may also comprise one or more random wells identified as 47*a* and 47*b* in FIG. 4*f*. They are called 'random', because they are randomly placed within the perimeter 155 of the cavity 142, that is to say, they are not aligned along a specific pattern of wells like along a pattern such as patterns 60, 61, 62, 63, 64, 164 of FIGS. 4*a*, 4*b*, 4*c*, 4*d*, 4*e* and 4*f*, respectively. The optional random wells 47*a* and 47*b* may be created to supplement the requirement in solvent flow input to the cavity 142 and/or brine flow output from the cavity 142. For example, a random well may be placed in an up-dip region of the trona stratum 5, when such random well is intended to be used mainly as injection well into the cavity 142, and/or a random well may be placed in a down-dip region of the trona stratum 5, when such random well is intended to be used mainly as production well to extract brine from cavity 142.

Another embodiment for the lithological displacement (lifting) of a trona stratum using a directionally drilled well for injection will now be described with reference to the following drawing: FIG. 2.

The method may comprise drilling a directionally drilled well 31 from the ground surface to travel more horizontally down to the depth of the interface 20. A horizontal section 32 of well 31 is drilled intersecting the interface 20. The bottom edge of the section 32 may be underneath the interface 20.

The downhole end of horizontal section 32 preferably comprises an in situ injection zone, which is in fluid communication with the strata interface 20.

The fluid is injected in the directionally drilled well 31 and flows out of the well 31 through the in situ injection zone which may comprise one or more downhole casing openings.

The horizontal borehole section 32 may have a downhole end opening 33 which is located at or near the parting interface 20. The downhole end opening 33 may comprise one or more holes with a smaller diameter than the internal diameter of the section 32 and may consist of the entire downhole end of the section 32. The horizontal borehole section 32 may have, alternatively or additionally, perforations 34 which are located at or near the parting interface 20. In some embodiments, the perforations 34 may be placed along at least one generatrix of the casing of the horizontal section 32, the generatrix being generally aligned with the interface. However, perforations 34 do not necessarily need to be aligned with the interface 20.

The one or more casing openings are preferably selected from the group consisting of the downhole end opening 33, casing perforations 34, and combinations thereof. The casing opening(s) would provide a suitable in situ injection zone through which the fluid can flow to enter the interface plane.

In the directionally drilled horizontal well 31, the gap 42' may be created as an extension of the borehole section 32 where the fluid 50 exits its downhole casing opening(s).

Several ways in creating the gap 42' by means of fluid injection may be carried out using various embodiments of the downhole borehole section 32, in which one or more casing openings (e.g., end opening 33 and/or casing perforations 34) serve to inject the fluid 50 in situ into the interface 20 as follows:

- injecting the lifting fluid 50 from only the downhole end opening 33 of the borehole section 32 (in which the downhole end opening 33 may comprise one or more holes with a smaller diameter than the internal diameter of the cylindrical section 32);
- injecting the lifting fluid 50 through the downhole end opening 33 of borehole section 32 and through casing perforations 34 perforating the casing of the section 32 along at least a portion of its length and being aligned along at least one generatrix of section 32, preferably perforating the entire length of the borehole section 32, the perforations being either on two generatrices of cylindrical section 32 which are aligned with the interface 20 so as to laterally inject fluid 50 from both sidewalls of the horizontal section 32 or on one generatrix 36 which is aligned with the interface 20 so as to laterally inject fluid 50 from only one sidewall of the horizontal section 32; or
- injecting the lifting fluid 50 through only side casing perforations 34 along at least one generatrix of at least a portion of the horizontal borehole section 32 (the end opening 33 being closed or impermeable to fluid flow in this embodiment), said generatrix being aligned with the interface 20, the perforations 34 preferably perforating the entire casing length of the borehole section 32, the perforations being either on two generatrices of cylindrical section 32 which are aligned with the interface 20 so as to laterally inject fluid 50 from both sidewalls of the horizontal section 32 or on one generatrix which is aligned with the interface 20 so as to laterally inject fluid 50 from only one sidewall of the horizontal section 32.

It is to be noted that the alignment of the casing perforations (perforations 34 for initial directionally-drilled well 31 or perforations for initial vertical well 30) with the interface 20 has been described above in the context of FIGS. 1 and 2.

However, it should be understood that such alignment is not required for adequate lifting the evaporite stratum at the interface 20. Additionally, these casing perforations may be oblong with their main axis being somewhat aligned with the interface 20. However, vertical slits or circular holes or any shaped punctures with a main axis being misaligned with the interface 20 are equally suitable so long as they are located at or near the interface 20 to permit fluid flow from these perforations to the interface 20. Since casing perforations in wells 30 or borehole portion 33 of well 31 should be near proximity to the interface 20 and since hydraulic pressure acts in all directions equally, even fluid injected from a vertical perforation or any shaped puncture not aligned with the interface 20 should find its way to the interface 20.

Figure 3B:
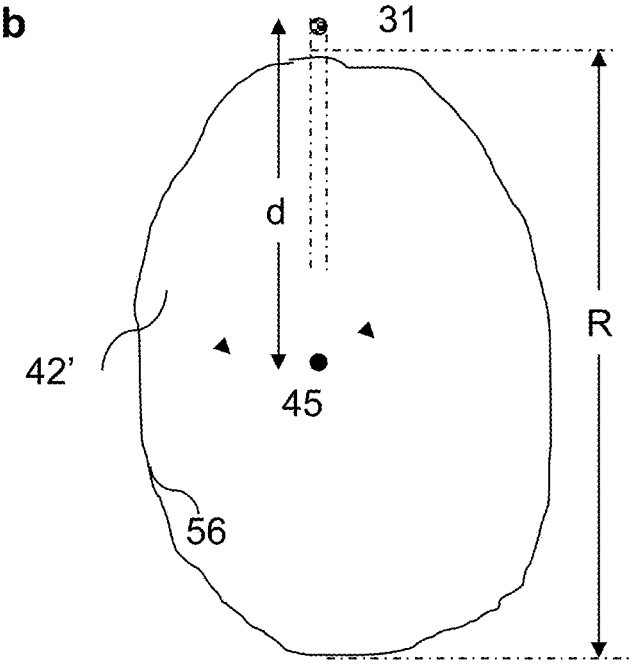
FIG. 3*b* shows a plan view of the cavity formed by lithological displacement (lifting) of the trona stratum using a directionally drilled well as illustrated in FIG. 2.

Similarly as described earlier for FIG. 3*a*, the lateral extent of the gap 42' should intersect the perforated section 47 of well 45 in FIG. 3*b*. The well 45 is preferably vertical but it may be directionally drilled with a horizontal section.

For extraction of brine to the surface, one or more wells which may be drilled at a distance from the initial directionally drilled well 31. For illustrative purposes, one vertical production well 45 is illustrated in side-view in FIG. 2 and in plan-view in FIG. 3*b*.

Figures 11A, 11B:
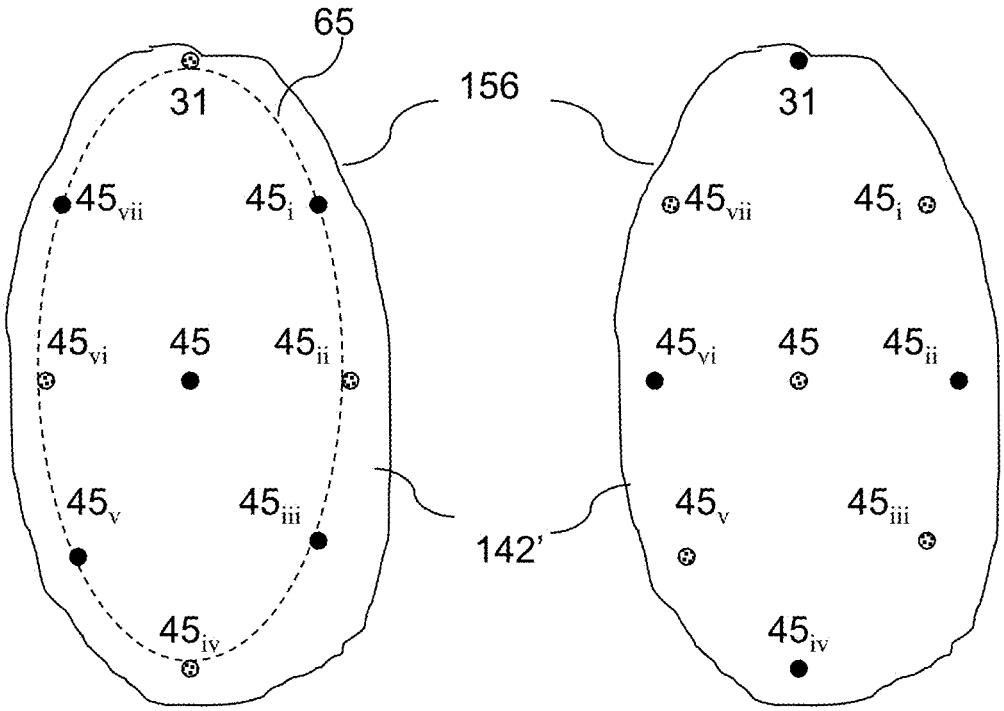
FIGS. 11*a* and 11*b* illustrate yet other embodiments of step (d) according to the present invention, comprising switching some wells in a 9-well set arranged in an oval-shaped pattern and comprising a center well and peripheral wells in fluid communication with a cavity formed by lithological displacement of a trona stratum via a directionally drilled well as illustrated in FIG. 2, in which, at proper time intervals, the mine operator switches modes of operation of adjacent peripheral well pairs.

But in some embodiments of the present invention, the set of wells used for ore exploitation comprises at least 4 wells. One well in the set is the initial well 45 which may become a center well in the well arrangement; another well in the set may be the initial well 31 through which the lifting fluid 50 is injected to lift the evaporite mineral 5 so that well 31 may be used as a peripheral well (albeit the location of its surface end may be located outside the perimeter 56 of gap 42'), while additional wells may be added as peripheral wells arranged along the perimeter 56 of the gap 42' in a pattern centered around the initial well 45 as illustrated in FIG. 3*b*. An example of a suitable well arrangement within the perimeter of cavity 142' used in ore exploitation is illustrated in FIG. 11*a*.

In FIG. 3*b*, the production well 45 may be drilled at a certain distance 'd' from the downhole location of the in situ injection zone of the horizontal section 32 so that the main fluid vector is directed towards the production well 45.

The gap 42' may be created as an axial extension of a well's horizontal borehole section 32 when the fluid 50 exits its downhole end opening 33.

The gap 42' may be created as a lateral extension of this horizontal borehole section 32 when the fluid 50 exits sidewall perforations 34 located on one or more generatrices of the borehole section 32.

The gap 42' may be created as a lateral and axial extension of this horizontal borehole section 32 when the fluid 50 exits end opening 33 and sidewall perforations 34 located on one or more generatrices of the borehole section 32.

To create a multitude of interconnected wells, more than one well 45 may be drilled within the perimeter 56 of the interface gap 42' which is enlarged into cavity 142' by mineral dissolution. An example of such arrangements of peripheral wells for a lithologically-displaced gap from the directionally-drilled well 31 is illustrated in FIG. 11*a*. Peripheral wells 45*y* (with y=i, ii, . . . wii) in FIG. 11*a* may be drilled prior to the lithological displacement such as is described below for the well 45 in FIG. 1. But some of the peripheral wells 45*y* may be drilled after the interface gap 42' has been created and has been enlarged by dissolution of mineral to form the mineral cavity 142'.

FIG. 11*a* illustrates a 9-well set with a centered arrangement pattern 65 (illustrated as an oval shape but could be any ovoid shape), the set of wells comprising a central well (well 45) and 8 peripheral wells identified as well 31 (the initial directionally drilled well through which the trona ore is lithologically displaced) and wells 45*y* where y=i, ii, . . . , vii. Wells 45 and 45*y* are within the perimeter 156 of the cavity 142', but well 31 may be inside or outside perimeter 156.

Wells

The wells may be initially established by conventional drilling, installation of casing, cementing between the casing and bore hole, and installation of injection tubing string or production tubing string or both in each well with appropriate spacers.

During solution mining, these interconnected wells may be alternated periodically as injection and production wells, with a buoyant unsaturated solvent directed from an injection well to a production well. This procedure should reduce the morning-glory cavity configuration or necking down or barbell cavity configuration as a result of jetting less saturated solution by moving the injection points and extraction points around the cavity.

The wells may be paired, and cross-over valves may be provided and controlled so that the two wells can serve alternately as injection and production wells. This promotes even cavity growth, and prevents scaling in the injection and production tubing strings.

Periodically, for pairs of wells, the cross-over valve may be opened to permit reversing of the liquid flow through the well tubing strings. Cross-over typically is accomplished by a pair of valves, one in each of the cross-over lines. This should promote more even dissolution of the mineral in the cavity and prevents the plugging of the production tubing string.

The wells preferably have the same internal diameter, generally from 5 to 50 inches, preferably from 7 to 40 inches.

The injection well and the production well may be vertical, but not necessarily. The wells may be spaced by a distance of at least 50 meters, or at least 100 meters, or at least 200 meters. The wells may be spaced by a distance of at most 1000 meters, or at most 800 meters, or at most 600 meters. Preferred spacing may be from 100 to 600 meters, preferably from 100 to 500 meters.

The wells may be completed or modified to both inject and produce, albeit preferably not simultaneously. For these dual-purpose wells, installation of both injection and production tubing strings may be made with appropriate spacers.

Figure 5A:
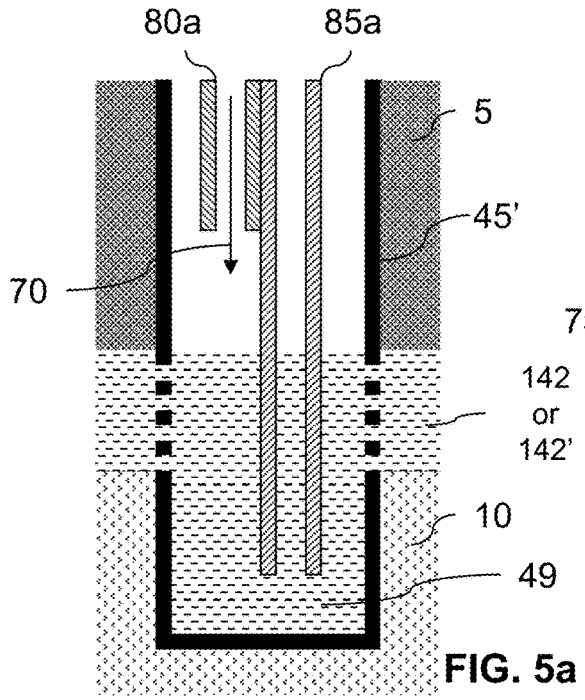
FIGS. 5*a* and 5*b* show a side view of a downhole end of a dual injection/production well containing side-by-side tubing strings, FIG. 5*a*. illustrating solvent injection in one tubing string, and FIG. 5*a*. illustrating brine extraction from one parallel tubing string.

One type of suitable downhole end of a dual injection/production well 45' is illustrated in FIG. 5*a* during injection of a production solvent 70 and in FIG. 5*a* during extraction of a brine 75 to the surface. The dual injection/production well 45' has side-by-side injection tubing string 80*a* and production tubing string 85*a*. The downhole end of the tubing strings 80*a* does not come in contact with the liquid level in the cavity 142 or 142', but the downhole end of the production tubing strings 85*a* is submerged in the liquid inside the sump 49 located at the downhole end of the dual injection/production well 45'.

Figure 5B:
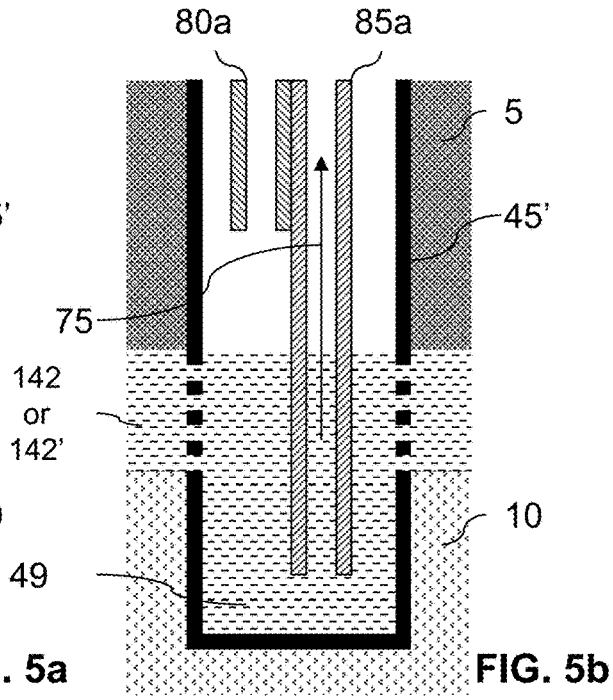

As illustrated in FIG. 5*a*, during the injection step (b), the production solvent 70 is injected through the tubing string 80*a*. As illustrated in FIG. 5*b*, after the operation of well 45' is switched from injection to production mode, the brine 75 is extracted to the ground surface through the tubing string 85*a*.

Figure 6A:
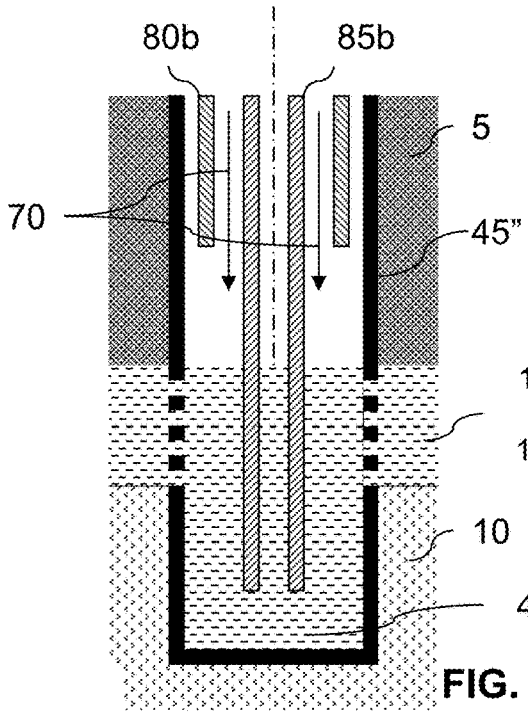
FIGS. 6*a* and 6*b* show a side view of a downhole end of a dual injection/production well containing concentric tubing strings, FIG. 6*a*. illustrating solvent injection in one outer tubing string and FIG. 5*a*. illustrating brine extraction from one inner tubing string.

Another type of suitable downhole end of a dual injection/production well 45" is illustrated in FIG. 6*a* during injection of production solvent 70 and in FIG. 6*a* during extraction of brine 75 to the surface. The dual injection/production well 45" has concentric injection tubing string 80*b* and production tubing string 85*b*. Like for well 45', the downhole end of the tubing strings 80*b* does not come in contact with the liquid level in the cavity 142 or 142', but the downhole end of the tubing strings 85*b* is submerged in the liquid inside the sump 49 located at the downhole end of the dual injection/production well 45".

Figure 6B:
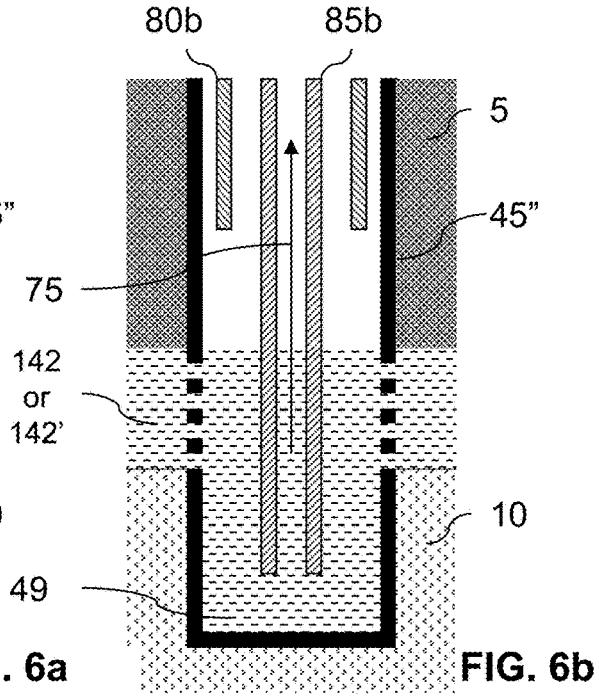
Figure 10A:
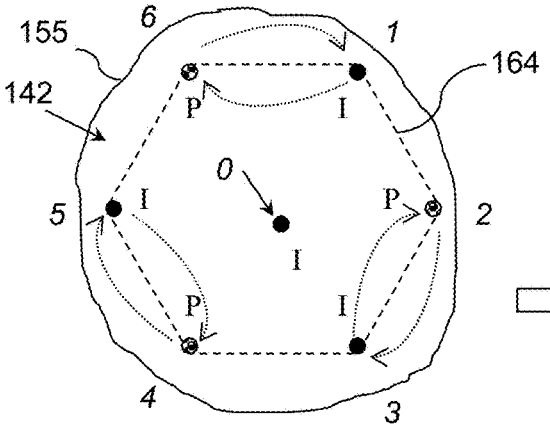
FIGS. 10*a*, 10*b*, 10*c*, and 10*d* illustrate other embodiments of step (d) according to the present invention, comprising switching some wells in a 7-well set arranged in a hexagonal-shaped pattern comprising a center well and 6 peripheral wells in fluid communication with a cavity formed by lithological displacement of a trona stratum, in which at proper time intervals the mine operator shift modes of operation of well pairs in random fashion.
Figure 10B:
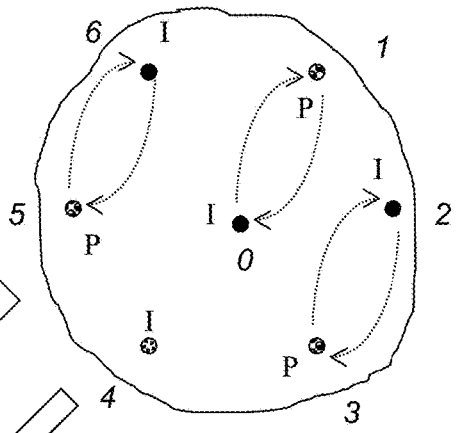
Figure 10C:
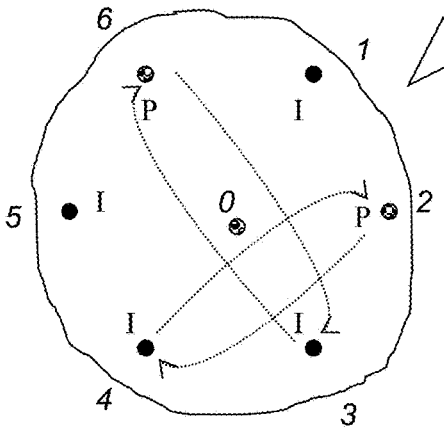
Figure 10D:
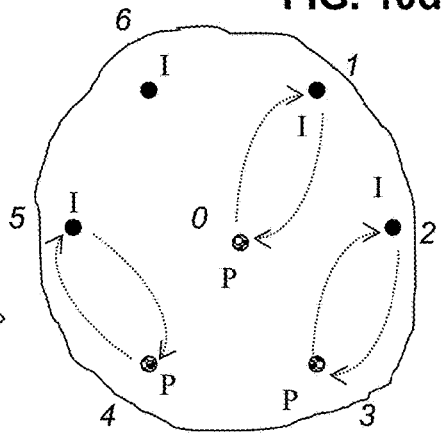

As illustrated in FIG. 6*a*, during the injection step (b), the production solvent 70 is injected through the tubing string 80*b* and the brine 75 is extracted to the ground surface through the tubing string 85*a*. As illustrated in FIG. 6*b*, after the operation of well 45" is switched from injection to production mode, the brine 75 is extracted to the ground surface through the tubing string 85*b*.

Headers and manifolds may be installed to allow both injection and production at each dual-purpose well.

Not all wells need to be dual-purpose wells, but at least 67%, or at least 80%, or at least 90% of the wells in the set are dual-purpose wells.

In some embodiments, the set of wells may contain two or more dual-purpose wells and at least one single-purpose well. A 'single-purpose' well is designed to only carry out injection or production, but not both.

In some instances where the ore stratum may have a dip, a well or wells within the cavity perimeter which are near the lowest point of the ore stratum (that is to say, down dip) may be a single-purpose well dedicated solely for production.

In yet these instances where the ore stratum may have a dip, a well or wells within the cavity perimeter which are near the highest point of the ore stratum (that is to say, up dip) may be a single-purpose well dedicated solely for injection.

The set of wells may comprise a number 'n' of wells with n>4, and a number less than 'n' wells, preferably a number (n−1) of wells, are peripheral wells that may be arranged in one or more patterns centered around at least one center well.

The peripheral wells are preferably centered around one center well.

The set of wells may be arranged in a single pattern or two or more concentric or pseudo-concentric patterns centered around at least one center well.

The pattern may comprise or consist of at least one polygon with from 3 to up to 12 sides, a honeycomb shape, or at least one ovoid shape, preferably a circle, an oval, or a polygon with 4 to 6 sides.

The set of wells may comprise from 4 to 100 or more wells, preferably comprises from 4 to 40 wells; more preferably comprises from 4 to 20 wells.

The set of wells arranged in a single pattern or a concentric pattern centered around one center well may also comprise one or more randomly-arranged wells.

During solution mining, these interconnected wells may be alternated periodically as injection and production wells, with a buoyant unsaturated solvent directed from an injection well to a production well.

The wells may be paired, and cross-over valves may be provided and controlled so that the two wells can serve alternately as injection and production wells.

The switching step (d) may promote even cavity growth (even dissolution in the cavity) and/or prevent scaling and/or plugging in the injection and production tubing strings (85*a*, 85*b* in FIG. 5*b*, 6*b*).

Indeed, this step should reduce the morning-glory cavity configuration or necking down or barbell cavity configuration by varying the injection points and extraction points within the cavity.

Periodically, for pairs of wells, the cross-over valve may be opened to permit reversing of the production solvent flow through the well tubing strings. Cross-over typically is accomplished by a pair of valves, one in each of the cross-over lines.

A brine collection zone (for example sump 49 in FIGS. 1 and 2) may be created at a downhole end of production wells or dual-purpose wells (generally below the trona stratum floor) to facilitate the recovery of the brine from the ore mined-out cavity. The formation of the collection zone may be by mechanical means (such as drilling past the interface 20) and optionally by chemical means (such as solution mining with a localized application of unsaturated solvent at the base of the mineral stratum).

A region of the collection zone may have a lower elevation (greater depth) than the bottom of the mineral ore stratum.

An initial vertical injection well, such as well 30 in FIG. 1, may be modified to become a dual injection/production well, by drilling the plug 35 (illustrated in FIG. 1) at the bottom of this well in order to make a sump to collect brine.

An initial directionally-drilled injection well, such as well 31 in FIG. 2, may be modified to become a dual injection/production well, by extending the vertical portion drilled down past the trona/oil shale interface 20 to form at the bottom of this well a sump to collect brine.

A pumping system (not illustrated) may be installed so that the brine can be pumped to the surface for recovery of the valuable products. Suitable pumping system can be installed at the downhole end of production wells and dual-purpose wells or at the surface end of these wells. This pumping system may be an 'in-mine' system in the sump 49 (sometimes called 'sump pump' or 'downhole pump') or a 'terranean' system at the ground surface (sometimes called 'surface pump'). A brine return pipe (such as tubing strings 85*a*, 85*b* in FIG. 6*a*, 6*b*) may be placed into the downhole collection zone (sump 49 in FIG. 6*a*, 6*b*) in fluid communication with such pumping system (not illustrated) to allow the brine to be pulled or pushed to the surface.

Exploitation of the Mineral Cavity

To carry out the method according to the present invention, at least one cavity has been formed by a lithological displacement of the mineral stratum as described above. The lithological displacement is performed when the mineral stratum is lying immediately above a water-insoluble stratum of a different composition with a weak parting interface being defined between the two strata and above which is defined an overburden up to the ground, such lithological displacement comprising injecting a fluid at the parting interface to lift the evaporite stratum at a lifting hydraulic pressure greater than the overburden pressure, thereby forming an interface gap which is a nascent mineral cavity at the interface and creating said mineral free-surface. The interface gap may or may not be propped open by injection of a suitable proppant material.

Once at least one cavity is formed by lithological displacement of the mineral stratum and the set of wells is in fluid communication with such cavity, the exploitation operation for mineral dissolution with the use of a production solvent and brine extraction to the surface can commence.

The method thus comprises:

b) injecting a (production) solvent into the at least one cavity through a first subset of wells operated in injection mode for the solvent to contact the mineral free face as the solvent flows through the at least one cavity and to dissolve in situ at least a portion of the mineral from the free face into the solvent to form a brine;

c) extracting at least a portion of said brine to the ground surface through a second subset of wells operated in production mode;

d) switching the operation mode of at least one well from the set after a suitable period of time; and (e) repeating the steps (a) to (d).

In a continuous mode, the production solvent is injected into the cavity via the first subset of wells during step (b) for the hydraulic pressure in the cavity to reach the desired operating pressure; then, the flowing production solvent dissolves the mineral from the solvent-exposed mineral free-surface and gets impregnated with dissolved mineral and forms a brine, and the cavity gets enlarged, while at the same time at least a portion of the resulting brine is continuously extracted to the surface via the second subset of wells during step (c) in such a way as to maintain the desired operating pressure in the cavity. The extracted brine may be recycled in part and re-injected into the cavity for additional enrichment in mineral.

The steps (b) to (d) may be carried out in the cavity at a pressure from less than the lifting hydraulic pressure (which is used during the lithological displacement of the mineral ore to create the interfacial gap) to less than hydrostatic head pressure.

In particular, the dissolution due to ore contact with the flowing solvent inside the cavity may be carried out at a hydraulic pressure from less than the lifting pressure to hydrostatic head pressure (at the depth at which the solution-mined cavity is enlarged), in which the cavity is filled with solvent. By flooding the cavity, the production solvent contacts the cavity ceiling and, upon contact with the mineral, dissolves it. Preferably, the dissolution may be carried out at a hydraulic pressure slightly above the hydrostatic head pressure (preferably from 0.01% to 10% higher than hydrostatic head pressure).

Because the mineral stratum is not pure (contains insoluble matter), a layer of insolubles may be deposited during dissolution in the mined-out cavity. This layer of insoluble separates the floor and ceiling of the mined-out cavity, while mechanically supporting the cavity ceiling and maintaining the mineral free-surface on the cavity ceiling accessible to the production solvent. Such insoluble layer gets thicker as more and more of the mineral from the cavity ceiling get dissolved, and provides, through its porosity, a channel through which the production solvent can pass.

When the mined-out cavity is self-supported by mineral rubble fractured from the cavity ceiling and/or by a layer of water insoluble material, the mineral dissolution may be carried out at a hydraulic pressure below hydrostatic head pressure. This is preferably done when the development of the mined-out cavity is mature, that is to say, when the mineral cavity created by at least a week or weeks of dissolution is now self-supported without having to apply a hydraulic pressure greater than the overburden pressure to keep it open. Due to too high overburden weight on an unsupported roof span of the mineral cavity, blocks of mineral rubble get fractured in the cavity ceiling and, as a result, mineral rubble lay inside the mineral cavity. In this instance, the cavity not only contains a layer of insolubles but also mineral rubble, both of which now support the new cavity ceiling. In this situation, it is not necessary to flood the cavity with the production solvent to access the cavity ceiling's mineral free-surface, because the mineral rubble now inside the cavity provides plenty of mineral free-surfaces for the production solvent to contact and dissolve to form the brine. Steps (b) and (c) are generally facilitated by a pump.

When the well switches operation mode in step (d), the solvent injection and brine production for this well may be carried out by a same pump (downhole pump or surface pump), preferably by a same surface pump when operating from hydrostatic head pressure up to lifting hydraulic pressure in the cavity; or by a same downhole pump when the hydraulic pressure in the cavity is maintained from hydrostatic head pressure to sub-hydrostatic head pressure during the solution mining operation.

In some embodiments when a well is switched from injection to production mode, a valve which controls the solvent flow inside such dual-purpose well may be closed to stop injection, while another valve which controls brine flow inside such dual-purpose well is opened to start production.

In some embodiments when a well is switched from production to injection mode, a valve which controls brine flow inside such dual-purpose well is closed, while another valve which controls the solvent flow inside such dual-purpose well may be open to start injection.

According to some embodiments of the present method, the step (d) may comprise switching the operation mode of at least one well from the first subset and also switching the operation mode of at least one well from the second subset after a suitable period of time.

According to some embodiments of the present method, the step (d) may comprise switching the operation mode of a pair of wells with cross-over valves.

The step (d) may comprise switching the operation mode of two or more wells from the first subset from injection to production and also switching the operation mode of two or more wells from the second subset from production to injection after a suitable period of time.

The flow of the solvent in the cavity is preferably non-unidirectional, but rather the well switching step (d) allows for the solvent to circulate throughout the cavity space, and for the solvent flow to have various orientations of flux vectors.

The suitable period of time for switching operation mode in step (d) is from 1 hour to 1 week, preferably from 2 hour to 4 days, more preferably from 3 hours to 2 days, most preferably from 4 hours to 1 day.

The method further comprises (e) switching at least one well from the set to an inactive mode. Step (e) may be temporary (and flow in or out may be resumed in this inactive well); or step (e) may be permanent and this well stays inactive for the remainder of the exploitation period.

In some embodiments when in step (e) the well is switched from injection to inactive mode, the valve which controls the solvent flow inside the well is closed to stop injection.

In some embodiments when in step (e) the well is switched from production to inactive mode, the valve which controls brine flow inside the well is closed to stop production.

According to any of or all of embodiments according to the method, when the operation mode of a dual-purpose well is switched, it is preferred to first stop the liquid flow in one tubing string before starting the flow in the other tubing string.

Examples of various techniques for switching the operation mode of one or more wells suitable for step (d) and/or optional step (e) are illustrated in FIG. 7*a*-7*d*, FIG. 8, FIG. 9, FIG. 10*a-d*; and FIG. 11*a-b*, in which a well under production mode ('production well') is identified as a spotted circle; a well under injection mode ('injection well') is identified as a black circle; and a well not operating ('inactive well') is identified as a white circle.

Reference will be made below to cavity 142 or 142' in the description of FIG. 7-19. Such cavity 142 (142') is created by the enlargement of the gap 42 (42') via mineral dissolution.

FIGS. 7*a*, 7*b*, 7*c*, and 7*d* show in plan views various embodiments of step (d) comprising alternating operation modes of some wells in a 7-well set arranged in an hexagonal pattern 164 comprising a center well (identified as '0') in production mode (P) and 6 peripheral wells at positions W1 to W6 in fluid communication with each other, all within the perimeter 155 of the cavity 142 formed by lithological displacement of a trona stratum, in which at suitable time intervals injection flow is shifted in a circular fashion from one peripheral well to the next adjacent peripheral well around the perimeter of the cavity—injecting from each successive peripheral well in a clockwise fashion (as shown) or in a counter-clockwise fashion (not shown) while closing the others—, and brine is recovered from the center well (W0) as production well. In FIG. 7*a*, the well W6 is switched from injection (I) to closed while the peripheral well W1 is switched from closed (C) to injection. In FIG. 7*b*, the peripheral well W1 is switched from injection mode (I) to closed mode while W2 is switched from closed (C) to injection (I). In FIG. 7*c*, peripheral well W2 is switched from injection (I) to closed while peripheral well W3 is switched from closed (C) to injection. In FIG. 7*d*, peripheral well W3 is switched from injection (I) to closed (C), while peripheral well W4 is switched from closed (C) to injection (I).

And these switching steps can be repeated all around the perimeter 155 of the cavity 142. The well switching in FIG. 7*a-d* is illustrated as being clockwise, but it could very well be counter-clockwise, or alternating between counter-clockwise and clockwise. In some embodiments, it may be desirable to operate the modes (inject, produce, or inactive) of the wells in pairs or in groups of three or more in many different possible patterns, up to and including random patterns, which best accomplish the objective requirements. The arrangements of the wells in operation in FIG. 7*b*-7*d* in fact represent derived patterns of the initial pattern in FIG. 4*a*, as these derived patterns are created by rotation of FIG. 4*a* around the center production well (position 0). As such, the pattern in FIG. 4*a* has five derived patterns (2 of which are not illustrated). FIG. 8 shows in a plan view another embodiment of switching operation mode in a 7-well set also with an hexagonal pattern comprising a center well in production mode (P) and 6 peripheral wells (W1-W6) in fluid communication with the cavity 142 formed by lithological displacement of a trona stratum, in which at suitable time intervals, the mine operator simultaneously switches three of the peripheral wells (W2, W4, W6) from closed (inactive) to injection mode while the other perimeter wells (W1, W3, W5) which were in injection mode are closed (inactive). This switching operation may be in fact accomplished by switching a pair of adjacent peripheral wells such as W2 and W3 from injection mode to inactive mode and vice versa.

FIG. 9 shows in a plan view yet another embodiment of switching operation mode in a 7-well set with an hexagonal pattern comprising a center well and peripheral wells (W1-W6) in fluid communication with a cavity formed by lithological displacement of the trona stratum, in which at proper time intervals, the mine operator switches the inner well from production to injection and switches a peripheral well from injection to production well; reversing this step; and carrying a similar dual-switch on the immediately adjacent peripheral well—thus "firing" each successive peripheral well W1 to W6 around the cavity perimeter. The well switching is illustrated as being clockwise in FIG. 9, but it could very well be counter-clockwise.

FIGS. 10*a*, 10*b*, 10*c*, and 10*d* show in various plan views another embodiment of switching operation mode in the same 7-well set arranged in the hexagonal-shaped pattern 164 within the perimeter 155 of the cavity 142 initially formed via enlargement of the interface gap 42 created by lithological displacement of a trona stratum as shown in FIG. 7*a-d*, this set of wells comprising a center well W0 and peripheral wells W1-W6 in fluid communication, in which at proper time intervals the mine operator shift modes of operation of well pairs in random fashion.

FIGS. 11*a* and 11*b* show in two plan views one embodiment of alternating operation mode in a 9-well set arranged in an oval-shaped pattern 65 and comprising a center well 45 and peripheral wells (31, 45*y* with y=I, ii, . . . wii) in fluid communication with the cavity 142' initially formed via enlargement of the interface gap 42' created by lithological displacement of the trona stratum via the directionally drilled well 31 (as described in FIG. 2). At proper time intervals, the mine operator shift modes of operation of adjacent peripheral well pairs.

Figure 12:
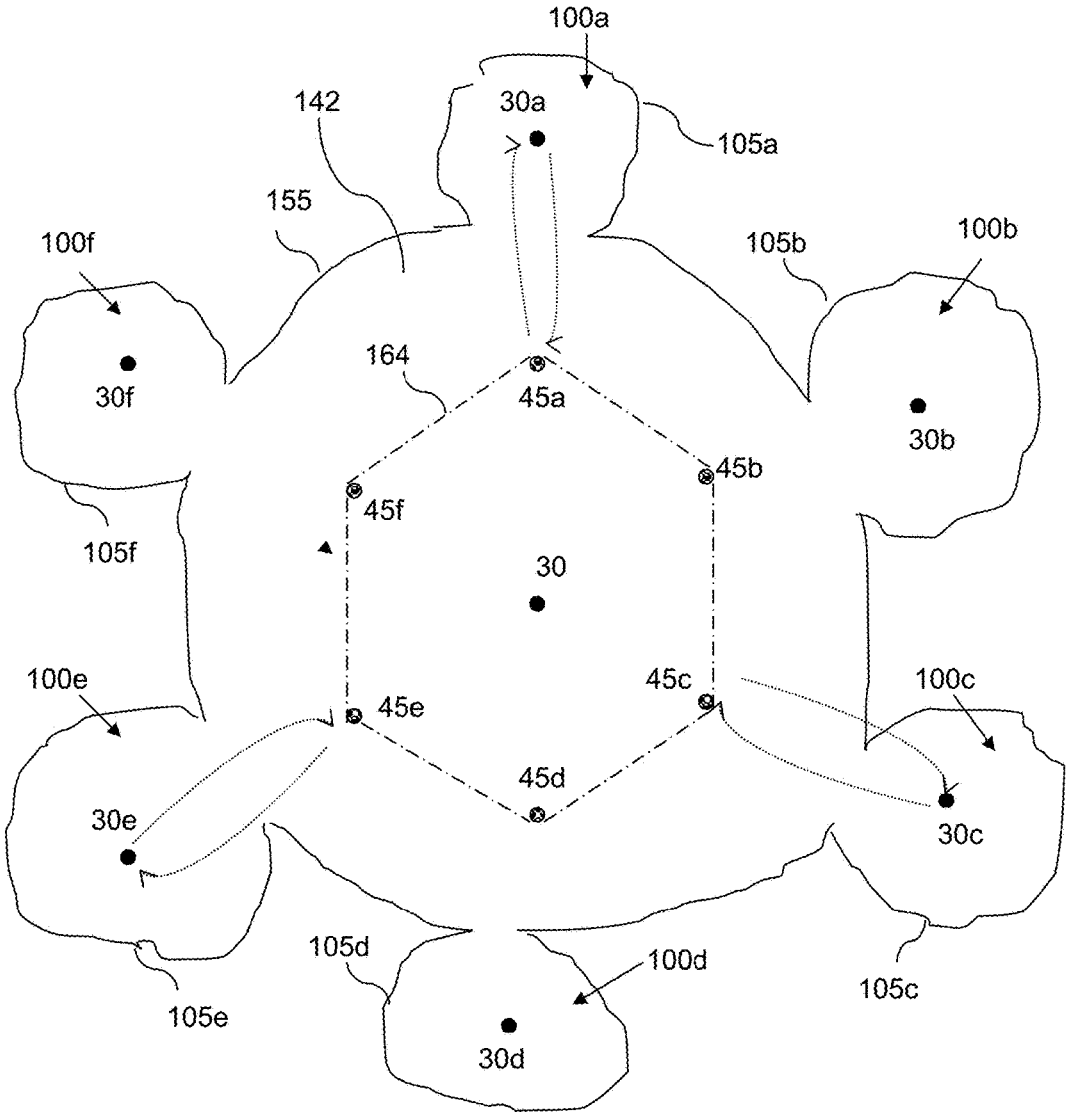
FIG. 12 illustrates yet another embodiment of step (d) according to the present invention, comprising switching operation mode of wells in a main 7-well set and in six hydraulically-connected peripheral cavities, such main 7-well set being arranged in a hexagonal-shaped pattern and comprising a main center well and six first peripheral wells, each of said plurality of peripheral cavities being formed by lithological displacement from their own center well, in which some wells are switched between production and injection modes from the main and peripheral cavities.

FIG. 12 shows in a plan view the exploitation of a main cavity 142 which is solution mined with a 7-well set arranged in a hexagonal-shaped pattern 164 and comprising a center well 30 and 6 first peripheral wells 45*x* with x=a, b, . . . f, this main cavity being hydraulically interconnected with a plurality of peripheral cavities 100*x* with x=a, b, . . . f, each being formed by lithological displacement from their own center well 30*x* with x=a, b, . . . f. The operation modes of a well from the main cavity 142 and a well from the closest adjacent peripheral cavity are alternated between production and injection. The pair coupling illustrated in FIG. 12 is as follows: 45*a*/30*a*; 45*c*/30*c*; and 45*e*/30*e*.

FIGS. 13*a*, 13*b*, 13*c*, and 13*d* illustrate the progressive development of another arrangement of a plurality of wells in fluid communication with a plurality of interconnected cavities according to another embodiment of the present invention. An initial number of injection wells are drilled, preferably in a pre-selected pattern, such number and pattern being determined based on mineral volume underneath to be mined as well as geological and physical constraints for drilling and injection/production.

Figure 13A:
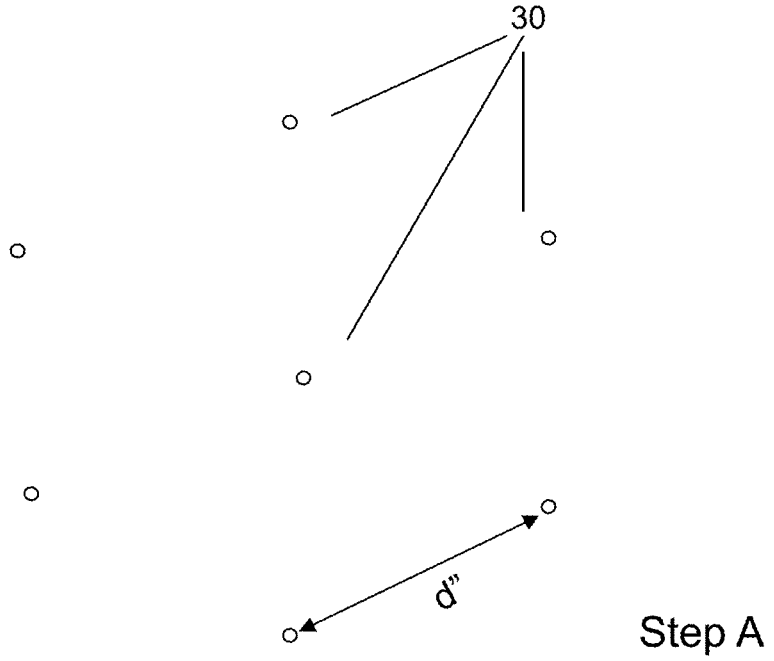
FIGS. 13*a*, 13*b*, 13*c*, and 13*d* illustrate the progressive development of a well field with an arrangement of a plurality of well sets in fluid communication with a plurality of interconnected cavities according to an embodiment of the present invention, each cavity being formed by lithological displacement from a well set with at least one center well and further comprising peripheral wells, preferably arranged on a specific pattern.

In FIG. 13*a*, seven initial wells 30 are positioned on the vertices and center of an hexagon with the inter-well distance d" between immediately-adjacent initial wells 30 being generally between 500 and 1500 feet, or between 800 and 1300 feet, or even between 1000 and 1250 feet.

Figure 13B:
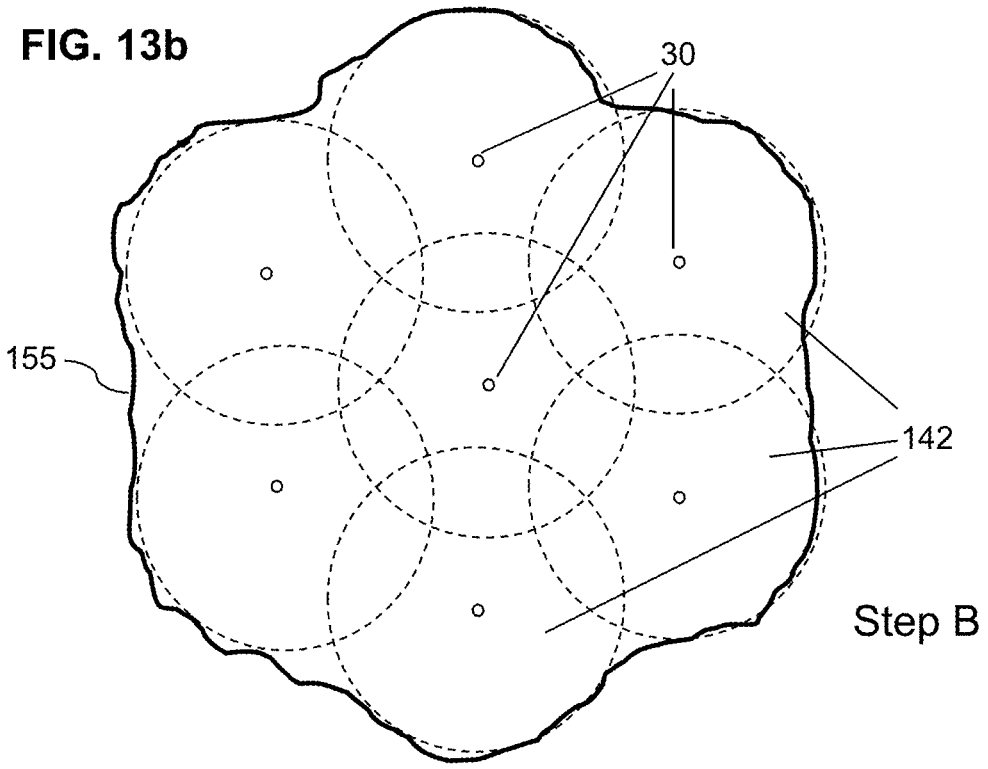

In FIG. 13*b*, a lifting fluid is injected into each well 30 either separately, i.e., not all at the same time, or simultaneously, i.e., all at the same time to perform a lithological displacement so as to create interfacial gaps which lead by ore dissolution to the formation of cavities 142 with a characteristic size and perimeter (shown here as an idealized circular shape) sufficiently large so that the lithologically displaced cavities 142 overlap (that is to say, the perimeter of two adjacent cavities 142 intersect in two points). The overall interconnected cavities 142 create an overall lithologically displaced zone (mega-cavity 143) with an outer boundary 155. Each injection well 30 is thus typically at or near the center of the lithologically-displaced cavity 142. As described previously, the cavities 142 that have been created through lithological displacement may or may not be propped open during the displacement phase by the introduction of suitable proppant material(s).

Figure 13C:
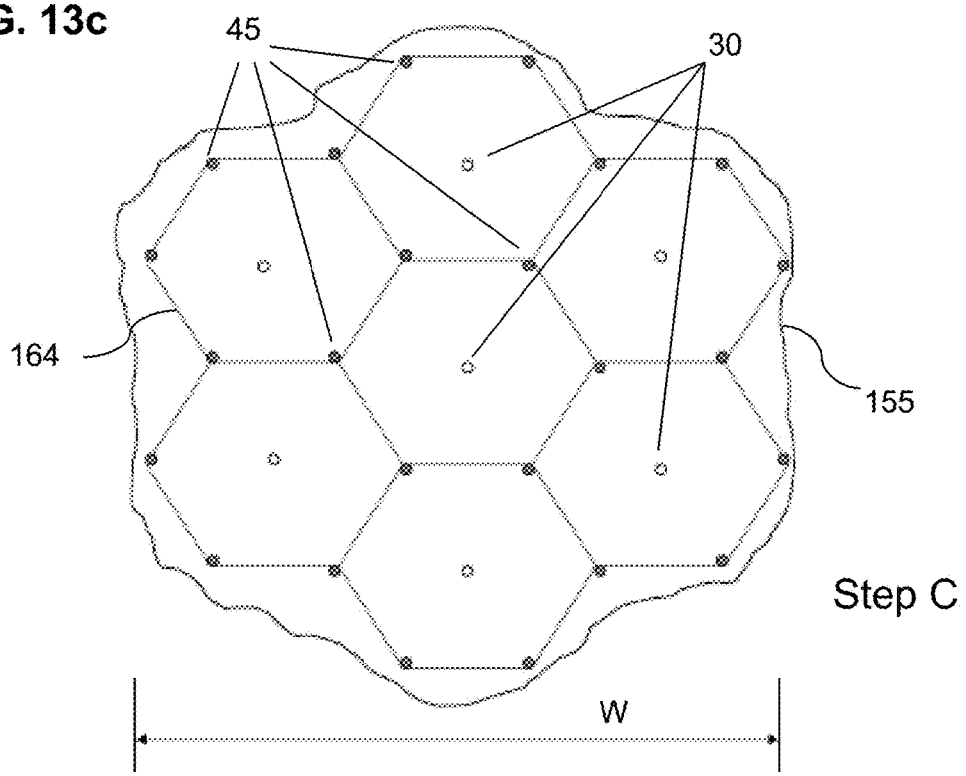

As shown in FIG. 13*c*, additional (peripheral) wells 45 (shown with ⊘) may be drilled in an arrangement following a desired well pattern (such as hexagonal pattern 164 shown in faint lines in this figure) while each well 30 (initial injection well) is inside such pattern, so that some wells 45 located on the hexagonal pattern 164 surround one well 30 to form individual, but interconnected, well sets. These wells 45 may be drilled prior to lithological displacement or may be drilled after the interfacial gaps are created by lithological displacement and enlarged by dissolution of the mineral ore to create the interconnected cavities 142. There is generally from 3 to 6 wells 45 as peripheral wells used for each cavity 142, preferably positioned at the vertices of each hexagonal shape 164, although not necessarily. The hexagonal patterns 164 are connected to each other, so that two adjacent patterns 164 share one side. The combination of these hexagonal patterns 164 make an overall honeycomb pattern to form a well field, in which the newly added wells 45 (peripheral) are at the vertices of two or three patterns 164 while the wells 30 are at or near the center of each pattern 164.

The wells 30 and 45 should be in fluid communication with at least one cavity 142. Each well (30, 45) is piped to a manifold for solvent, and comprises a valve which allows fluid to flow in (for injection mode) or flow out by reverse flow (for production mode), or stops fluid flow (for inactive mode).

Figure 13D:
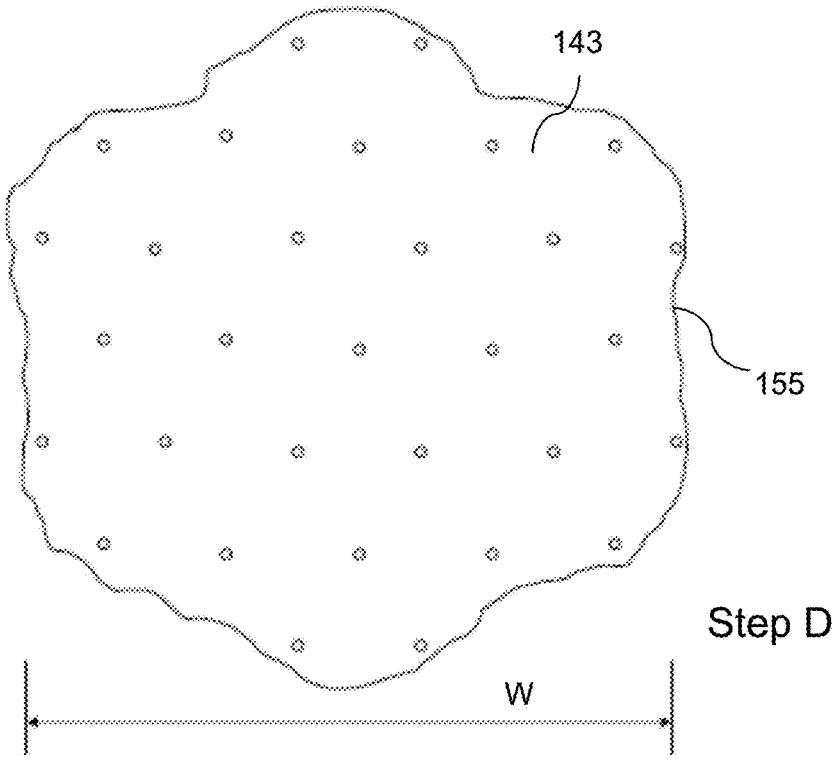

As shown in FIG. 13*d*, the exploitation of the mineral ore which utilizes the multi-well field provides for interconnection of the cavities and combination to form the 'mega-cavity' 143. This 'mega-cavity' 143 may have a span W of from 1000 to 3000 feet, from 1600 to 2600 feet, or from 2000 to 2500 feet.

As shown in FIG. 13*d*, when exploitation of the cavities is initiated, the method comprises injecting a solvent into a first set of wells selected as injection wells, while withdrawing a brine from a second subset of wells selected as production wells.

Figure 14:
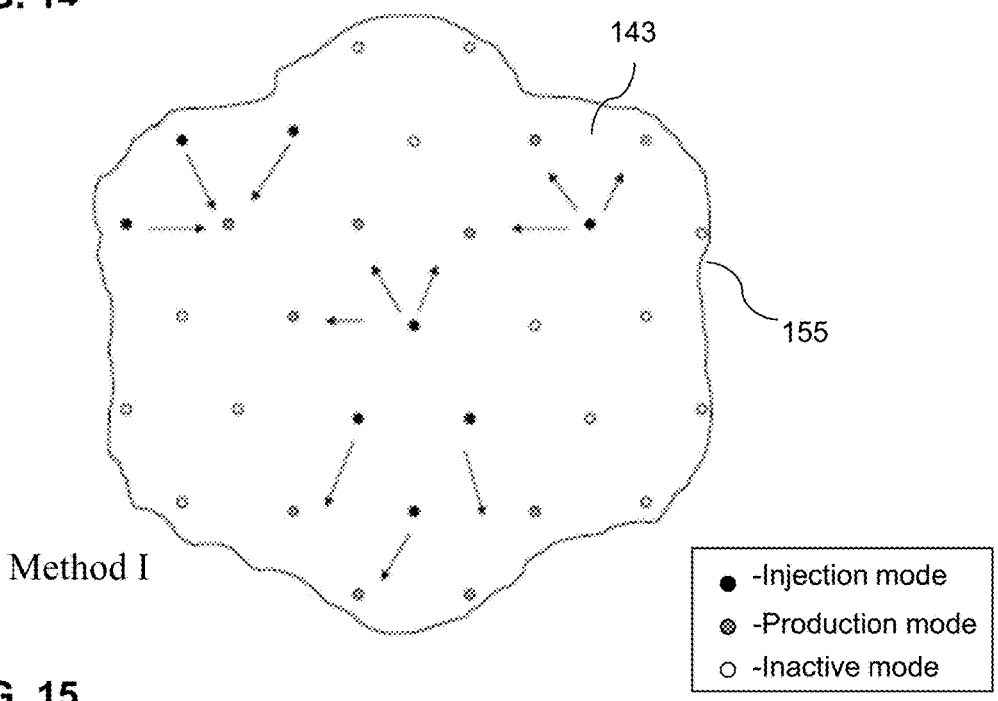
FIG. 14 illustrates an embodiment of well switching step (d) according to the present invention, which is identified as 'Method I' and which utilizes the well field in fluid communication with the plurality of interconnected cavities illustrated in FIG. 13*d;*

FIG. 14 illustrates 'Method I' which is an embodiment of well switching step (d) which utilizes the multi-well field arrangement illustrated in FIG. 13*d*. Each well set consisting of 6 peripheral wells and 1 center well can be operated as described above for a single well set for a single cavity 142 in which some of the wells in each set are periodically switched to achieve more uniform dissolution of mineral ore resource to meet exploitation and production requirements.

Figure 15:
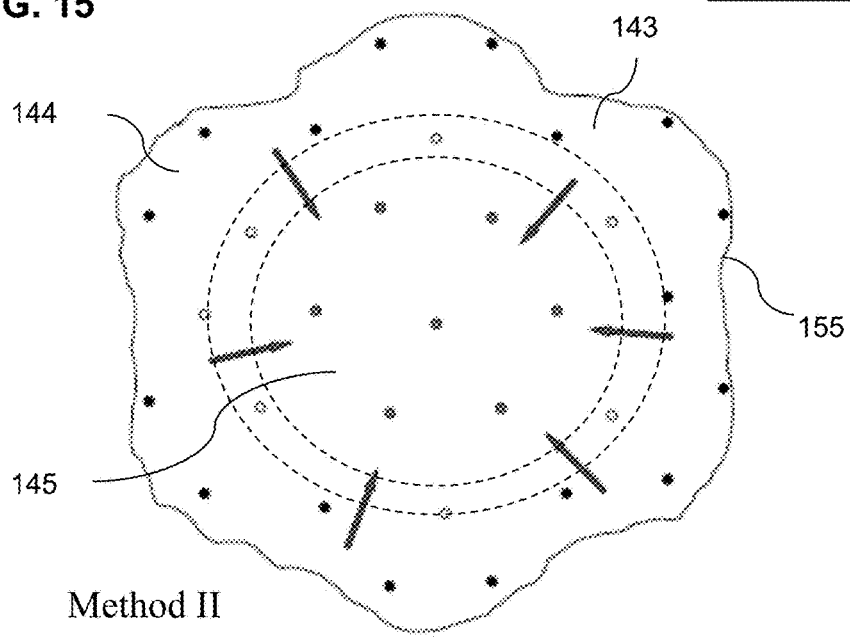
FIG. 15 illustrates another embodiment of well switching step (d) according to the present invention, which is identified as 'Method II' and which utilizes the well field in fluid communication with the plurality of interconnected cavities illustrated in FIG. 13*d;*

FIG. 15 illustrates 'Method II' which is another embodiment of well switching step (d) which utilizes the multi-well field arrangement illustrated in FIG. 13*d*. This Method II involves the 'concentric sequence' switching technique, in which outer wells at the periphery (in annulus 144) of the mega-cavity 143 are used as injection wells for the solvent to flow towards inner wells in central portion 145 of the mega-cavity 143 used as production wells, sometimes bypassing inactive wells sandwiched between active wells in the annulus 144 and the central region 145. Periodically, the operations of the outer wells in outer annulus 144 and the inner wells in the central region 145 are switched from solvent injection to brine production and vice versa.

Figure 16:
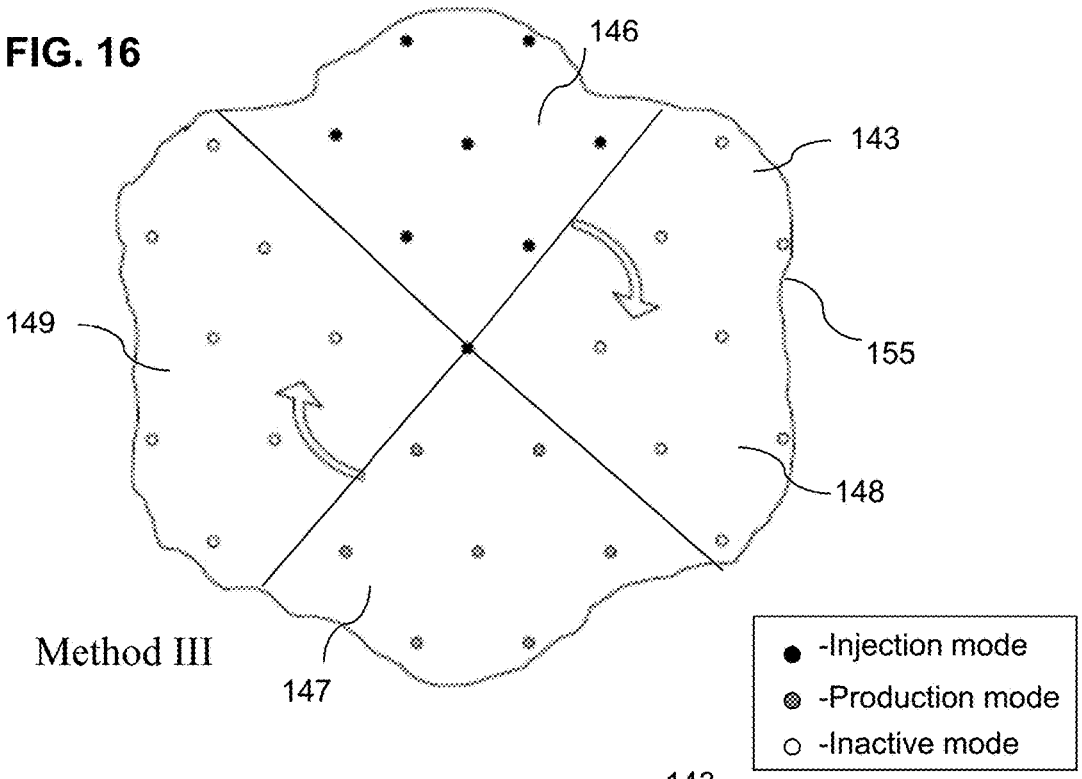
FIG. 16 illustrates yet another embodiment of well switching step (d) according to the present invention, which is identified as 'Method III' and which utilizes the well field in fluid communication with the plurality of interconnected cavities illustrated in FIG. 13*d;*

FIG. 16 illustrates 'Method III' which is yet another technique of well switching step (d) which utilizes the multi-well field arrangement illustrated in FIG. 13*d*. This Method III includes the 'rotational sequence' switching technique, in which the operation mode switching step (d) is performed on peripheral wells of the set to impart a rotating motion of solvent around a centered well of the set. Wells in a portion (quadrant 146) of mega-cavity 143 are operated in injection mode and wells in the opposite portion (quadrant 147) of mega-cavity 143 are operated in production mode, while the remaining wells in the sets in the opposite portions (quadrants 148 and 149) of mega-cavity 143 are inactive. For the rotational switch, the mode of wells in quadrant 146 is switched from injection to inactive, while the wells in adjacent quadrant 148 are switched from inactive to injection mode; and at the same time, the mode of wells in quadrant 147 is switched from production to inactive, while the wells in adjacent quadrant 149 are switched from inactive to production mode. Although the rotational switch Method III in the multi-well set in fluid communication with the mega-cavity 143 is illustrated as being clockwise, a counter-clockwise rotation technique is also applicable. An alternative to switching the entire quadrant of wells would be to partially switch sets of wells in each quadrant to rotate the quadrants in smaller increments. In alternate or additional embodiments of this rotational switch Method III in the multi-well set in fluid communication with the mega-cavity 143, once the rotating motion of solvent is established around the centered production well (by triggering various solvent injection events) to form a slowly rotating mass of nearly homogenous brine at or near saturation at the centered production well, the rotational switch Method III may further include reversing the rotating motion of solvent around the same centered production well (such as triggering the various solvent injection events as described above in the various quadrants but in reversed order).

Figure 17:
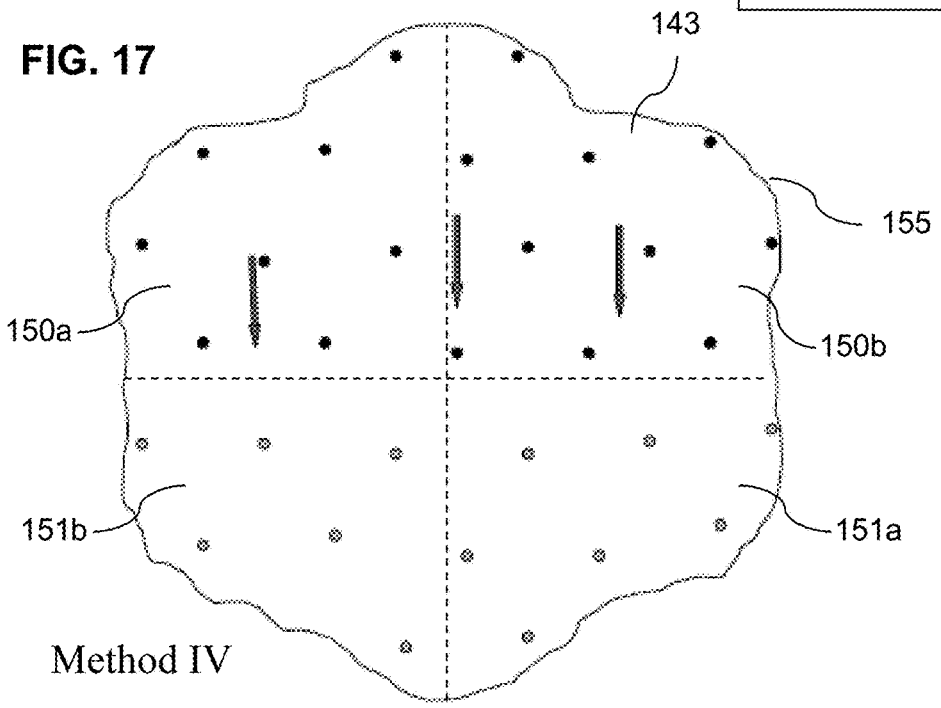
FIG. 17 illustrates an alternate embodiment of well switching step (d) according to the present invention, which is identified as 'Method VI' and which utilizes the well field in fluid communication with the plurality of interconnected cavities illustrated in FIG. 13*d;*

FIG. 17 illustrates an alternate embodiment of well switching step (d) identified as 'Method IV' which utilizes the multi-well field arrangement illustrated in FIG. 13*d*. This Method IV includes the 'bank sequence' switching technique. Wells in two adjacent quadrants 150*a* and 150*b* (thus in a half section) of mega-cavity 143 are operated in injection mode and wells in the two opposite adjacent quadrants 151*a* and 151*b* (in the other half section) of mega-cavity 143 are operated in production mode. In one embodiment, the mode of wells in half section 150*a*+150*b* is switched from injection to production, while at the same time, the wells in other half section 151*a*+151*b* are switched from production to injection mode. In an alternate embodiment, the mode of wells in quadrant 150*a* is switched from injection to production, while at the same time, the wells in the opposite quadrant 151*a* are switched from production to injection mode, so that the wells in half section 150*b*+151*a* are all operated under injection mode, and the wells in half section 150*a*+151*b* are all operated under production mode.

Figure 18:
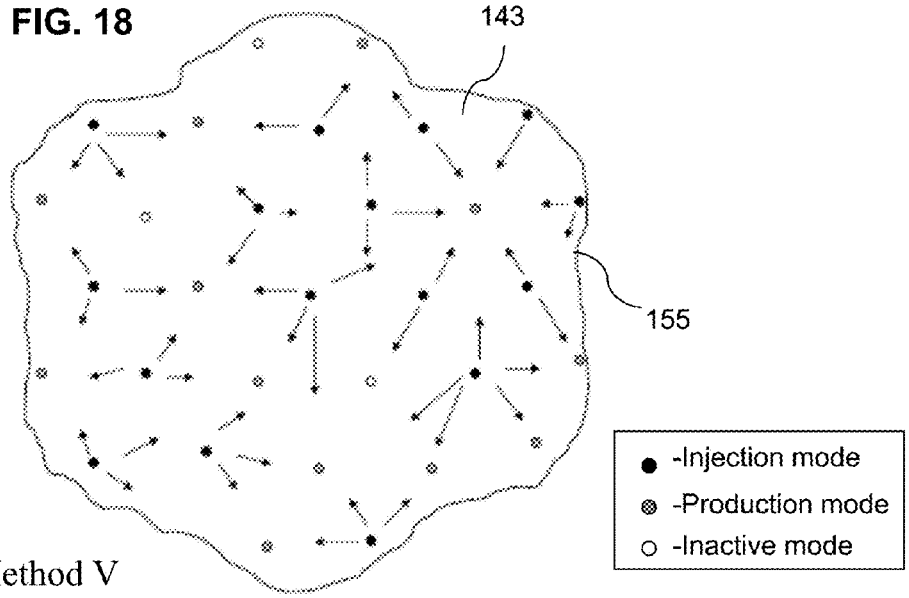
FIG. 18 illustrates yet another embodiment of well switching step (d) according to the present invention, which is identified as 'Method V' and which utilizes the well field in fluid communication with the plurality of interconnected cavities illustrated in FIG. 13*d;*

FIG. 18 illustrates yet another embodiment of well switching step (d) identified as 'Method V' which utilizes the multi-well field arrangement illustrated in FIG. 13*d*. This Method V includes the 'random sequence' switching technique. The operational mode does not necessarily follow a specific or periodic time frame and/or specific order of switching mode operations amongst the multi-well set. Rather, in this embodiment, the selection of the wells which are in injection, production, or inactive mode may be selected based on specific constraints determined from the production requirements or selected at random within the constraints of the flow requirements. For example, well switching (d) may take place in response to measurement of selected parameters which are key indicators of mineral ore solution mining performance. On the other hand, well switching (d) may take place at random timeframes and wells locations that are defined by an appropriate algorithm designed for this purpose.

In yet other embodiments (not illustrated) of well switching step (d) identified as 'Method VI' which utilizes the multi-well field arrangement illustrated in FIG. 13*d*, the set of wells comprises outermost wells, these wells preferably surrounding innermost wells including one or more centered wells. In such embodiments, switching the operation mode in step (d) for some or all of these outermost wells may be done more frequently than for the innermost wells. In preferred embodiments, switching the operation mode in step (d) for the outermost wells in the set is done preferably two times more often, more preferably three times more often, than for the innermost wells.

Figure 19A:
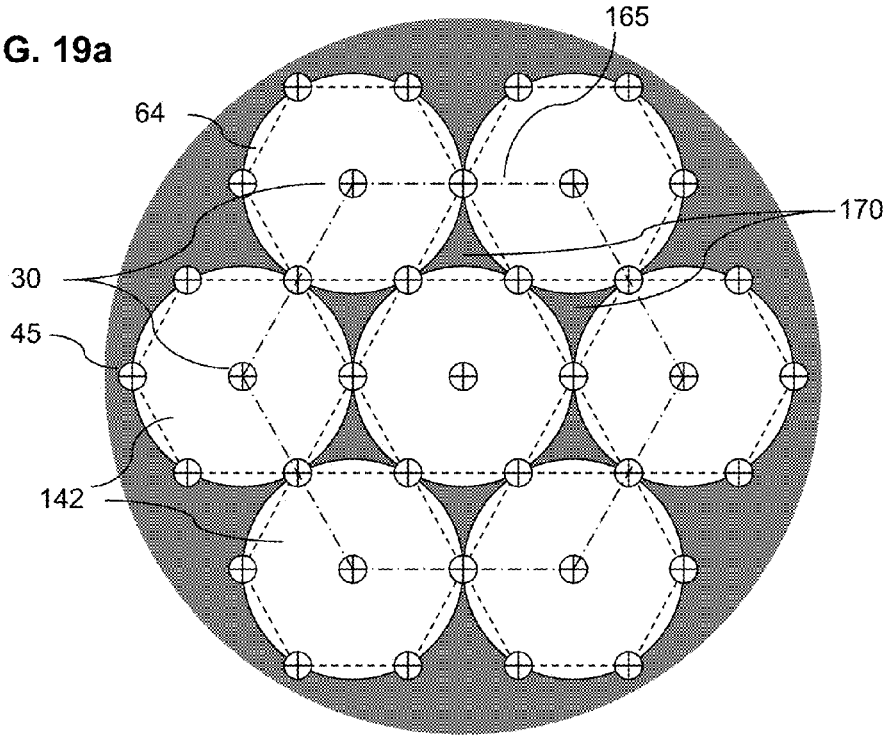
FIGS. 19*a* and 19*b* illustrate two other embodiments of well fields which can be utilized in well switching step (d) according to the present invention, each well field being in fluid communication with the plurality of interconnected cavities which are yet substantially non-overlapping, and each cavity being formed from at least one center well by lithological displacement.
Figure 19B:
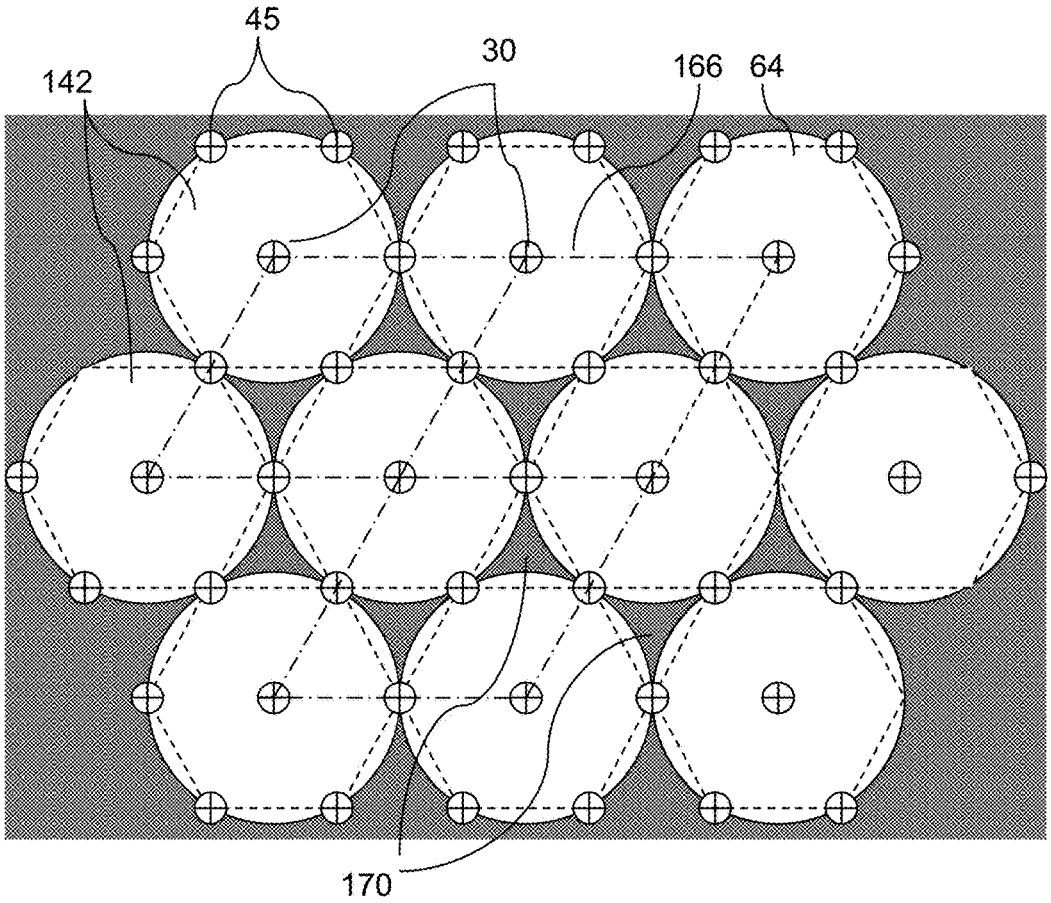

FIGS. 19*a* and 19*b* illustrate two other arrangements of a plurality of wells in fluid communication with a plurality of interconnected cavities according to an embodiment of the present invention, each cavity being formed from at least one center well by lithological displacement.

The arrangement in FIG. 19*a* for the multi-well set is similar to the arrangement in FIG. 3*c* in that the various cavities 142 are initiated from a center well 30 by lithological displacement, but rather than having totally-overlapping cavities 142, the cavities 142 in FIGS. 19*a* and 19*b* do not overlap completely, and in most instances only intersect each other at the edge of the cavities 142 (one point intersection between two adjacent cavities). Generally, these cavities 142 are tangent in a close circular packing either in a somewhat circular well field as shown in FIG. 19*a*, in which the center wells 30 are positioned on the vertices and the center of an hexagon 165 (similar to FIG. 13*a*) or in a somewhat parallepiped well field as shown in FIG. 19*b* in which the center wells 30 of the cavities 142 are positioned on the vertices of parallelograms 166 (preferably rhombi).

In these 'circular close packing' arrangements in FIGS. 19*a* and 19*b*, there is a portion of the mineral ore which remains in the form of somewhat triangular-shaped ore pillars 170. Some (or all) of the ore pillars 170 can be dissolved by switching the wells, preferable those closest to the pillars 170, between injection and production modes. Alternatively, some (or all) of the ore pillars 170 can be left in place, depending on the mechanical status of the overburden. With the ore pillars 170 in place, the theoretical extraction ratio of the mineral ore within the perimeter 155 of the mega-cavity 143' as shown in FIG. 19*b* is 90.6%.

In view of the various configurations of the multi-well set and its different techniques available to carrying the exploitation of the mineral ore, it is envisioned that any of the previously-described embodiments can be used in any combinations.

Production Solvent and Resulting Brine

The production solvent used for evaporite mineral dissolution in step (b) may be water or may comprise an aqueous solution comprising a desired solute (e.g., at least one evaporite mineral component such as at least one alkali value).

The production solvent employed in such in-situ trona solution mining method may contain or may consist essentially of water or an aqueous solution unsaturated in desired solute in which the desired solute is selected from the group consisting of sodium sesquicarbonate, sodium carbonate, sodium bicarbonate, and mixtures thereof.

The water in the production solvent may originate from natural sources of fresh water, such as from rivers or lakes, or may be a treated water, such as a water stream exiting a wastewater treatment facility. The production solvent may be caustic. An aqueous solution in the production solvent may contain a soluble compound, such as sodium hydroxide, caustic soda, any other bases, one or more acids, or any combinations of two or more thereof.

In the case of trona stratum, the production solvent may be an aqueous solution containing a base (such as caustic soda), or other compound that can enhance the dissolution of trona in the solvent. The production solvent may comprise at least in part an aqueous solution which is unsaturated in the desired solute, for example a solution which is unsaturated in sodium carbonate and which is recycled from the same solution-mined target trona bed and/or from another solution-mined trona bed which may be adjacent to or underneath the target trona bed.

The production solvent may be preheated to a predetermined temperature to increase the solubility of the mineral ore.

The production solvent employed as a solvent in the in-situ trona solution mining step may comprise or may consist essentially of a weak caustic solution for such solution may have one or more of the following advantages. The dissolution of sodium values with weak caustic solution is more effective, thus requiring less contact time with the trona ore. The use of the weak caustic solution also eliminates the 'bicarb blinding' effect, as it facilitates the in situ conversion of sodium bicarbonate to sodium carbonate (as opposed to performing the conversion ex situ on the surface after extraction to the surface). It also allows more dissolution of sodium bicarbonate than would normally be dissolved with water alone, thus providing a boost in production rate. It may further leave in the mined-out cavity an insoluble carbonate such as calcium carbonate which may be useful during the mining operation.

It should be noted that the composition of the solvent used as production solvent may be modified during the course of the trona solution mining operation. For example, water as production solvent may be used to form initially a mined-out cavity at the trona free face, while sodium hydroxide may be added to water at a later time in order to effect for example the conversion of bicarbonate to carbonate during the solution mining production step, hence resulting in greater extraction of desired alkaline values from the trona stratum 5.

The surface temperature of the injected production solvent can vary from 32° F. (0° C.) to 250° F. (121° C.), preferably up to 220° F. (104° C.).

The temperature of production solvent may be between 0° F. and 200° F. (17.7-104° C.), or between 104 and 176° F. (40-80° C.), or between 140 and 176° F. (60-80° C.), or between 100 and 150° F. (37.8-65.6° C.). The higher the injected solvent temperature, the higher the rate of dissolution at and near the point of injection.

While the production solvent is injected through the first subset of wells operated in injection mode into the at least one cavity in step (b), the solvent contacts the mineral free face as the solvent flows through the at least one cavity and dissolves in situ at least a portion of the mineral from the free face into the solvent to form a brine. The brine contains dissolved mineral.

For trona solution mining, the brine preferably comprises sodium carbonate, sodium bicarbonate, or combinations thereof.

In preferred embodiments in which trona is dissolved, the dissolution inside the cavity may be sufficient to obtain a brine saturated in sodium carbonate and/or sodium bicarbonate. The trona dissolution inside the cavity may be sufficient to obtain a TA content in the brine of at least 8 wt %, preferably at least 10%, more preferably at least 15%.

The dissolution of mineral ore in the interfacial gap or cavity may be carried out at hydrostatic head pressure (at the depth at which the solution-mined cavity is enlarged), in which the interfacial gap or cavity is filled with solvent. By flooding the interfacial gap or cavity, the production solvent contacts the ceiling of the interfacial gap or cavity and, upon contact with the mineral ore, dissolves it.

Because the mineral stratum is not pure (contains insoluble matter), a layer of insolubles may be deposited during dissolution in the mined-out cavity. This layer of insoluble separates the floor and ceiling of the mined-out cavity, while mechanically supporting the cavity ceiling and maintaining the mineral free-surface on the cavity ceiling accessible to the production solvent. The layer of insolubles at the bottom of the solution-mined cavity may provide a (porous) flow channel in the cavity for the brine to flow therethrough. Such insoluble layer gets thicker as more and more of the mineral from the cavity ceiling get dissolved, and provides, through its porosity, a channel through which the production solvent can pass.

When the mined-out cavity is self-supported by mineral rubble fractured from the cavity ceiling and/or by a layer of water insoluble material, the mineral dissolution may be carried out at a hydraulic pressure below hydrostatic head pressure. This is preferably done when the development of the mined-out cavity is mature, that is to say, when the mineral cavity created by several rounds of dissolution is now self-supported without having to apply a hydraulic pressure greater than the overburden pressure to keep it open. Due to too high overburden weight on an unsupported roof span of the mineral cavity, blocks of mineral nibbles get fractured and now lay inside the mineral cavity. In this instance, the cavity not only contains a layer of insolubles but also contains mineral nibbles which now support the cavity ceiling. In this situation, it is not necessary to flood the cavity with the production solvent to access the cavity ceiling's mineral free-surface, because the mineral nibbles now inside the cavity provide plenty of mineral free-surfaces for the production solvent to contact and dissolve to form the brine.

In step (c), at least a portion of said brine is extracted to the ground surface through the second subset of wells operated in production mode. The extracted brine via the second subset of wells (under production mode) may be recycled in part and re-injected into the cavity for additional enrichment in mineral, especially when the content of desired mineral solute of the brine is not sufficiently high.

The brine which is removed to the surface may have a surface temperature generally lower than the surface temperature of the production solvent at the time of injection. The surface temperature in the extracted brine may be at least 3° C. lower, or at least 5° C. lower, or at least 8° C. lower, or even at least 10° C. lower, than the surface temperature of the injected production solvent.

The extracted brine preferably has a chloride content being equal to or less than 0.5 wt %.

The temperature of the injected production solvent generally changes from its point of injection as it gets exposed to trona. Because the solvent temperature at time of injection is generally higher than the in situ temperature of the trona stratum, the brine loses some heat as it flows through the mined cavity until the brine gets extracted to the surface.

The flow of production solvent may depend on the size of the cavity, such as the length of its flow path inside the cavity, the desired time of contact with ore to dissolve the mineral from the free face, as well as the stage of cavity development whether it be nascent for ongoing formation or mature for ongoing production. For example, the injected fluid flow rate in injection wells may vary from 9 to 477 cubic meters per hour ($m^3$/hr) [42-2100 gallons per minute or 1-50 barrels per minute]; from 11 to 228 $m^3$/hr [50-1000 GPM or 1.2-23.8 BBL/min]; or from 13 to 114 $m^3$/hr (60-500 GPM or 1.4-11.9 BBL/min); or from 16 to 45 $m^3$/hr (70-200 GPM or 1.7-4.8 BBL/min); or from 20 to 25 $m^3$/hr (88-110 GPM or 2.1-2.6 BBL/min).

The dissolution of the desired solute may be carried out under a pressure lower than hydrostatic head pressure, or be carried out at hydrostatic head pressure. The pressure may vary depending on the depth of the target ore bed. The dissolution of the desired solute may be carried out under a pressure lower than hydrostatic head pressure (at the depth at which the solution-mined cavity is formed) during the hydraulic displacement. The dissolution of the desired solute may be carried out at hydrostatic head pressure after a mined-out cavity is formed, for example during a production phase in which the voided space in the trona stratum containing insolubles is filled with liquid solvent.

The solution mining method may further comprise injecting a blanket fluid such as compressed gas (air, N2) into the mining cavity to prevent dissolution of the ore roof into the production solvent.

With respect to any or all embodiments of the present invention, in the case of the occurrence of a 'channeling' phenomenon during solution mining, one of the possible remedies might be achieved effectively by periodically fluctuating the flows of the solvent through the various inter-connected wells in the first subset. In this way, unsaturated solvent would be forced from the bypass channels and fresh ore would be exposed to the production solvent.

Another possible remedy might be achieved effectively by introducing insoluble tailings when injecting the production solvent in order to alter the flow path of these so-formed bypass channels and expose the solvent to fresh ore. It is envisioned that tailings could be injected periodically, in an intermittent manner, or in a continuous manner. Overall this cavity development may be effectively provided to desired areas through the use of tailings to direct flows and varying flow rates, temperature and saturation levels of the injected production solvent. The tailings may also act to form a barrier from the underlying floor (shale floor) and contaminants potentially falling from the upper areas of the trona stratum. The production solvent thus may include tailings which then deposit on the floor of the mined-out cavity. Deposited tailings change flow paths through damming effects and direct the solvent flow to supplement the impact of the switching operation modes of some or all wells from production to injection and vise versa according to the present invention.

In yet another embodiment of the present invention, the solution mining method for trona ore uses the layer of insoluble rock that is deposited in the formed mined-out cavity by the dissolution of trona. This layer of insoluble separates the floor and ceiling of the mined-out cavity, while mechanically supporting the cavity ceiling, the latter one being the bottom interface for the trona rubble and the trona stratum above it. Such insoluble layer gets thicker as more and more of the trona overburden get dissolved, and provides, through its porosity, a channel through which the solvent can pass through.

With respect to any of or all embodiments of the present invention, in the case of the occurrence of a 'bicarb blinding' phenomenon during solution mining, the switching of the operation mode of at least one well according to step (d) from production to injection would jet the (unsaturated) production solvent in proximity to sodium bicarbonate which is deposited near the downhole end of this well when operated in production mode. The injection of solvent in this area targets quicker dissolution of deposited sodium bicarbonate and minimize clogging of the mineral face.

In another aspect, the present invention also relates to a manufacturing process for making one or more sodium-based products from an evaporite mineral stratum comprising a water-soluble mineral selected from the group consisting of trona, nahcolite, wegscheiderite, and combinations thereof, said process comprising:

carrying out any aspect or embodiment of the method according to the present invention to solution mine the trona stratum and to dissolve trona from the main mineral free-surface created at the strata interface into a solvent to obtain a brine comprising sodium carbonate and/or sodium bicarbonate, and passing at least a portion of said brine through one or more units selected from the group consisting of a crystallizer, a reactor, and an electrodialysis unit, to form at least one sodium-based product.

In trona solution mining, the brine extracted to the surface may be used to recover alkali values.

Examples of suitable recovery of sodium values such as soda ash, sodium sesquicarbonate, sodium carbonate decahydrate, sodium bicarbonate, and/or any other sodium-based chemicals from a solution-mined brine can be found in the disclosures of U.S. Pat. No. 3,119,655 by Frint et al; U.S. Pat. No. 3,050,290 by Caldwell et al; U.S. Pat. No. 3,361,540 by Peverley et al; U.S. Pat. No. 5,262,134 by Frint et al.; and U.S. Pat. No. 7,507,388 by Ceylan et al., and these disclosures are thus incorporated by reference in the present application.

Another example of recovery of sodium values is the production of sodium hydroxide from a solution-mined brine. U.S. Pat. No. 4,652,054 to Copenhafer et al. discloses a solution mining process of a subterranean trona ore deposit with electrodialytically-prepared aqueous sodium hydroxide in a three zone cell in which soda ash is recovered from the withdrawn mining solution. U.S. Pat. No. 4,498,706 to Ilardi et al. discloses the use of electrodialysis unit co-products, hydrogen chloride and sodium hydroxide, as separate aqueous solvents in an integrated solution mining process for recovering soda ash. The electrodialytically-produced aqueous sodium hydroxide is utilized as the primary solution mining solvent and the co-produced aqueous hydrogen chloride is used to solution-mine NaCl-contaminated ore deposits to recover a brine feed for the electrodialysis unit operation. These patents are hereby incorporated by reference for their teachings concerning solution mining with an aqueous solution of an alkali, such as sodium hydroxide and concerning the making of a sodium hydroxide-containing aqueous solvent via electrodialysis.

The manufacturing process may comprise: passing at least a portion of the brine comprising sodium carbonate and/or sodium bicarbonate:

through a sodium sesquicarbonate crystallizer under crystallization promoting conditions to form sodium sesquicarbonate crystals;

through a sodium carbonate monohydrate crystallizer under crystallization promoting conditions to form sodium carbonate monohydrate crystals;

through a sodium carbonate crystallizer under crystallization promoting conditions to form anhydrous sodium carbonate crystals;

through a sodium carbonate hydrate crystallizer under crystallization promoting conditions to form crystals of sodium carbonate decahydrate or heptahydrate;

to a sodium sulfite plant where sodium carbonate is reacted with sulfur dioxide to form a sodium sulfite-containing stream which is fed through a sodium sulfite crystallizer under crystallization promoting conditions suitable to form sodium sulfite crystals; and/or through a sodium bicarbonate reactor/crystallizer under crystallization promoting conditions comprising passing carbon dioxide to form sodium bicarbonate crystals.

In any embodiment of the present invention, the process may further include passing at least a portion of the brine through one or more electrodialysis units to form a sodium hydroxide-containing solution. This sodium hydroxide-containing solution may provide at least a part of the lifting fluid to be injected into the gap for the lifting step and/or may provide at least a part of the production solvent to be injected into the cavity for the dissolution step.

In any embodiment of the present invention, the process may further comprise pre-treating and/or enriching with a solid mineral and/or purifying (impurities removal) the extracted brine before making such product.

The present invention further relates to a sodium-based product obtained by the manufacturing process according to the present invention, said product being selected from the group consisting of sodium sesquicarbonate, sodium carbonate monohydrate, sodium carbonate decahydrate, sodium carbonate heptahydrate, anhydrous sodium carbonate, sodium bicarbonate, sodium sulfite, sodium bisulfite, sodium hydroxide, and other derivatives.

The present invention having been generally described, the following Examples are given as particular embodiments of the invention and to demonstrate the practice and advantages thereof. It is understood that the examples are given by way of illustration and is not intended to limit the specification or the claims to follow in any manner.

EXAMPLES

Example 1

Ore dissolution in a 7-well set, such as illustrated in FIG. 4*e* (hexagonal pattern for well arrangement), which is in fluid communication with a cavity created by lithological displacement was investigated via computer modeling to find the optimal injection/production flow patterns.

Each well in the set could be an injection well, a production well, or an inactive well. The constraints applied in the 7-well set were as follows: each 7-well set had at least one production well and at least one injection well, and thus could have from 0 up to 5 inactive wells.

For this 7-well pattern and constraints, there are 1,932 possible injection/production patterns. Out of the 1,932 possible patterns, only 255 fundamental flow patterns are unique after the reflection and rotation symmetries of the hexagonal shape are considered, the remainder of the patterns being derived patterns from reflection and rotation symmetries. A fundamental 7-well flow pattern could have from 0 derived pattern up to 11 derived patterns. For example, FIGS. 4*b* to 4*d* illustrate three of the derived flow patterns of the fundamental flow pattern illustrated in FIG. 4*a*.

It is estimated that combining the use of all of the 1,932 7-well flow patterns in the switching step would provide about 60% uniformity of dissolution of the cavity. However, specific (fundamental+derived) flow patterns can provide better uniformity of dissolution than randomly selected patterns. Optimal pattern selections can provide at least 70% uniformity of dissolution, preferably at least 75% uniformity of dissolution, more preferably at least 80% uniformity of dissolution, most preferably at least 85% uniformity of dissolution. It is further expected that through application of repetitive switching between the various (fundamental+ derived) flow patterns which are producing the highest levels (e.g., greater than 85%) of dissolution uniformity, it should be possible to achieve a dissolution uniformity approaching 100%.

TABLE 2 provides estimated dissolution uniformity for 18 examples of 7-well patterns (wells switching in the fundamental and derived flow patterns) using the hexagonal configuration in FIG. 4*e* with a center well 30 and six peripheral wells 45*x* (x being a to f). The operation mode for each of the 7 wells in the fundamental flow pattern in Examples 1A-1R is identified in TABLE 2 as 'I' for injection well, 'P' for production well, and 'C' for inactive (or closed) well.

Examples 1A to 1O demonstrate greater than 85% uniform dissolution of the cavity (from 87 to 90%). FIG. 20*a*, 21*a*, 22*a*, 23*a*, 24*a* illustrate the 7-well fundamental flow patterns of Examples 1A, 1D, 1G, 1J, and 1M respectively, while FIG. 20*b*, 21*b*, 22*b*, 23*b*, 24*b* illustrate the estimated resulting cavity dissolution by switching well operation mode for each respective fundamental pattern and its derived patterns, the darker color indicating areas of greater vertical dissolution. Most of the fundamental 7-well flow patterns with relatively uniform dissolution (>85%) appear to have a production or inactive well in the center well 30.

TABLE 2

| Ex. | Well position on hexagonal pattern of FIG. 4e | | | | | | | No. of derived | Estimated dissolution uniformity |
|---|---|---|---|---|---|---|---|---|---|
| No | 30 | 45a | 45b | 45c | 45d | 45e | 45f | patterns | (%) |
| 1A | P | C | C | I | C | I | I | 11 | 89.27 |
| 1B | P | C | I | P | I | C | P | 5 | 88.92 |
| 1C | P | C | C | C | I | P | I | 5 | 88.81 |
| 1D | P | C | C | C | I | P | P | 11 | 88.73 |
| 1E | P | C | C | I | C | P | I | 11 | 88.71 |
| 1F | P | C | I | C | I | P | P | 11 | 88.68 |
| 1G | P | C | C | C | I | C | P | 5 | 88.25 |
| 1H | P | C | C | I | C | I | P | 11 | 88.22 |
| 1I | P | C | I | P | I | P | P | 11 | 87.97 |
| 1J | C | C | C | I | P | P | P | 11 | 87.82 |
| 1K | C | C | C | I | P | C | P | 11 | 87.61 |
| 1L | P | C | C | I | C | C | I | 2 | 87.57 |
| 1M | P | C | I | C | I | C | P | 5 | 87.41 |
| 1N | P | C | I | C | I | I | I | 5 | 87.15 |
| 1O | P | C | I | C | I | P | I | 5 | 87.03 |
| 1P | I | C | I | I | C | P | P | 5 | Poor |
| 1Q | I | C | I | I | I | P | P | 11 | Poor |
| 1R | I | I | I | I | P | P | P | 5 | Poor |

On the other end, Examples 1P to 1R provide poor and uneven dissolution of the cavity. FIG. 25*a*, 26*a*, 27*a* illustrate the 7-well fundamental flow patterns of Examples 1P, 1Q, 1R, respectively, while FIG. 25*b*, 26*b*, 27*b* illustrate the estimated resulting uneven cavity dissolution by switching well operation mode using each respective fundamental pattern and its derived patterns, the lighter color indicating areas of poor vertical dissolution. Most of the fundamental 7-well flow patterns with relatively uneven dissolution appear to have an injection well in the center well 30.

The Examples 1A to 1R above show the modeling results for dissolution uniformity when using each fundamental flow pattern with its derived patterns based on symmetry and rotation); however various fundamental flow patterns and respective derived patterns may be employed for the switching step (d), and the result on dissolution uniformity would exceed what can be achieved with a single fundamental flow pattern.

Example 2

Ore dissolution in a 31-well set, such as illustrated in FIG. 13*c* (a set with 1 center hexagonal pattern and 6 contiguous peripheral hexagonal patterns), which is in fluid communication with a cavity created by lithological displacement was investigated via computer modeling to find the optimal injection/production flow patterns. A set of wells this large should be capable of producing sufficient volumes of solution mined sodium brine to provide a substantial portion of a commercial-scale plant ore feed. Therefore, a 31-well set would be considered a "well field" in practical applications.

For this 31-well pattern, there are more than 617 trillions of possible well operation patterns. To limit the number of modeling runs, the 31-well patterns were limited to initially use in each hexagonal pattern an injection well in position 30 (center well in each hexagonal pattern) and production wells in positions 45 (peripheral wells in each hexagonal pattern).

Alternating between injection and productions modes in each adjacent well pairs provide a good dissolution uniformity, especially in the region covered from the centered well of the 31-well field up to about the center wells 30 of the 6 peripheral hexagonal shapes. The dissolution though is estimated to be poorer near the outer annular edge of the 31-well field in the region covered from about the centered wells 30 of the 6 peripheral hexagonal patterns to the outermost peripheral wells 45.

The Applicant has surprisingly found by way of these simulations that by increasing the frequency of operation mode switching in these outermost well pairs of the 31-well pattern compared to that of the operation mode switching of the other well pairs, the dissolution would become more uniform near the outermost region of the 31-well field. Further, these studies have clearly indicated that through the use of optimal well switching patterns, including re-injection of unsaturated brines from certain wells, a fully saturated production brine could be created while developing highly uniform dissolution profiles over very large areas. Achieving at least 85% to nearly 100% uniformity of cavity dissolution, approaching or achieving full brine saturation (including the use of re-injection of at least a portion of unsaturated brine), and large-scale mining and production operation are believed to be three of the key attributes of a successful in situ trona solution mining method.

The disclosure of all patent applications, and publications cited herein are hereby incorporated by reference, to the extent that they provide exemplary, procedural or other details supplementary to those set forth herein.

Should the disclosure of any of the patents, patent applications, and publications that are incorporated herein by reference conflict with the present specification to the extent that it might render a term unclear, the present specification shall take precedence.

Accordingly, the scope of protection is not limited by the description set out above, but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. While preferred embodiments of this invention have been shown and described, modifications thereof can be made by one skilled in the art without departing from the spirit or teaching of this invention. The embodiments described herein are exemplary only and are not limiting. Many variations and modifications of systems and methods are possible and are within the scope of the invention.

What we claimed is:

1. In an underground formation comprising an evaporite mineral stratum comprising trona, wegscheiderite, or combinations thereof, a method for solution mining an evaporite mineral from at least one cavity having a mineral free face, said method comprising:

a) providing a set of at least three wells in fluid communication with the at least one cavity, said set comprising a first subset of wells being operated in injection mode and a second subset of separate wells operated in production mode;

b) injecting a solvent into the at least one cavity through the first subset operated in injection mode for the solvent to contact the mineral free face as the solvent flows through the at least one cavity and to dissolve in situ at least a portion of the mineral from the free face into the solvent to form a brine;

c) extracting at least a portion of said brine to the ground surface through the second subset of wells operated in production mode;

d) switching the operation mode of at least one well from the set after a period of time; and (e) repeating the steps (a) to (d), wherein the set of wells comprises outermost wells surrounding innermost wells, and switching the operation mode in step (d) for at least some of these outermost wells is more frequently than for the innermost wells, or wherein the operation mode switching step (d) is performed on peripheral wells of the set to impart a rotating motion of solvent around a centered well of the set.

2. The method according to claim 1, wherein the wells in the set are paired, and wherein cross-over valves are provided and controlled so that the paired wells serve alternatively as injection and production wells.

3. The method according to claim 1, wherein the set of wells comprises from 4 to 100 wells.

4. The method according to claim 1, wherein steps (b) and (c) is facilitated by a pump, and wherein, when one of the wells switches operation mode in step (d), the solvent injection and brine production for this well are carried out by the same pump.

5. The method according to claim 1, wherein step (d) comprises switching the operation mode of at least one well from the first subset and also switching the operation mode of at least one well from the second subset after the suitable period of time.

6. The method according to claim 1, wherein the method further comprises:

carrying out step (f): switching at least one well from the first or second subset from an injection or production mode to an inactive mode; or carrying out step (f'): switching at least one well from the set from an inactive mode to an injection or production mode; or carrying out step (f) and (f) simultaneously on at least two different wells from the set.

7. The method according to claim 1, wherein the at least one cavity is initially formed by a lithological displacement of the mineral stratum, said lithological displacement being performed when said mineral stratum is lying immediately above a water-insoluble stratum of a different composition with a weak parting interface being defined between the two strata and above which is defined an overburden up to the ground surface, said lithological displacement comprising injecting a fluid at the parting interface to lift the evaporite stratum at a lifting hydraulic pressure greater than the overburden pressure, thereby forming an interface gap which is a nascent mineral cavity at the interface and creating said mineral free-surface.

8. The method according to claim 1, wherein the at least one cavity is initially formed by a lithological displacement of the mineral stratum, and wherein forming the at least one cavity by lithological displacement of the mineral stratum comprises applying a lifting hydraulic pressure characterized by a fracture gradient between 0.9 psi/ft (20.4 kPa/m) and 1.5 psi/ft (34 kPa/m).

9. The method according to claim 1, wherein the at least one cavity is initially formed from at least one uncased section of a borehole directionally drilled through the mineral stratum.

10. The method according to claim 1, wherein the injected solvent in step (b) comprises an unsaturated aqueous solution comprising sodium carbonate, sodium bicarbonate, sodium hydroxide, calcium hydroxide, or combinations thereof.

11. The method according to claim 1, wherein the set of wells comprises outermost wells surrounding innermost wells, and wherein in that switching the operation mode in step (d) for at least some of these outermost wells is more frequently than for the innermost wells.

12. The method according to claim 1, wherein the operation mode switching step (d) is performed on peripheral wells of the set to impart a rotating motion of solvent around a centered well of the set.

13. The method according to claim 1, wherein the at least one cavity is initially formed by one or more borehole horizontal sections drilled through the mineral stratum.

14. The method according to claim 1, wherein the injected solvent in step (b) comprises an aqueous alkaline solution.

15. The method according to claim 1, wherein the suitable period of time for switching operation mode in step (d) is from 1 hour to 1 week.

16. A manufacturing process for making one or more sodium-based products from an evaporite mineral stratum comprising a water-soluble mineral ore selected from the group consisting of trona, wegscheiderite, and combinations thereof, the process comprising:

carrying out the method according to claim 1 to dissolve the water-soluble mineral ore from said at least one cavity in said evaporite mineral stratum to obtain said brine comprising sodium carbonate and/or sodium bicarbonate, and passing at least a portion of said brine through one or more units selected from the group consisting of a crystallizer, a reactor, and an electrodialysis unit, to form at least one sodium-based product, the at least one sodium-based product being selected from the group consisting of soda ash, sodium bicarbonate, sodium hydroxide, sodium sulfite, sodium sesquicarbonate, any sodium carbonate hydrates, and any combination thereof.

* * * * *